US005647101A

United States Patent [19]

Morita

[11] Patent Number: 5,647,101

[45] Date of Patent: Jul. 15, 1997

[54] WEIGHT REDUCED MAGNETIC FASTENER

[75] Inventor: Tamao Morita, Tokyo, Japan

[73] Assignee: Tarmo Co., Ltd., Tokyo, Japan

[21] Appl. No.: 522,952

[22] Filed: Sep. 1, 1995

[30] Foreign Application Priority Data

Sep. 2, 1994 [JP] Japan ..... 6-232501

[51] Int. Cl.[6] ..... A44B 21/00

[52] U.S. Cl. ..... 24/303

[58] Field of Search ..... 24/303, 66.1; 248/206.5; 292/251.5; 335/285

[56] References Cited

U.S. PATENT DOCUMENTS

| | | | |
|---|---|---|---|
| D. 247,468 | 3/1978 | Morita . | |
| 4,480,361 | 11/1984 | Morita | 24/303 |
| 4,736,494 | 4/1988 | Marchesi | 24/303 |

FOREIGN PATENT DOCUMENTS

| | | | |
|---|---|---|---|
| 58-108714 | 6/1983 | Japan | 335/285 |
| 58-145106 | 8/1983 | Japan | 335/285 |
| 59-18615 | 1/1984 | Japan | 335/285 |
| 59-119804 | 7/1984 | Japan | 335/285 |

*Primary Examiner*—James R. Brittain

*Attorney, Agent, or Firm*—Pennie & Edmonds LLP

[57] ABSTRACT

A magnetic fastener has a fastening element and an attracted element. The fastening element has a permanent magnet with a hole substantially parallel to the direction of the magnetic poles and a ferromagnetic plate on one side of the magnet facing the hole. The attracted element also has a ferromagnetic plate adapted for connecting to the open side side of the magnet facing the hole. Either one or both of the first and second plate can have a ferromagnetic rod that extends into the magnet hole. If only one rod is formed, the length of it extends substantially the depth of the magnet so that when the attracted element is connected to the fastening element, the end of the rod is near or contacting the opposing ferromagnetic plate through the magnet hole. If a rod is formed on each plate, the combined length of the rods is such that the ends thereof are near or touching within the magnet hole when the attracted element is fully engaged to the fastening element. In any event, at least one of the rods has a blind hole extending from the respective plate toward the respective end of the rod. The blind hole cross-sectional area is at least 2.2% but no more than 88.9% that of the rod.

10 Claims, 54 Drawing Sheets

FIG. 20A
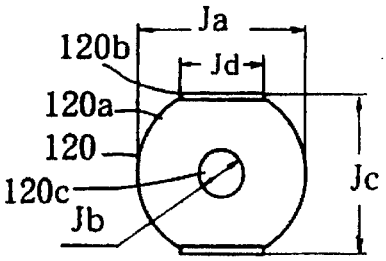
FIG. 20B
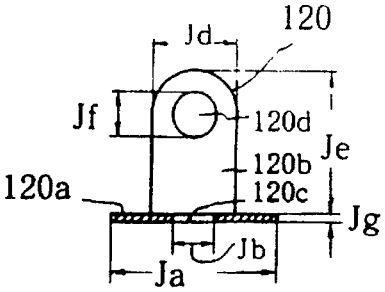
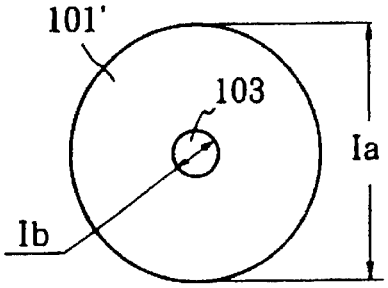
FIG. 20C
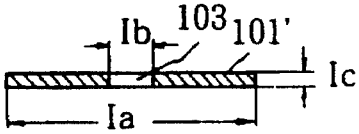
FIG. 20D
FIG. 20E
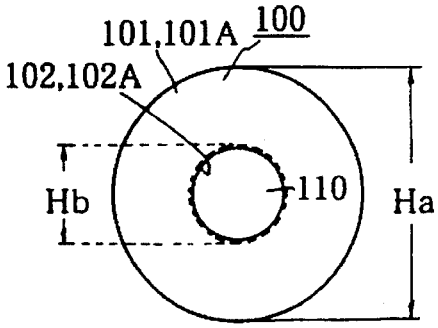
FIG. 20F
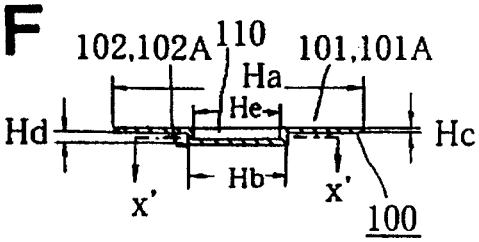
FIG. 20G
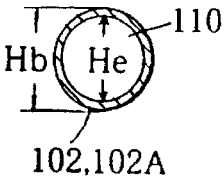

FIG 21A
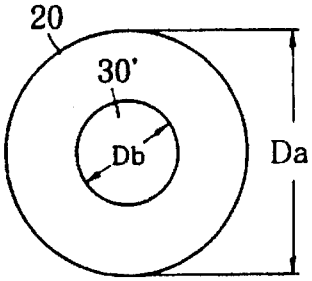
FIG. 21C
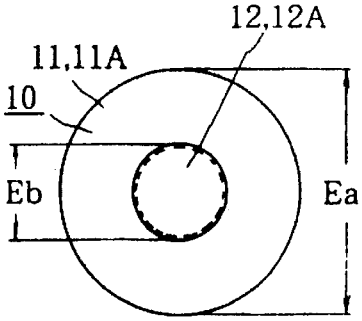
FIG.21E
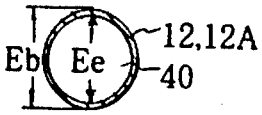
FIG 21B
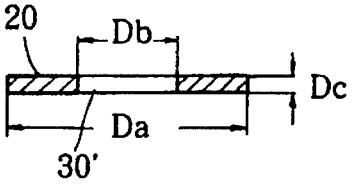
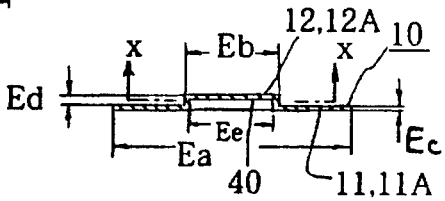
FIG. 21D
FIG.21F
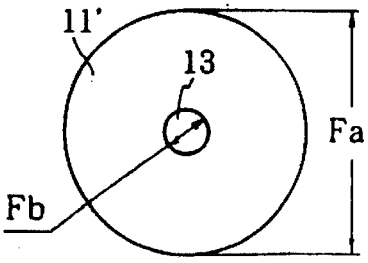
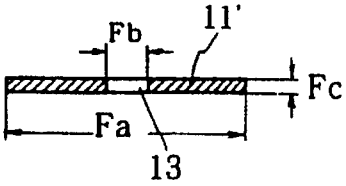
FIG. 21G
FIG. 21H
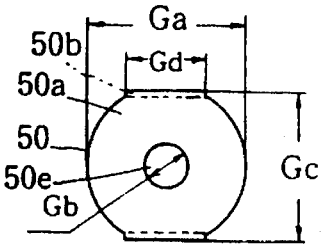
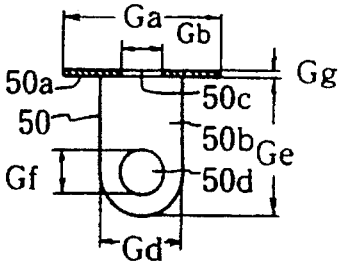
FIG. 21I FIG. 25A
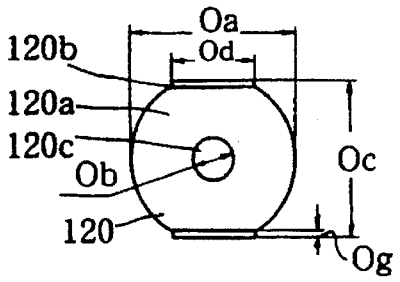
FIG. 25B
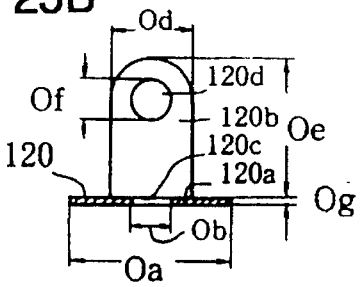
FIG. 25C
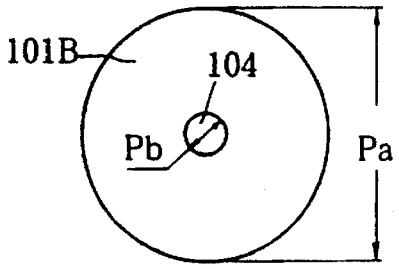
FIG. 25D
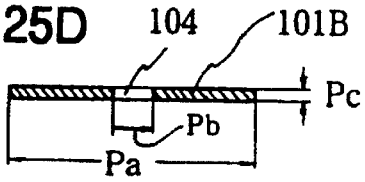
FIG. 25E
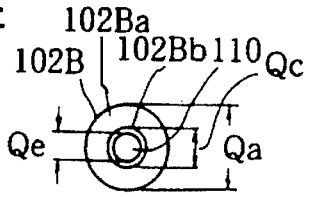
FIG. 25F
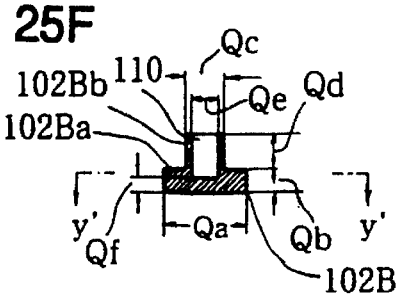
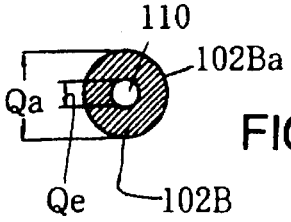
FIG. 25G FIG. 26A
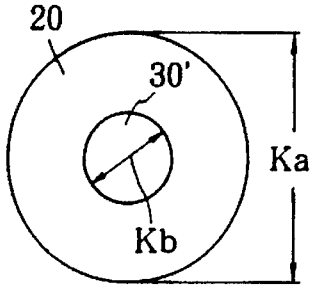
FIG. 26C
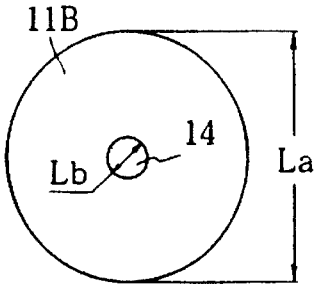
FIG 26B
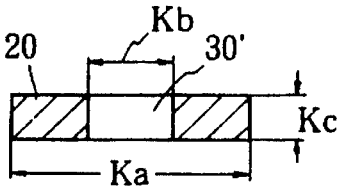
FIG. 26D
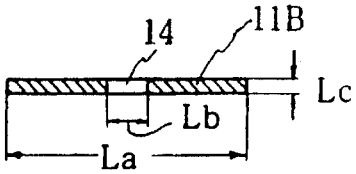
FIG. 26E
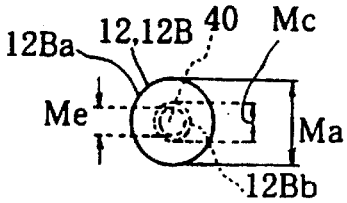
FIG. 26H
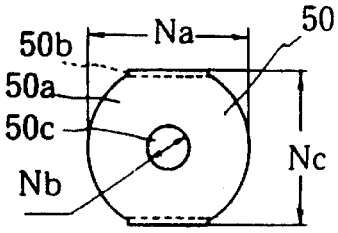
FIG. 26F
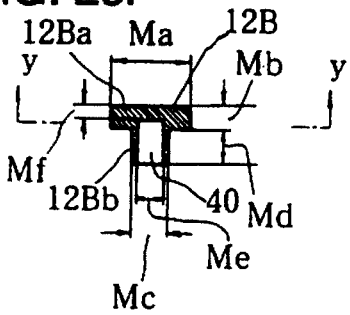
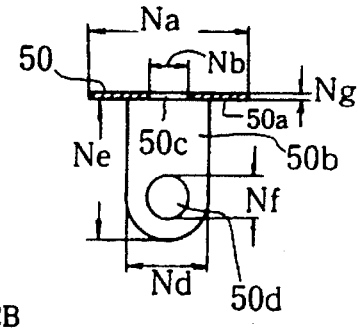
FIG. 26I
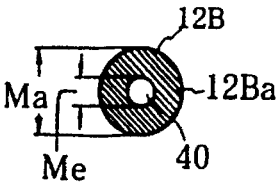
FIG. 26G FIG. 36A
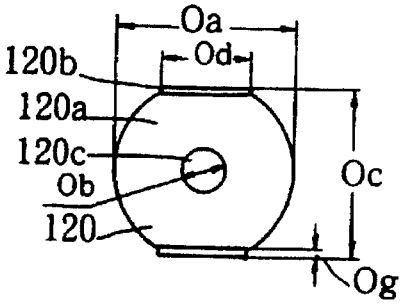
FIG. 36B
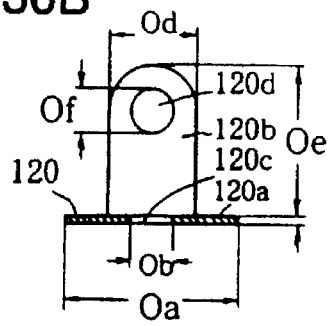
FIG. 36C
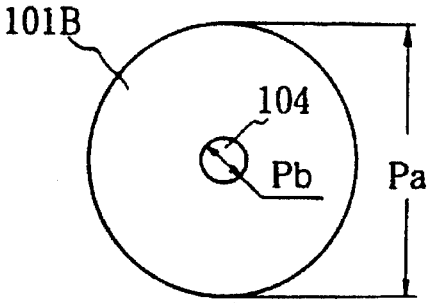
FIG. 36D
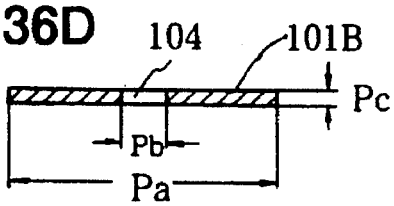
FIG. 36E
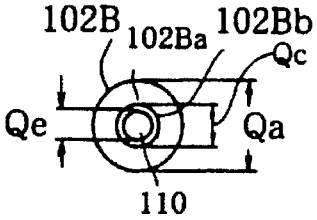
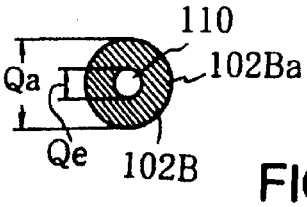
FIG. 36G
FIG. 36F
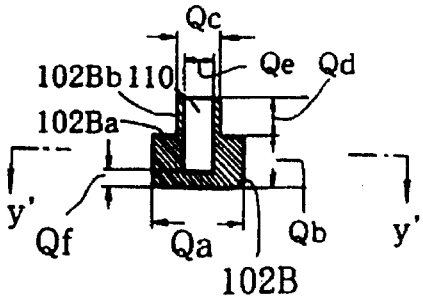

FIG. 44A
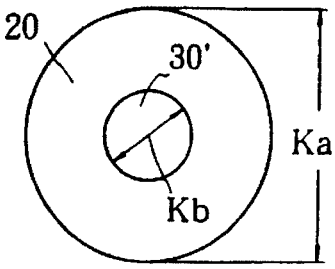
FIG. 44C
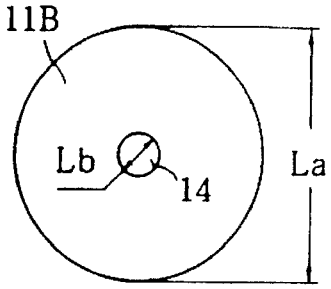
FIG. 44B
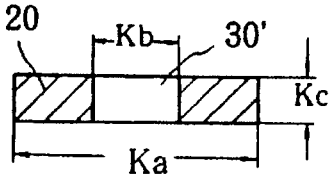
FIG. 44D
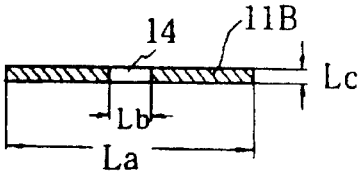
FIG. 44E
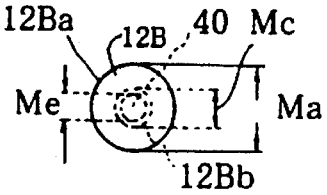
FIG. 44H
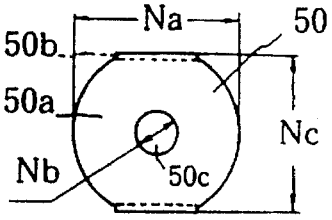
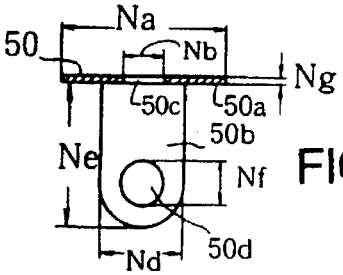
FIG. 44I
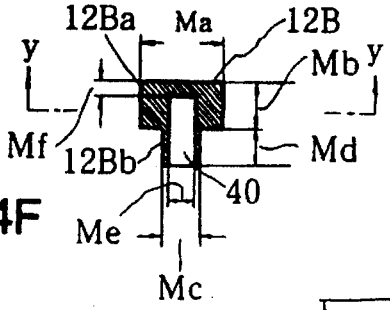
FIG. 44F
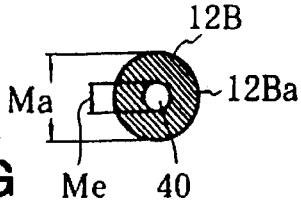
FIG 44G

WEIGHT REDUCED MAGNETIC FASTENER

BACKGROUND

A fastener based on a permanent magnet is available in variety of structures depending upon the purpose for which it is designed. Such a fastener has been widely used for a variety of purposes, for its simpleness and ease of use and handling. One typical fastener based on permanent magnet is described in Japanese utility model JP 54-3923. This fastener has a female fastening element and a male fastening element. The female element has a permanent magnet with a hole and a ferromagnetic plate with a rod extending from one side of it. The plate is attached to the magnet at one pole side with the rod extending into the hole. The male fastening element has a ferromagnetic plate with a projection extending from one side of it. The magnet hole is adapted to accommodate insertion of the projection from the opposite side or opposite pole of the magnetic. This design makes it possible for the male or female element to come together and be separated. The structure disclosed in Japanese utility model JP 54-3923 is such that the magnet serves as a component of both the female and male fastening elements. The magnetism is furthermore enhanced by the plates and the projection, both of which serve to complete the magnetic circuit. Thus, a fastener disclosed in the Japanese utility model JP 54-3923 provides strong magnetic attraction.

Although this type of fastener provides a good holding strength, however, it tends to be heavy because it uses solid metal plates with solid projections or rods. To this end, the fastener under described in U.S. Patent Des. 247,468 contemplates use of a hollow rod, thus reducing the fastener weight. Although the weigh reduction is desirable, the hollow rod concept has not been utilized and no consideration was given to what magnetic force is best suited for a given fastener. In fact, no attempt has even been made in the past to determine an optimum relationship between the extent of weight reduction and magnetic force required, when a hollow rod, as opposed to a solid rod, is used.

SUMMARY

According to the present invention, the magnetic fastener provides an optimum balance between the magnetic strength and its weight. This is contemplated in the present invention by providing a fastening element and an attracted element. The fastening element has a magnet with a hole and a first ferromagnetic plate attracted to one magnet pole side. The attracted element has a second ferromagnetic plate adapted for attracting to the opposite (other magnet pole) side. The first or second ferromagnetic plate has a ferromagnetic rod protruding or extending from one side of it. The rod is adapted to be inserted into the magnet hole and preferably extends to the opposing plate when the attracted element is fully connected to the fastening element. The rod has a blind hole extending from the respective plate toward its tip or apex. The blind hole cross-sectional area is at least 2.2% but not more than 88.9% that of the rod, the cross-sectional area taken parallel to the surface of the respective plate.

Specifically, in one embodiment, the rod protrudes from the second plate and is positionable through the magnet hole and contacts or is near the first plate when the attracted element is fully connected to the fastening element. In another embodiment, the rod protrudes from the first plate instead of the second plate. In this embodiment, the rod remains inside the magnet hole and extends substantially flush with the opposite magnetic pole side so that the rod end also contacts or is near the second plate when the second plate is fully attracted (connected) to the opposite magnetic pole side of the fastening element. Again, the rod has a blind hole extending from the first plate toward the tip end of the rod, with the blind hole cross-sectional area being preferably at least 2.2% but not more than 88.9% that of the rod.

According to another embodiment, the first and second plates each have a ferromagnetic rod extending from one side thereof and adapted to be inserted into the magnet hole. And both rods each have a blind hole extending from their respective plates toward near the tip end of the rod, with the cross-sectional area of each blind hole being preferably at least 2.2% but not more than 88.9% of the rod cross-sectional area.

Due to the blind hole dimension, the overall weight of the fastener is reduced.

BRIEF DESCRIPTION OF THE DRAWINGS

These and other features, aspects, and advantages of the present invention will become much more apparent from the following description, appended claims, and accompanying drawings where:

FIGS. 20A–20G show the components of the attracted element of FIG. 19, where:

FIG. 20A is a top elevational view of the attaching element;

FIG. 20B is a side cross-sectional view of the attaching element;

FIG. 20C is a top elevational view of the supplemental ferromagnetic plate member;

FIG. 20D is a side cross-sectional view of the supplemental ferromagnetic plate member;

FIG. 20E is a top elevational view of the ferromagnetic plate member;

FIG. 20F is a side cross-sectional view of the ferromagnetic plate member; and FIG. 20G is a cross-sectional view of the ferromagnetic rod.

FIGS. 21A–20I show the components of the fastening element of FIG. 19, where:

FIG. 21A is a top elevational view of the magnet;

FIG. 21B is a side cross-sectional view of the magnet;

FIG. 21C is a top elevational view of the ferromagnetic plate member;

FIG. 21D is a side cross-sectional view of the ferromagnetic plate member;

FIG. 21E is a cross-sectional view of the ferromagnetic rod;

FIG. 21F is a top elevational view of the supplemental ferromagnetic plate member;

FIG. 21G is a side cross-sectional view of the supplemental ferromagnetic plate member;

FIG. 21H is a top elevational view of the attaching element; and

FIG. 21I is a side cross-sectional view of the attaching element.

FIGS. 25A–25G show the components of the attracted element of FIG. 24, where:

FIG. 25A is a top elevational view of the attaching element;

FIG. 25B is a side cross-sectional view of the attaching element;

FIG. 25C is a top elevational view of the ferromagnetic plate member;

FIG. 25D is a side cross-sectional view of the ferromagnetic plate member;

FIG. 25E is a top elevational view of the ferromagnetic rod;

FIG. 25F is a side cross-sectional view of the ferromagnetic rod; and

FIG. 25G is a cross-sectional view of the ferromagnetic rod taken along the line y'—y' of FIG. 25F.

FIGS. 26A–20I show the components of the fastening element of FIG. 24, where:

FIG. 26A is a top elevational view of the magnet;

FIG. 26B is a side cross-sectional view of the magnet;

FIG. 26C is a top elevational view of the ferromagnetic plate member;

FIG. 26D is a side cross-sectional view of the ferromagnetic plate member;

FIG. 26E is a top elevational view of the ferromagnetic rod;

FIG. 26F is a side cross-sectional view of the ferromagnetic rod;

FIG. 26G is a cross-sectional view of the ferromagnetic rod taken along the line y—y of FIG. 26F;

FIG. 26H is a top elevational view of the attaching element; and

FIG. 26I is a cross-sectional side view of the attaching element.

FIGS. 36A–36G show the components of the attracted element of FIG. 35, where:

FIG. 36A is a top elevational view of the attaching element;

FIG. 36B is a side cross-sectional view of the attaching element;

FIG. 36C is a top elevational view of the ferromagnetic plate member;

FIG. 36D is a side cross-sectional view of the ferromagnetic plate member;

FIG. 36E is a top elevational view of the ferromagnetic rod;

FIG. 36F is a side cross-sectional view of the ferromagnetic rod; and

FIG. 36G is a cross-sectional view of the ferromagnetic rod taken along the line y'—y' of FIG. 36F.

FIG. 37A is a top elevational view of the magnet;

FIG. 37B is a side cross-sectional view of the magnet;

FIG. 37C is a top elevational view of the ferromagnetic plate member;

FIG. 37D is a side cross-sectional view of the ferromagnetic plate member;

FIG. 37E is a top elevational view of the attaching element; and

FIG. 37F is a cross-sectional side view of the attaching element.

FIG. 43A is a top elevational view of the attaching element;

FIG. 43B is a side cross-sectional view of the attaching element;

FIG. 43C is a top elevational view of the ferromagnetic plate member; and

FIG. 43D is a side cross-sectional view of the ferromagnetic plate member.

FIGS. 44A–44I show the components of the fastening element of FIG. 42, where:

FIG. 44A is a top elevational view of the magnet;

FIG. 44B is a side cross-sectional view of the magnet;

FIG. 44C is a top elevational view of the ferromagnetic plate member;

FIG. 44D is a side cross-sectional view of the ferromagnetic plate member;

FIG. 44E is a top elevational view of the ferromagnetic rod;

FIG. 44F is a side cross-sectional view of the ferromagnetic rod;

FIG. 44G is a cross-sectional view of the ferromagnetic rod taken along the line y—y of FIG. 44F;

FIG. 44H is a top elevational view of the attaching element; and

FIG. 44I is a cross-sectional side view of the attaching element.

DESCRIPTION OF THE DRAWINGS

Figure 1:
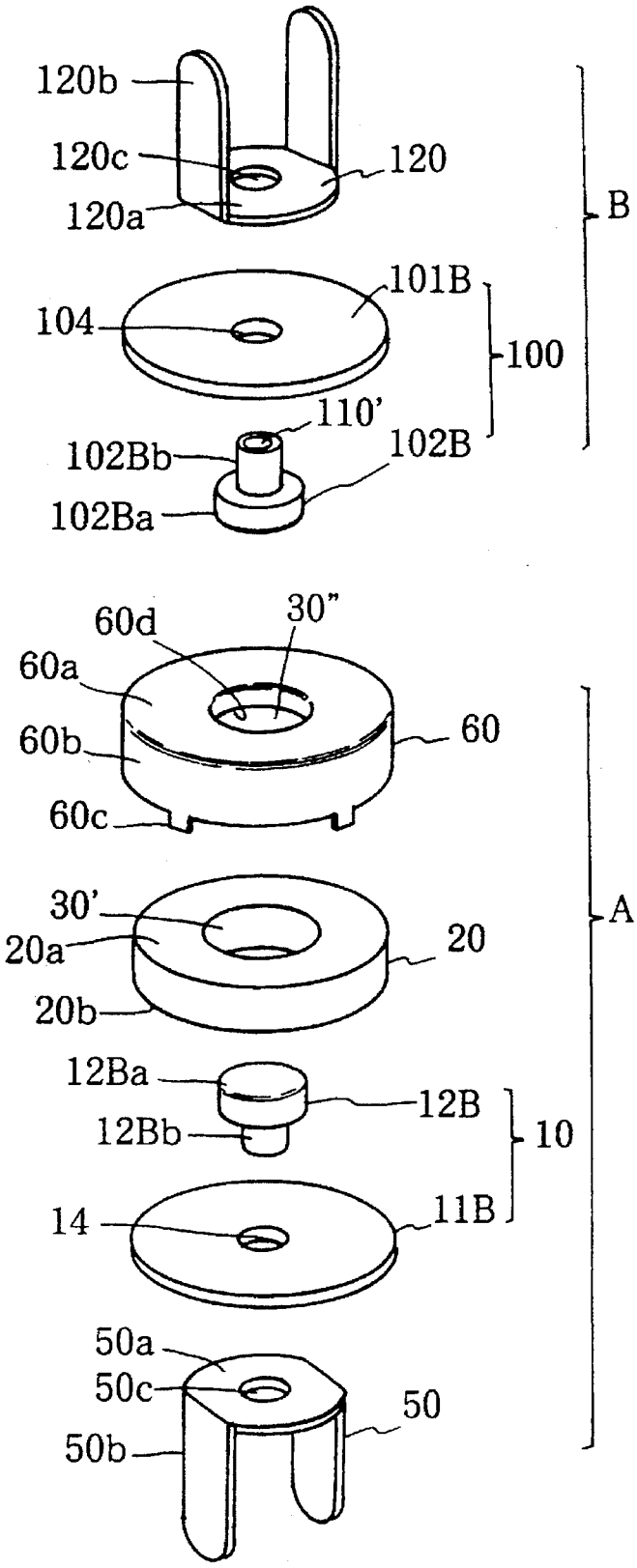
FIG. 1 is an exploded perspective view of a magnetic fastener according to one embodiment of the present invention.

The drawings show various embodiments of the present invention. For convenience, the same or equivalent elements of different embodiments have been identified with the same reference numerals.

All of the fasteners according to the present and shown in the drawings have a fastening element A and attracted element B, with the fastening element including a permanent magnet 20 having a central hole 30, and a ferromagnetic plate member 10 either without or with a ferromagnetic rod 12 extending from one side of it, and an attaching element 50. The attracted element B also has a ferromagnetic plate member 100 either without or with a ferromagnetic rod 102 extending from one side of it. In any event, at least one of the plate members 10 and 100 has a ferromagnetic rod 12 or 102, each preferably with a blind hole 40, 110, the cross-sectional area of which is at least 2.2% but no more than 88.9% that of the rod itself, the cross-sectional area being parallel to the surface of the respective plate 11, 101. The blind hole may be filled with ferromagnetic or non-ferromagnetic material if desired.

The fastener according to the present invention can be attached to any object 200 that requires fastening such as handbags, bags, containers. The present fastener can also be used to hold doors open or closed, fasten belts or laces to doors, or even used instead of buttons in clothing.

The permanent magnet 20 used in the present fastener may be a flat magnet stone, arnica magnet stone, mangan alumni magnetic stone or other magnetic stone materials, or other magnetic materials such as samarium cobalt magnetic stone, neogium, ferromagnetic, bron magnetic stone, as long as it magnetically attracts element B. The ferromagnetic elements used in the fastener typically should be materials that have a high magnetic conductivity. The permanent magnet can also include plastic and rubber magnets that are doughnut-shaped with a central hole extending in the direction of or parallel to the magnetic poles.

Figure 2:
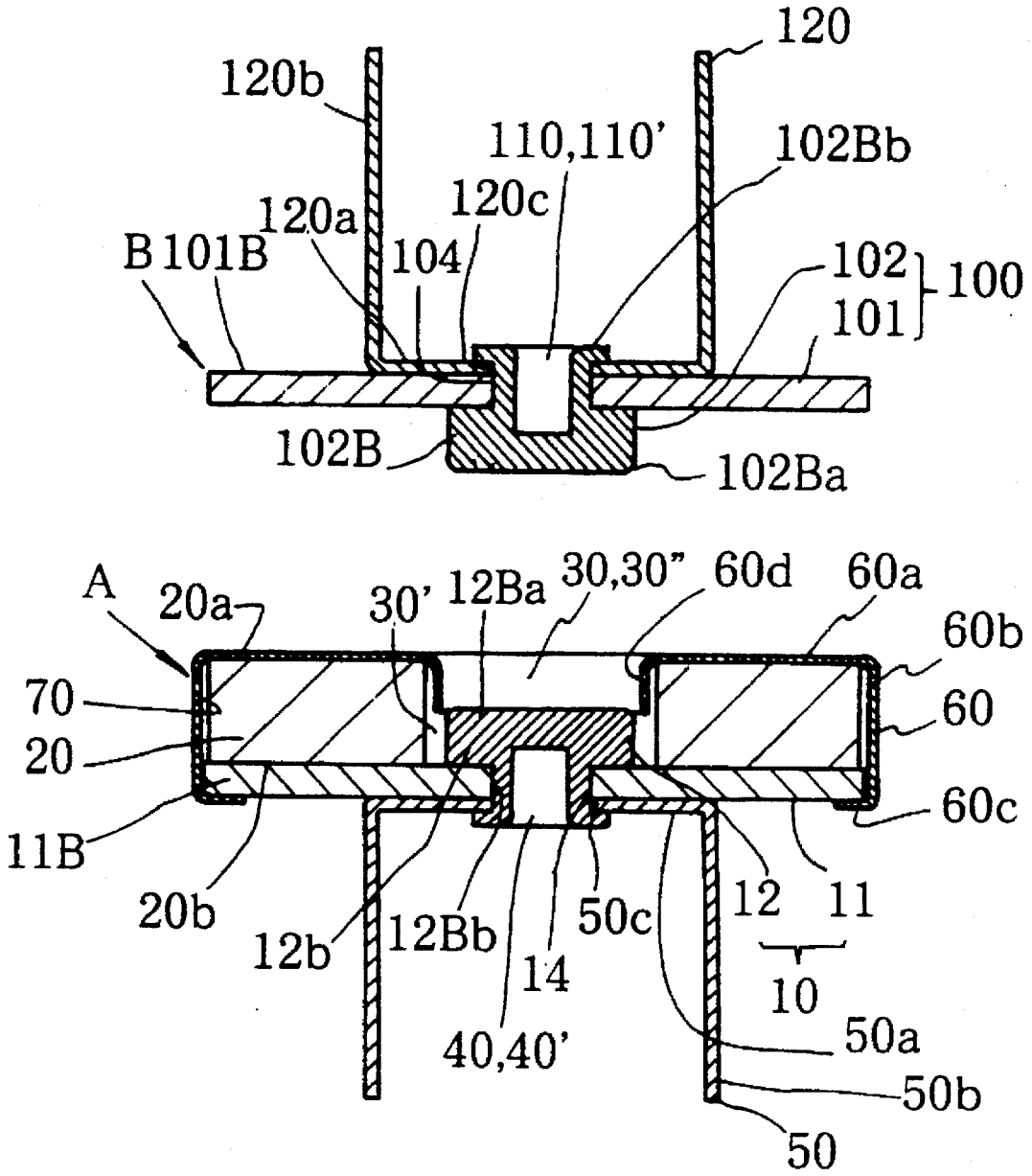
FIG. 2 is a side cross-sectional view of the fastener before engagement.
Figure 3:
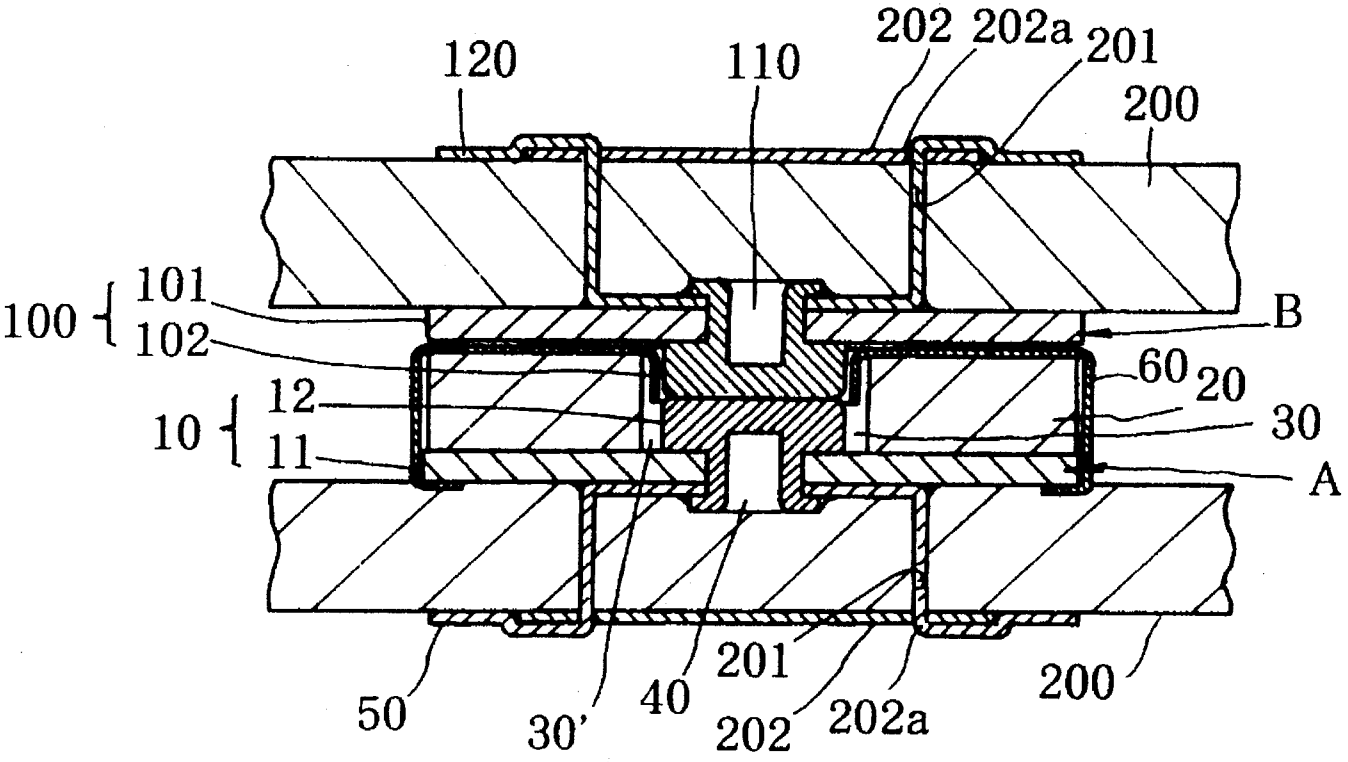
FIG. 3 is a side cross-sectional view of the fastener fully engaged and attached to objects to be fastened.

First Embodiment: FIGS. 1–3

The fastening element A according to FIGS. 1–3 has a permanent magnet 20, a magnet field transferring ferromagnetic member 10, and a case 60 for enclosing the magnet 20 and the magnetic member. It also includes an attaching element 50 used for attaching the fastening element A to an object 200. The permanent magnet 20 is a plate type, preferably round, with a round central hole 30' extending through its opposite sides **20*a* and 20*b* (magnetic poles). The poles are substantially aligned perpendicular to these sides such that one of the sides 20*a* and 20*b*** is a north pole and the other of the sides is a south pole, for instance.

The ferromagnetic member 10 has a ferromagnetic plate 11, 11B and a ferromagnetic rod 12, 12B attached to the plate. The ferromagnetic plate 11 is generally round and has central hole 14 adapted for attaching the ferromagnetic rod 12B, and has a slightly larger diameter than the magnet pole side **20*b*, as shown in FIGS. 2 and 3. The ferromagnetic rod 12B is cylindrical, but the distal end portion 12Ba is larger in diameter than the proximal end 12Bb, as shown in the drawings. The proximal portion is connected to the ferromagnetic plate 11B. The diameter of the distal end portion 12Ba is larger than the diameter of hole 14. Further, ferromagnetic part 12B has a blind hole 40 extending from the tip of the proximal smaller diameter portion 12Bb to the larger diameter distal end portion 12Ba**.

The diameter of the blind hole 40 on this ferromagnetic rod 12B need only reach just inside the distal end portion 12Ba as shown in FIGS. 2 and 3. The hole, however, may extend deeper to near the distal tip end. The ferromagnetic rod 12B is just long enough to reach the midpoint of magnet 20, and is smaller than the magnet hole so that the outer wall of the rod does not touch the hole's wall when the ferromagnetic plate 11 is attached to the magnet at the side **20*b*. The round blind hole 40 has a cross-sectional area of at least 2.2% but no more than 88.9% of the rod cross-sectional area, the cross-section taken parallel to the surface of the plate 11B**.

The ferromagnetic member 10 is assembled by inserting the smaller diameter rod portion 12Bb into the hole 14 on the ferromagnetic plate 11B and a hole **50*c* formed through the attaching element 50 until the larger diameter rod portion 12Ba abuts against the plate 11B. The portion that protrudes from a seat plate 50*a* of the attachment element 50 is deformed (riveted so that the blind hole edge is bent outwardly) to attach these elements together. It is preferable for the ferromagnetic rod 12B to have a sufficient clearance between the internal side of magnet hole 30'** as shown.

The attachment element 50, which is attached to the ferromagnetic member 10, comprises a seat plate **50*a*, which is attached to the ferromagnetic plate 11B, and a pair of legs 50*b* extending about 90 degrees from the either side of the seat plate 50*a*. At the center of the seat plate 50*a* has a round hole 50*c* through which the smaller diameter rod portion 12Bb is inserted. This attachment element 50** may be made with either a non-ferromagnetic material such as brass or a ferromagnetic material.

The case 60 secures the magnet 20 and ferromagnetic member 10 together. The case 60 is cup-shaped, having a round upper surface **60*a* and a cylindrical side plate 60*b* extending downwardly from the upper surface periphery. Engaging prongs 60*c* extend downwardly from the free end of the case. The upper surface has a central hole 30" through which an inner cylindrical flange 60*d* extends downwardly. Although the case 60 is typically made from a non-ferromagnetic materials such as brass, or plastic, a quasi-ferromagnetic material such as stainless steel may also be used. The permanent magnet 20 and the ferromagnetic member 10 are held together with the case 60 to form a unibody, by sliding the permanent magnet 20 into the case 60, with the inner flange 60*d* in the magnet hole 30', and then attaching the ferromagnetic plate 11B into the case 60 with the ferromagnetic rod 12 in the magnet hole, and thereafter bending the prongs 60*c* on the case 60 onto the surface of the ferromagnetic plate 11B as shown in FIG. 2 and 3. A clearance space 70** between the outer magnet outer periphery and the case inner periphery is created by the slightly larger ferromagnetic plate to eliminate possibility of a direct contact of the magnet.

The fastening element A is attached to an object 200 by having the legs **50*b* of the attaching element 50 go through the elongated holes 201 formed through the object 200; and by bending portions of the legs 50*b* protruding from the object and going through the elongated holes on the seat metal plate 202 as shown in FIG. 3**.

The attracted element B includes a ferromagnetic member 100 having an attaching element 120. The ferromagnetic member 100 has a round ferromagnetic plate 101B with a ferromagnetic rod 102B extending from one side of it. The ferromagnetic plate 101B has a central hole 104 adapted for accepting the ferromagnetic rod 102B, which has a short cylindrical rod, similar to the rod 12B of the fastening element A, with a distal end portion 102Ba having a larger diameter than a proximal portion 102Bb of the rod 102B. The rod 102B is attached to the ferromagnetic plate 102B similar to the rod 12B of the fastening element. Similarly, the ferromagnetic rod 102B has a blind hole extending from the end of the small diameter rod portion 102Bb to the large diameter rod portion 102Ba.

Similar to the blind hole 40, the blind hole 110 on the ferromagnetic rod 102B needs to reach the side of the large diameter rod portion 102Ba, and need only to be in the side of the large diameter rod portion 102Ba. Also, the hole 110 may extend into to the large diameter rod portion 102Ba if desired.

The attaching element 120, similar to the attaching element 50, has a seat plate **120*a* for attaching to the ferromagnetic plate part 101B and a pair of legs 120*b* bent about 90 degrees from either side of the seat plate 120*a*, and a central round hole 120*c* at the seat plate 120*a* so as to have the small diameter rod portion 102Bb** go through it.

This attaching element 120 forms the attracted element B by having this ferromagnetic plate 101B and the ferromagnetic rod 102B secured together to form one piece by attaching the seat plate **120*a* to the ferromagnetic plate 101B, with the hole 104 and 120*c* aligned to form a continuously aligned hole, and having the small diameter rod 102Bb of the ferromagnetic rod part 102B pushed through the holes 104 and 120*c*, and then having the surface of the large diameter rod 102Ba contact the surface of the ferromagnetic plate 101B, and having the portion of the small diameter rod 102Bb, protruding from the hole 120*c* of the seat plate 120*a*, riveted outwardly. This attaching element 120** may be made of such non-ferromagnetic material as brass, and it can also be made of ferromagnetic material.

The attracted element B thus created will have, when its ferromagnetic plate 101 is pulled by the fastening element A, its ferromagnetic rod 102, within the hole 30 of the fastening element A, meet, or come close to the ferromagnetic rod 12 of the fastening element A. The rod 102 is smaller than the hole 30" formed through the case 60 to accommodate insertion of the rod therethrough, as shown in FIG. 3.

The attracted element B thus created will have a round blind hole 110 extending from the ferromagnetic plate 101 of the ferromagnetic member 100 to the ridge of the ferromagnetic 102. Again, the cross-sectional area of the blind hole 110 is at least 2.2% but no more than 88.9% of the cross-sectional area of the rod 102B itself.

The attracted element B constructed as described above is attached to the object 200, which has two elongated holes 201 into which the legs **120*b* of the attaching element 120 are inserted with a portion of each protruding; and is secured by sliding the protruding portion of the legs 120*b* through the elongated hole 202*a* on the seat plate 202 provided on the object 200, and by bending the protruding portion of the legs 120*b*** at the base.

This embodiment has blind holes 40, 110 in both ferromagnetic rods 12, 102. The fastener according to the present invention, however, can have only one blind hole in either of these rods 12, 102. In addition, where blind holes are in both rods, as in this embodiment, it is not necessary to have equal blind hole dimensions. That is, the depth and diameter of the holes can be differently set.

The blind holes 40 and 110 in the fastening element A and the attracted element B are to be placed towards the top of the ferromagnetic rod 12 and 102 from the ferromagnetic plate 11 and 101. These holes 40 and 110 can be closed if desired by filling with either ferromagnetic or non-ferromagnetic material.

Figure 4:
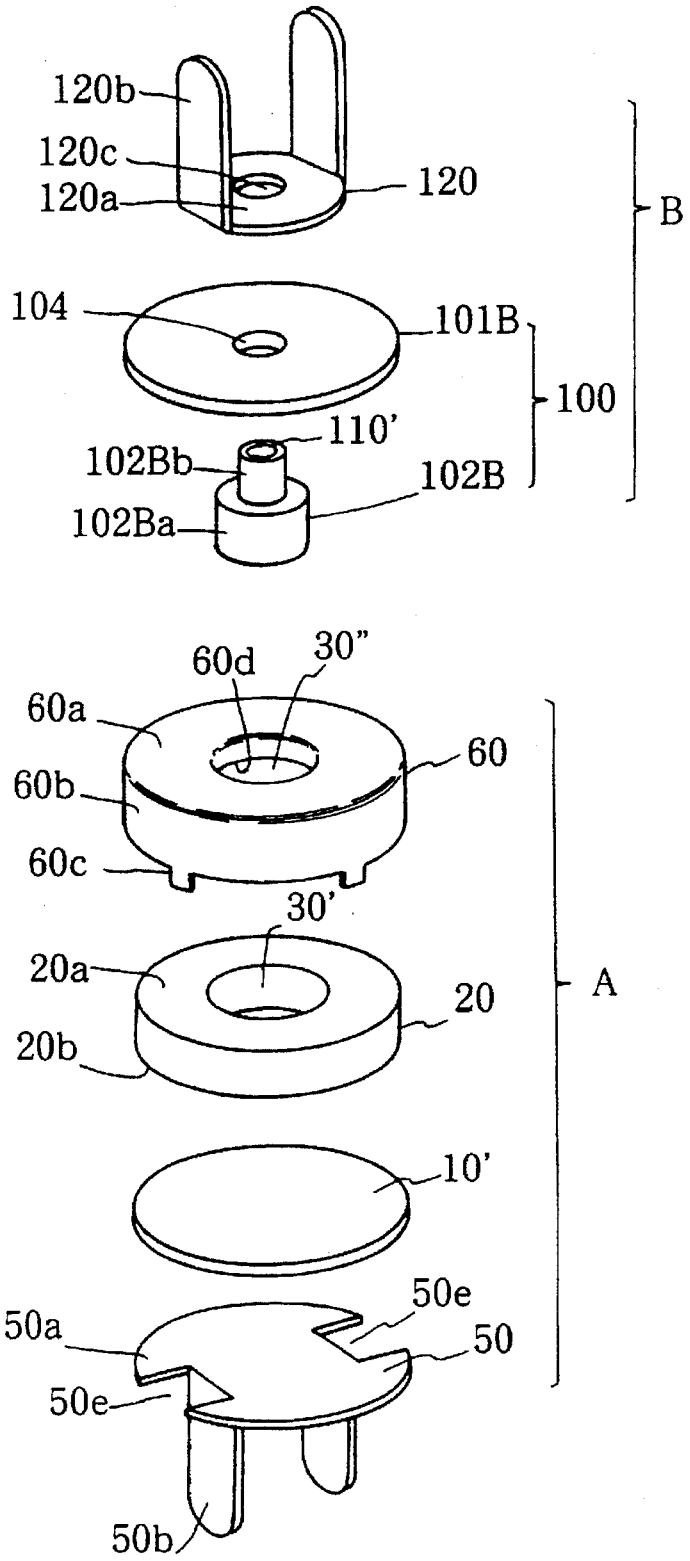
FIG. 4 is an exploded perspective view of a magnetic fastener according to a second embodiment of the present invention.
Figure 5:
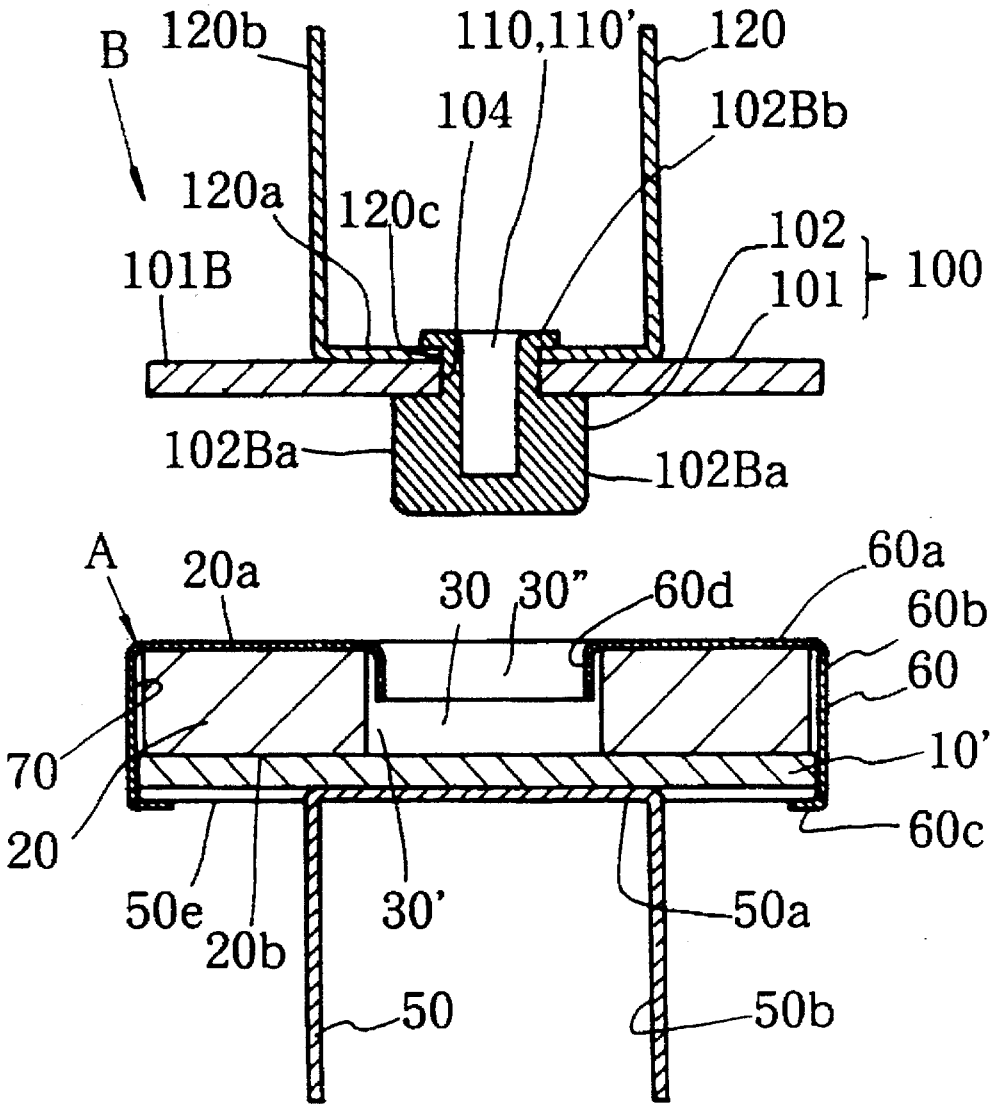
FIG. 5 is a side cross-sectional view of the fastener (second embodiment) before engagement.
Figure 6:
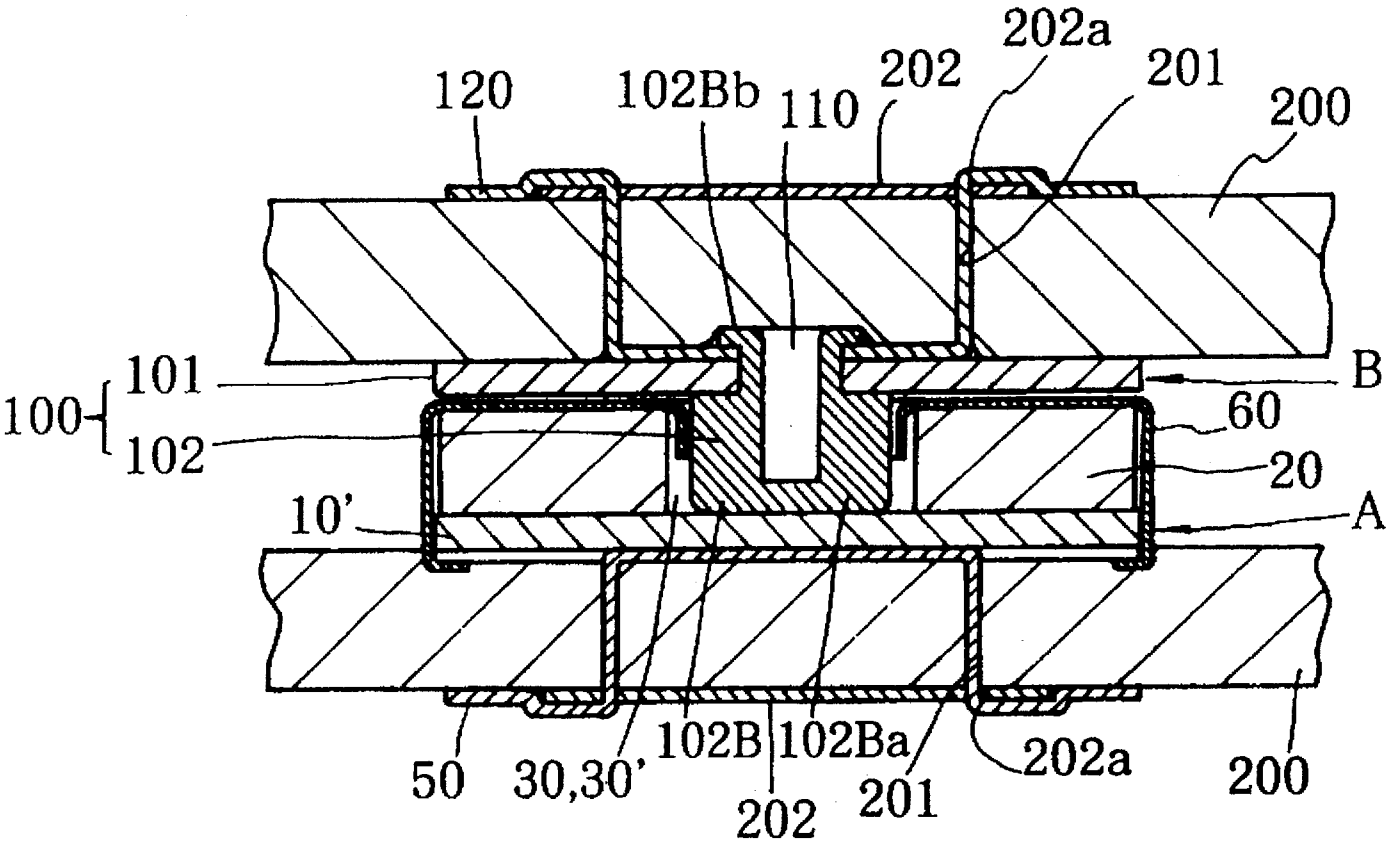
FIG. 6 is a side cross-sectional view of the fastener (second embodiment) fully engaged and attached to objects to be fastened.

Second Embodiment: FIGS. 4–6

The fastening element A of the fastener according to the second embodiment has a ferromagnetic plate 10' without a ferromagnetic rod. Only the ferromagnetic plate 101B of the attracted element B has a ferromagnetic rod 102, which is designed to be attracted to the ferromagnetic plate 10' so that the rod 102 touch or come close to the plate 10'. Otherwise, the fastener of this embodiment is substantially similar to the first embodiment.

The attaching element 50, which is to be attached to the ferromagnetic material 10', has a round seat plate 50*a'* nearly the same size as the ferromagnetic plate 10'. A pair of legs 50*b* and 50*b* are formed by cutting slits on diametrically opposing sides of the seat plate 50*a* and bent substantially perpendicularly to the seat plate 50*a*. The legs, however, are longer than the length of the slits 50*e*. The attaching element may be made of any non-ferromagnetic material such as brass, and also may be constructed with ferromagnetic material to form part of the ferromagnetic components.

The permanent magnet 20 and the plate type ferromagnetic material 10' are held together inside the case 60 as described in the first embodiment. The magnet 20 is placed inside the case so as to have the interior flange 60*d* placed inside the magnet hole 30'. The plate 10' is then placed inside the case 60 with one surface facing the magnetic pole side 20*b*. The attaching element 50 is placed in the case 60 against the exposed side of the plate 10'. The prongs 60*c* are then bent to the surface of the seat plate 50*a* to the elements together.

Again, as in the first embodiment, a clearance space 70 is formed between the inner periphery of the case and the outer periphery of the magnet. Although the case 60 is preferably non-ferromagnetic, it is acceptable to use a quasi-ferromagnetic material such as stainless steel. Even a ferromagnetic material can be used if desired.

The fastening element A and the attracted element is attached to the object 200 as described in the first embodiment. The attracted element B is essentially the same as that of the first embodiment except for the length of the rod 102Ba, which is longer in this embodiment and has a longer blind hole 110. In any event, the cross-sectional area of the blind hole 110 is again at least 2.2% but no more than 88.9% of the rod cross-sectional area.

Figure 7:
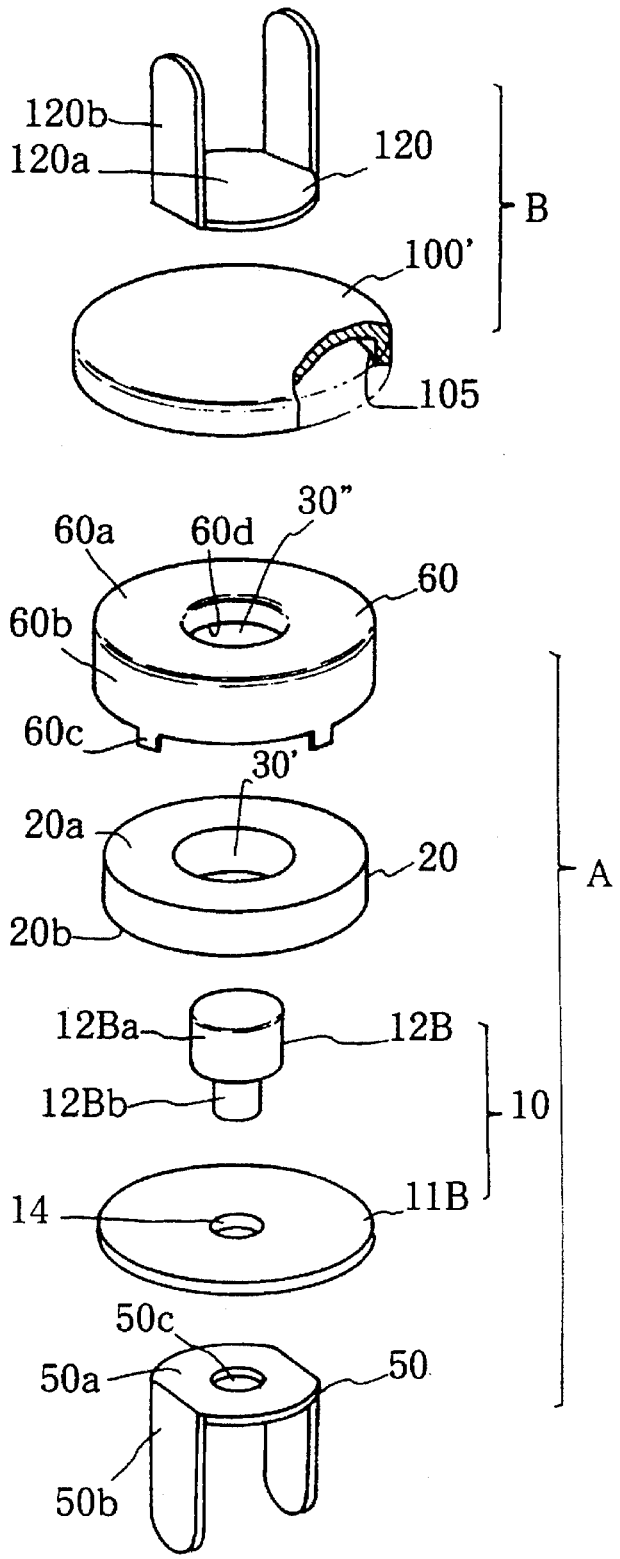
FIG. 7 is an exploded perspective view of a magnetic fastener according to a third embodiment of the present invention.
Figure 8:
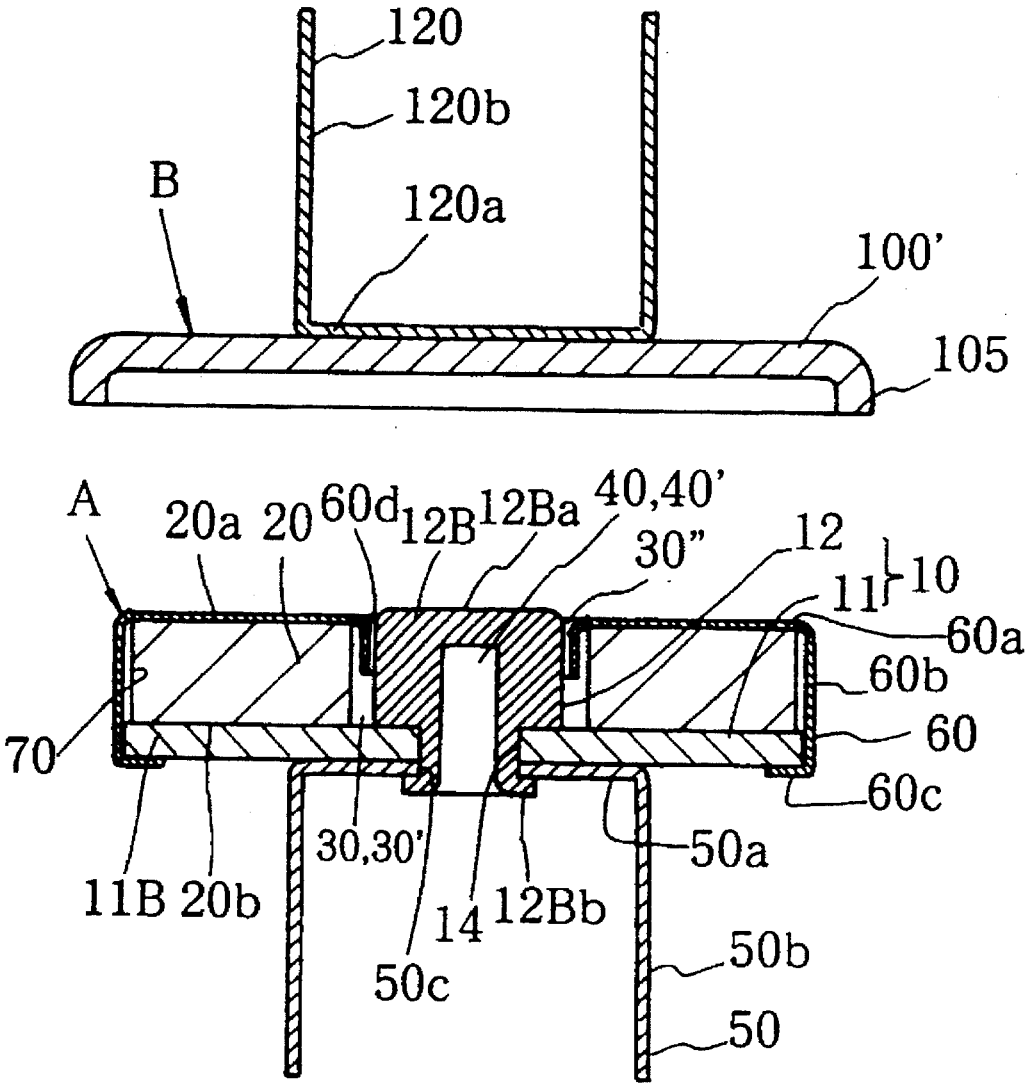
FIG. 8 is a side cross-sectional view of the fastener (third embodiment) before engagement.
Figure 9:
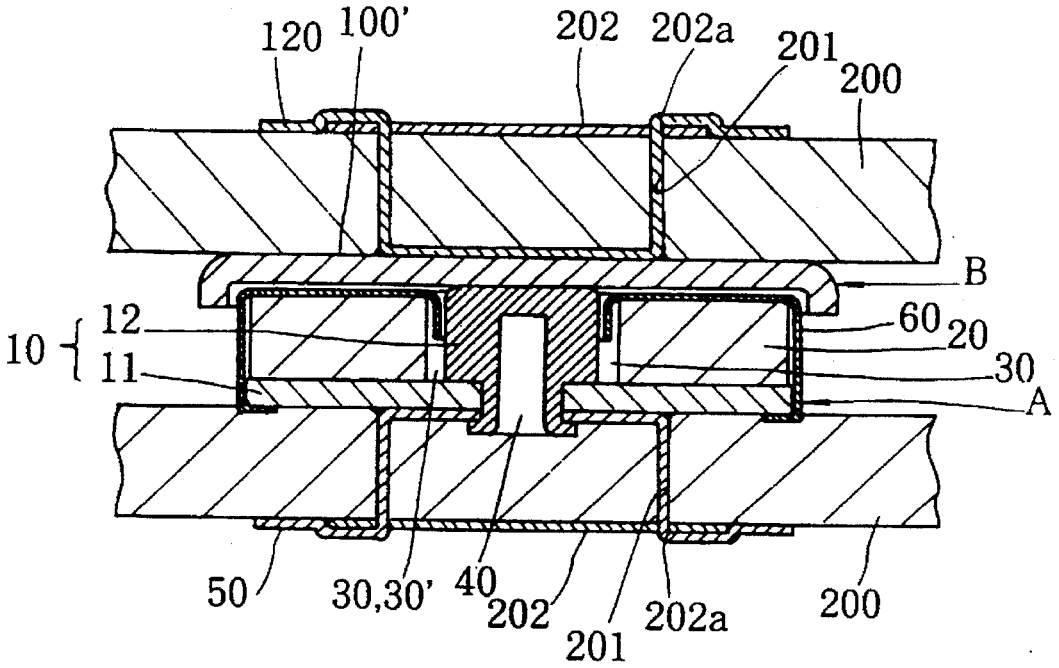
FIG. 9 is a side cross-sectional view of the fastener (third embodiment) fully engaged and attached to objects to be fastened.

Third Embodiment: FIGS. 7–9

The fastener according to this embodiment has a ferromagnetic rod 12 extending from the fastening element A instead of the attracted element B shown in the second embodiment. In addition, the rod 12 protrudes slightly out of the hole 30". Otherwise, the fastening element A is substantially similar to that of the first embodiment, including a blind hole 40 having a cross-sectional area of at least 2.2% but no more than 88.9% of the rod cross-sectional area. In this embodiment, similar to the second embodiment, the blind hole 40 is reaches deeper into the larger diameter portion 12Ba. It, however, only needs to enter just slightly into the larger diameter rod 12Ba from the smaller diameter rod 12Bb. Alternatively, the blind hole can even be deeper, near the end of the larger diameter rod 12Ba.

Furthermore, the rod 12 may have its end at the same level as the upper surface 60*a* of the fastening element or even be slightly retracted below the surface 60*a*.

The attracted element B comprises a round ferromagnetic plate 100 having a downwardly extending flange 105 that extends slightly into the case side wall 60*b*. In this regard, the plate 100 is larger in diameter than that of the case 60. Further, the material and structure of the ferromagnetic plate 100' is constructed so that it can effectively absorb the magnetic field radiating from the side of the magnet.

The attaching element 120 comprises of an attaching base plate 120*a* which is directly affixed via soldering or spot welding to the ferromagnetic plate member 100' and a pair of upright legs 120*b* extending from the base plate 120*a*. Further, the attaching element may be either non-ferromagnetic such as brass or ferromagnetic material.

Figure 10:
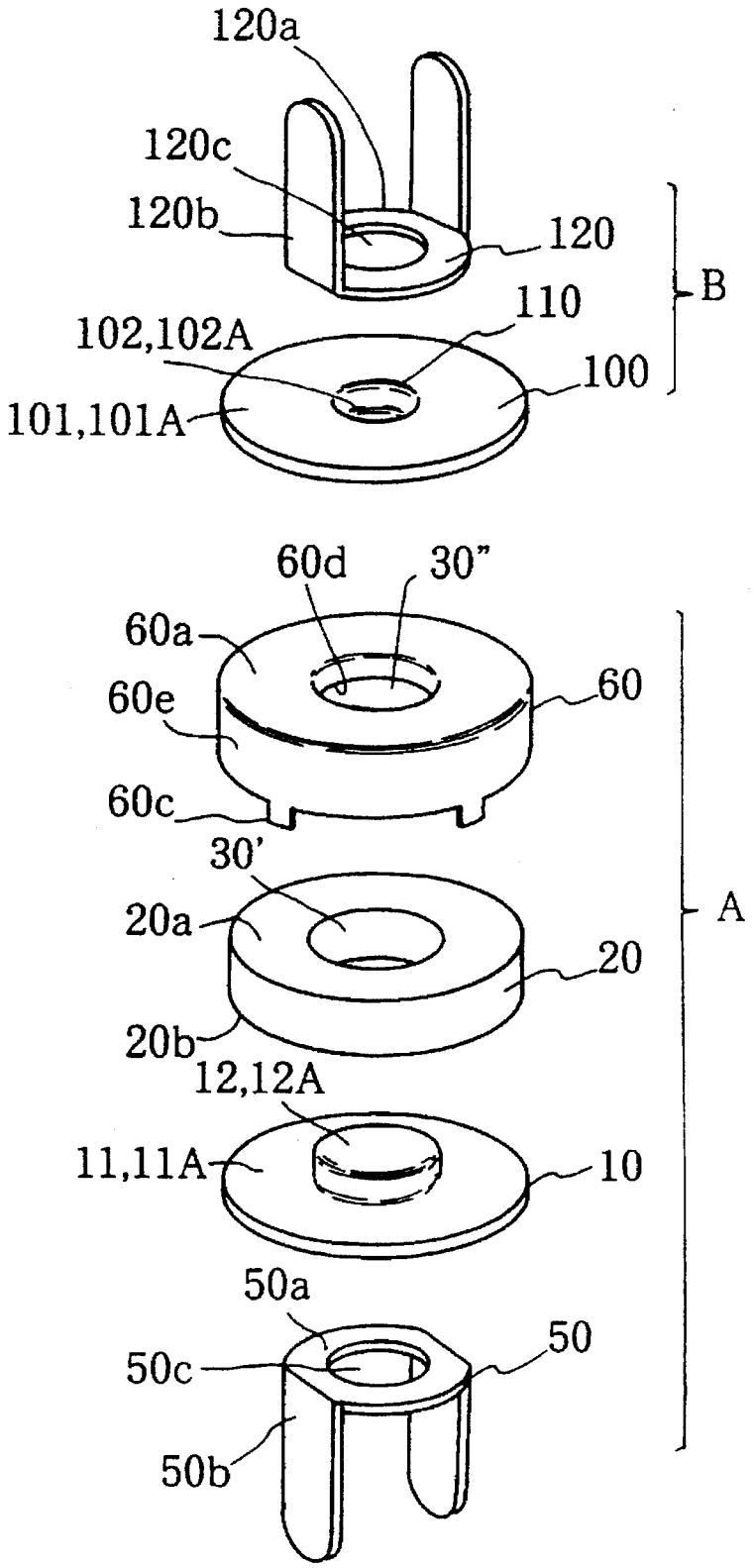
FIG. 10 is an exploded perspective view of a magnetic fastener according to a fourth embodiment of the present invention.
Figure 11:
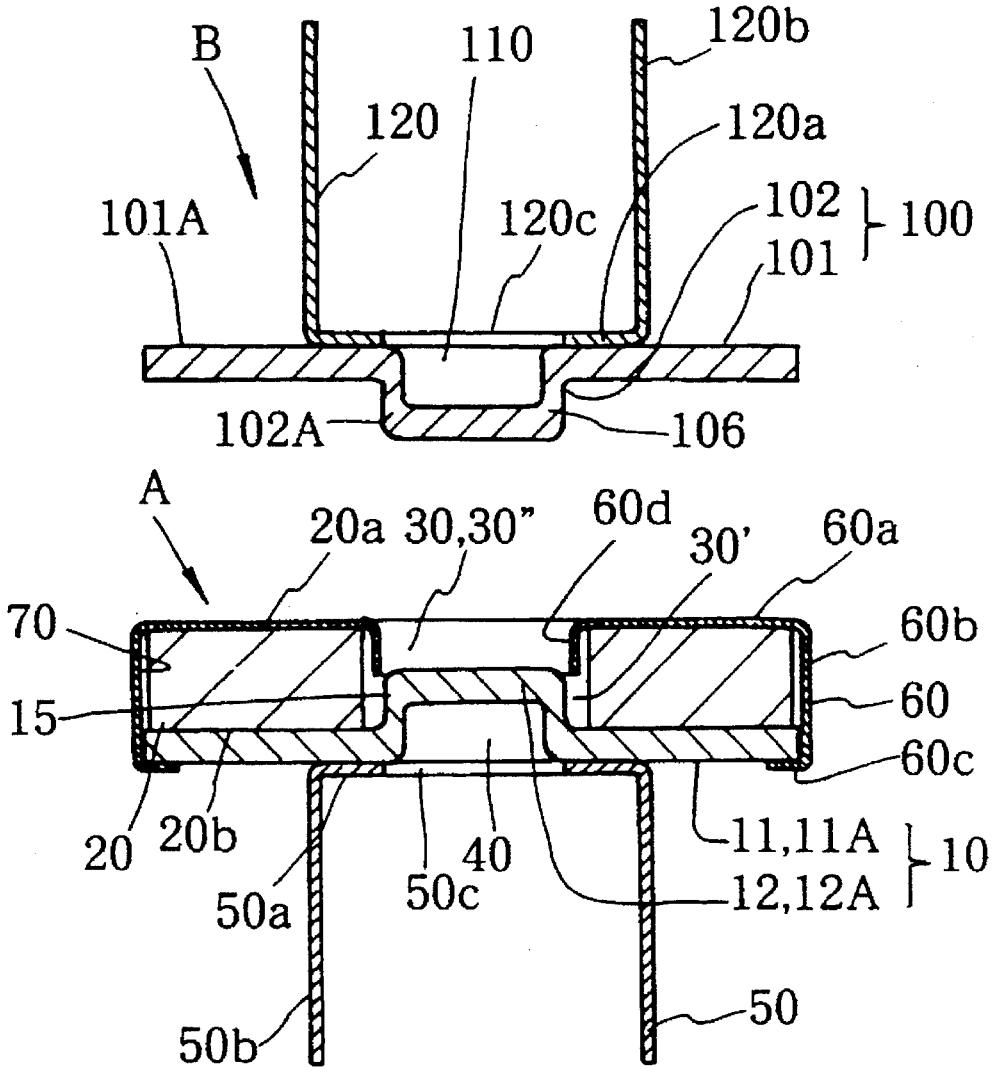
FIG. 11 is a side cross-sectional view of the fastener (fourth embodiment) before engagement.
Figure 12:
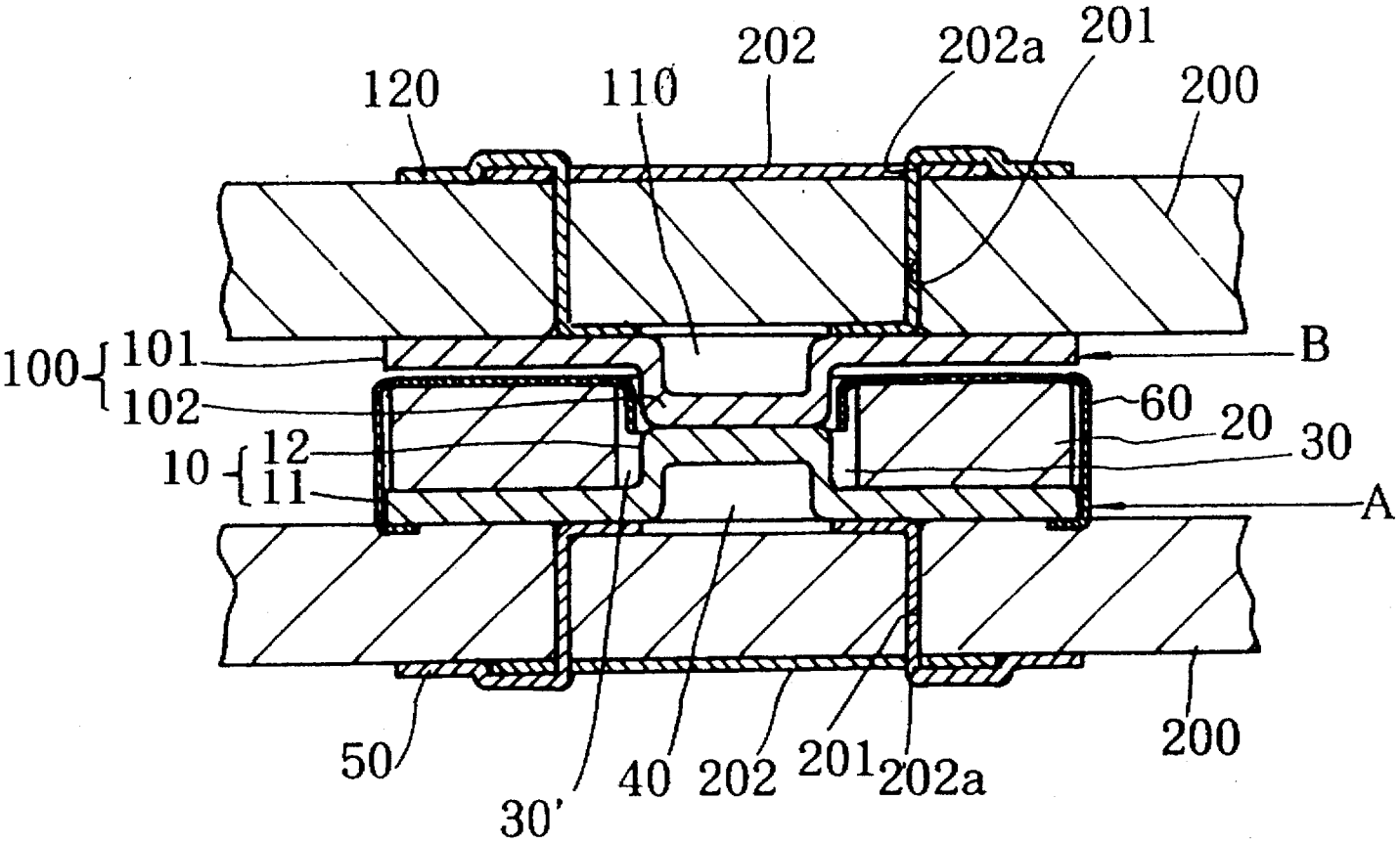
FIG. 12 is a side cross-sectional view of the fastener (fourth embodiment) fully engaged and attached to objects to be fastened.

Fourth Embodiment: FIGS. 10–12

The fastener of the fourth embodiment utilizes a single piece ferromagnetic member 10, 100 formed by press molding to form a plate 11, 101 with an integral ferromagnetic rod 12, 102, to which the attaching element 50, 120 is welded. The rods 12 and 102 do not have two differently sized portions. Otherwise, the fastener according to this embodiment is substantially similar to the first embodiment.

The ferromagnetic rod extending from the plate 12, 102 is substantially circular, but the outer side profile can be conical due to the press molding or cylindrical. The side wall 15, 106 of the ferromagnetic rod 12, 102 is thinner than both the rod end and the ferromagnetic plate 11, 101, forming a lighter ferromagnetic member 10, 100.

The attaching element 50, 120 which is mounted on the ferromagnetic plate 11, 101 has a seat plate 50*a*, 120*a* that is roughly circular, and at its center has a hole 50*c*, 120*c*, which is slightly than the blind hole 40, 110. Further, it has a pair of legs 50*b*, 120*b* standing at right angles from the seat plate. This seat plate 50*a*, 120*a* of the attaching element 50, 120 is either soldered or spot-welded to the ferromagnetic plate 11, 101, with the blind hole 40, 110 aligned with the hole 50*c*, 120*c*. Again, the attaching element 50, 120 can be either non-ferromagnetic or ferromagnetic material.

The ferromagnetic rods 12 and 102, whose diameters are slightly smaller than the hole 30', each protrude half-way into the magnet hole 30'. The bores 40, 110 of the ferromagnetic members 10 and 100 each have a cross-sectional area, at least at one given point, at least 2.2% but no more than 88.9% of the rod cross-sectional area.

The fastening element A and attracted element B each have the ferromagnetic member 10, 100 with a blind hole 40, 110. As with the first embodiment, only one of these ferromagnetic member may be provided with a blind hole. Also, the holes 40 and 110 need not have the same diameter or depth or both.

Figure 13:
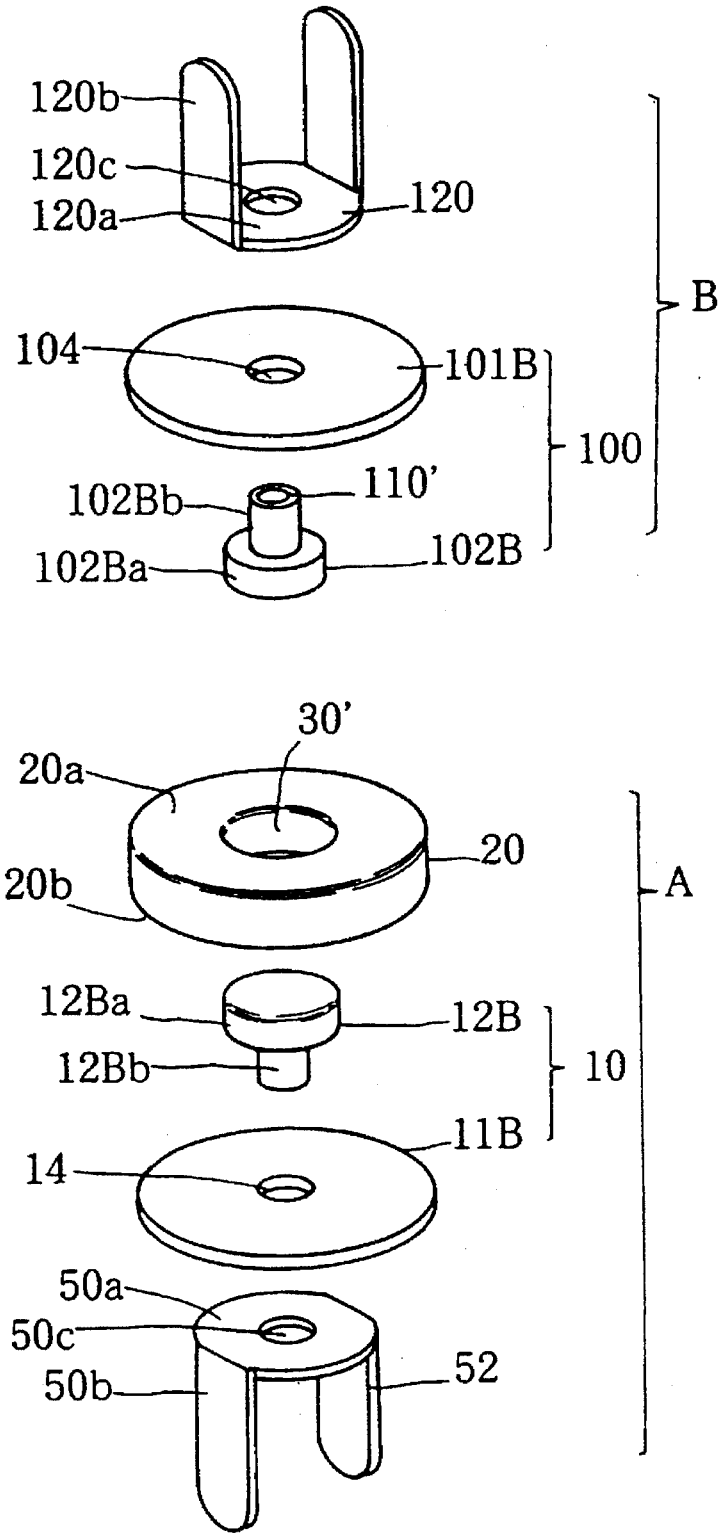
FIG. 13 is an exploded perspective view of a magnetic fastener according to a fifth embodiment of the present invention.
Figure 14:
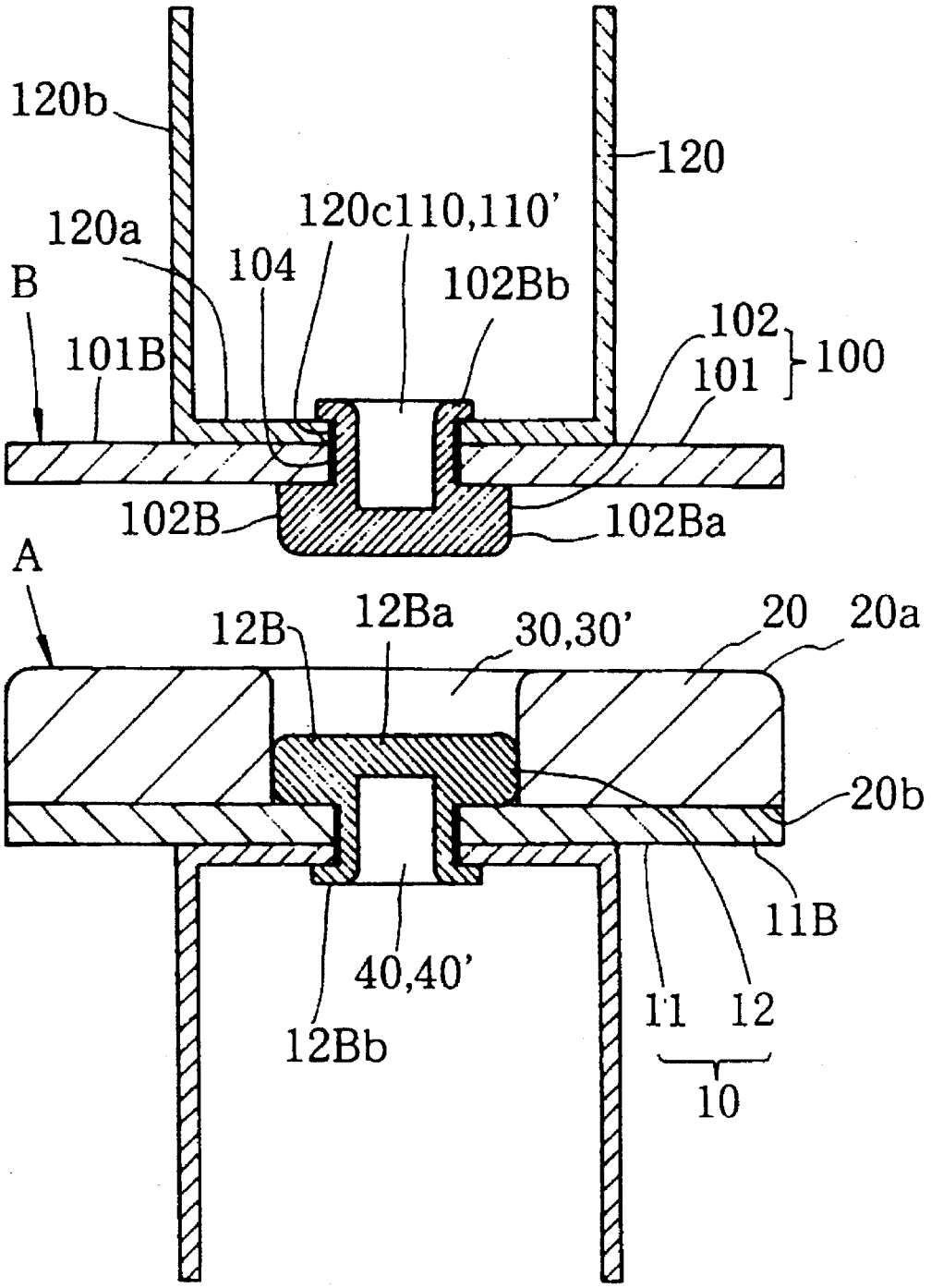
FIG. 14 is a side cross-sectional view of the fastener (fifth embodiment) before engagement.
Figure 15:
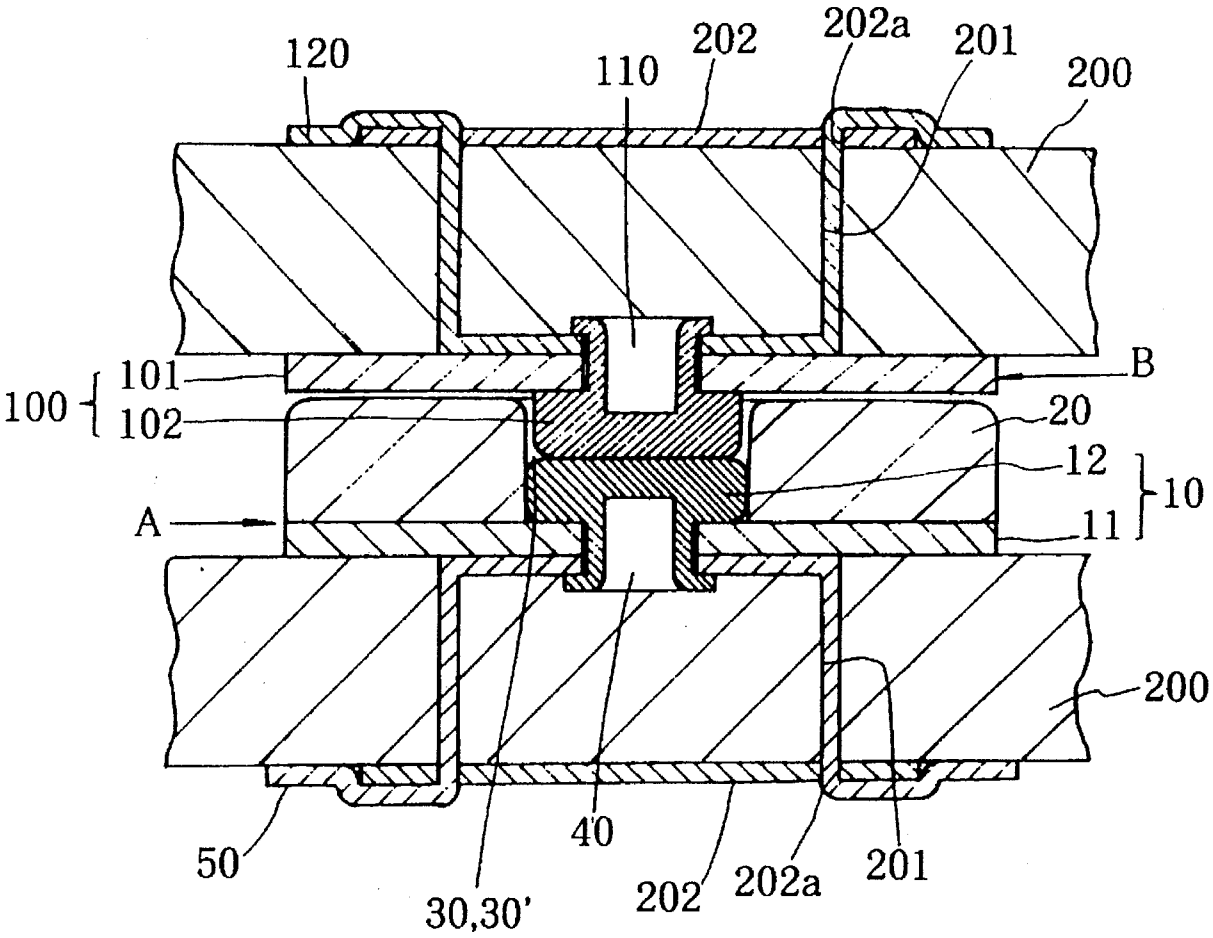
FIG. 15 is a side cross-sectional view of the fastener (fifth embodiment) fully engaged and attached to objects to be fastened.

Fifth Embodiment: FIGS. 13–15

The fastener according to the fifth embodiment does not require the case 60, and the size of the larger diameter portions 12Ba and 102Ba are different. Otherwise the fastener of this embodiment is the substantially the same as the first embodiment. Specifically, the ferromagnetic rod's larger portion 12Ba is press-fit or squeezed into the magnet hole 30' and retains the ferromagnetic member 10 and the attaching member 50 to the magnet as a unit. The ferromagnetic rod's larger portion 102Ba, however, is smaller than the magnet hole 30' to enable it to move freely in and out of the hole, as shown in FIG. 15.

The permanent magnet 20 used here is preferably a doughnut-shaped plastic or rubber magnet, with a central hole. In addition, the corner 20*a* is rounded as shown in FIGS. 14 and 15. Again, the bores 40, 110 of the ferromagnetic members 10 and 100 each have a cross-sectional area of at least 2.2% but no more than 88.9% of the rod cross-sectional area.

Figure 16:
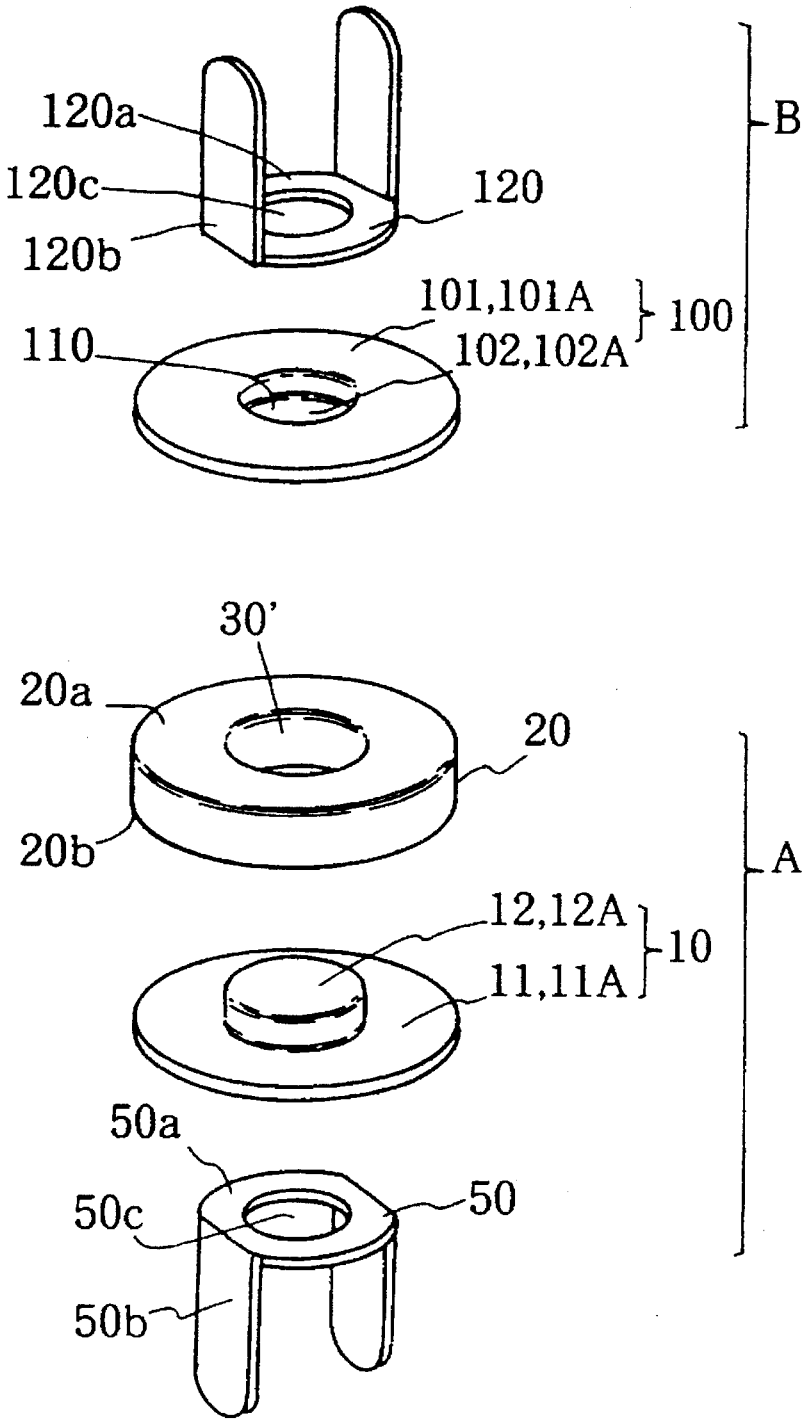
FIG. 16 is an exploded perspective view of a magnetic fastener according to a sixth embodiment of the present invention.
Figure 17:
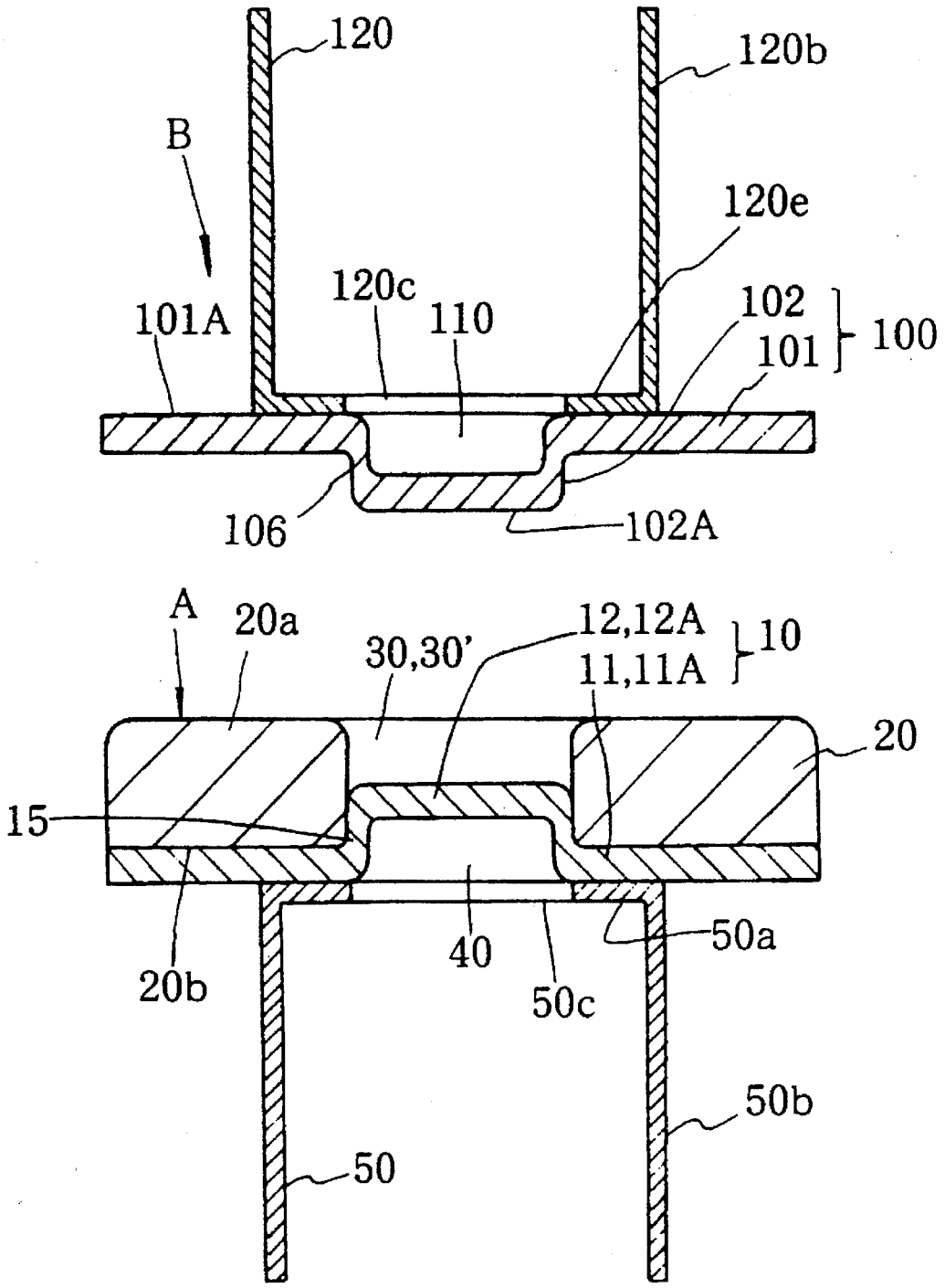
FIG. 17 is a side cross-sectional view of the fastener (sixth embodiment) before engagement.
Figure 18:
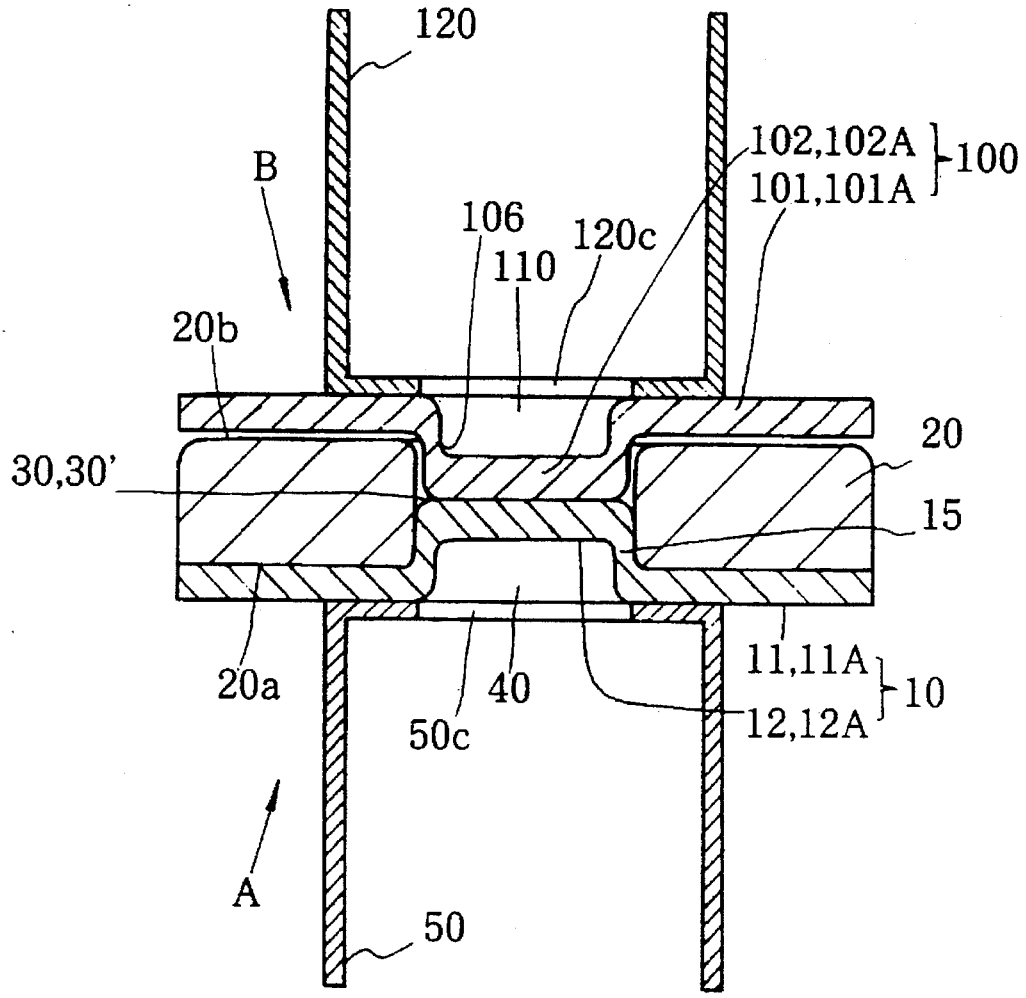
FIG. 18 is a side cross-sectional view of the fastener (sixth embodiment) fully engaged.
Figure 19:
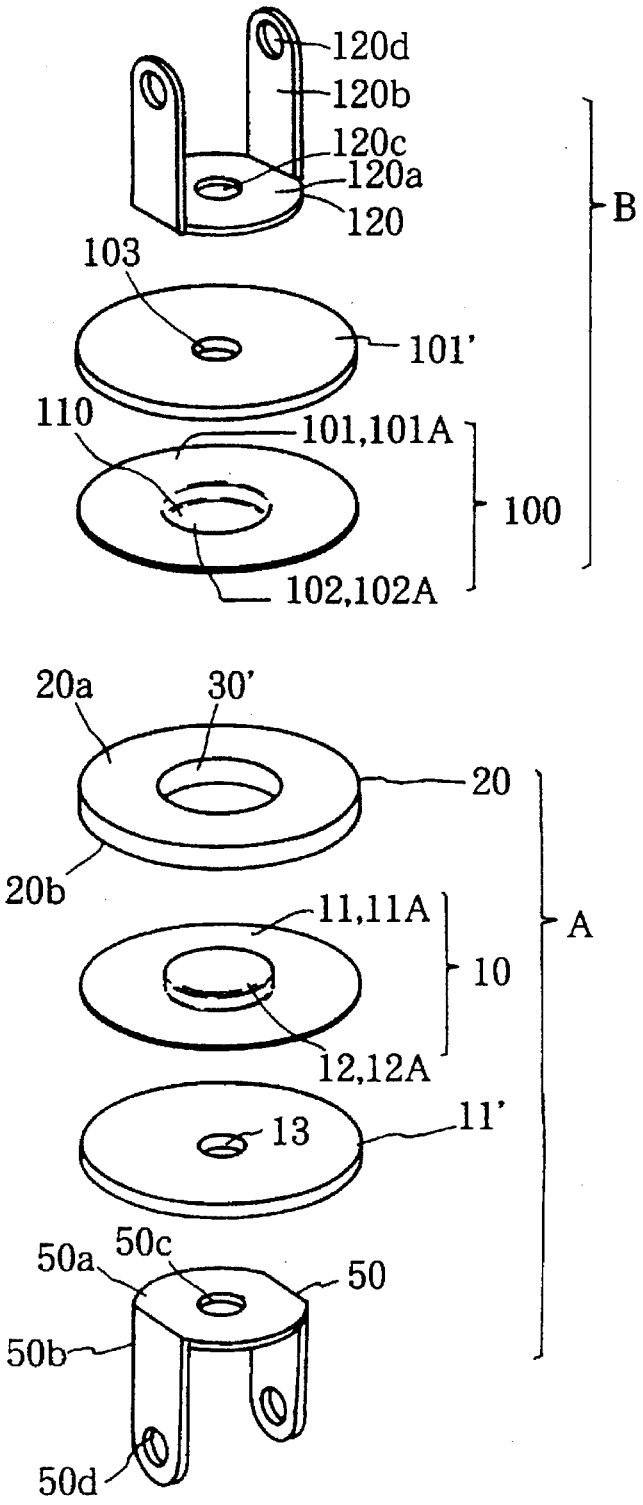
FIG. 19 is an exploded perspective view of a magnetic fastener of a first test case according to the present invention.
Figure 22:
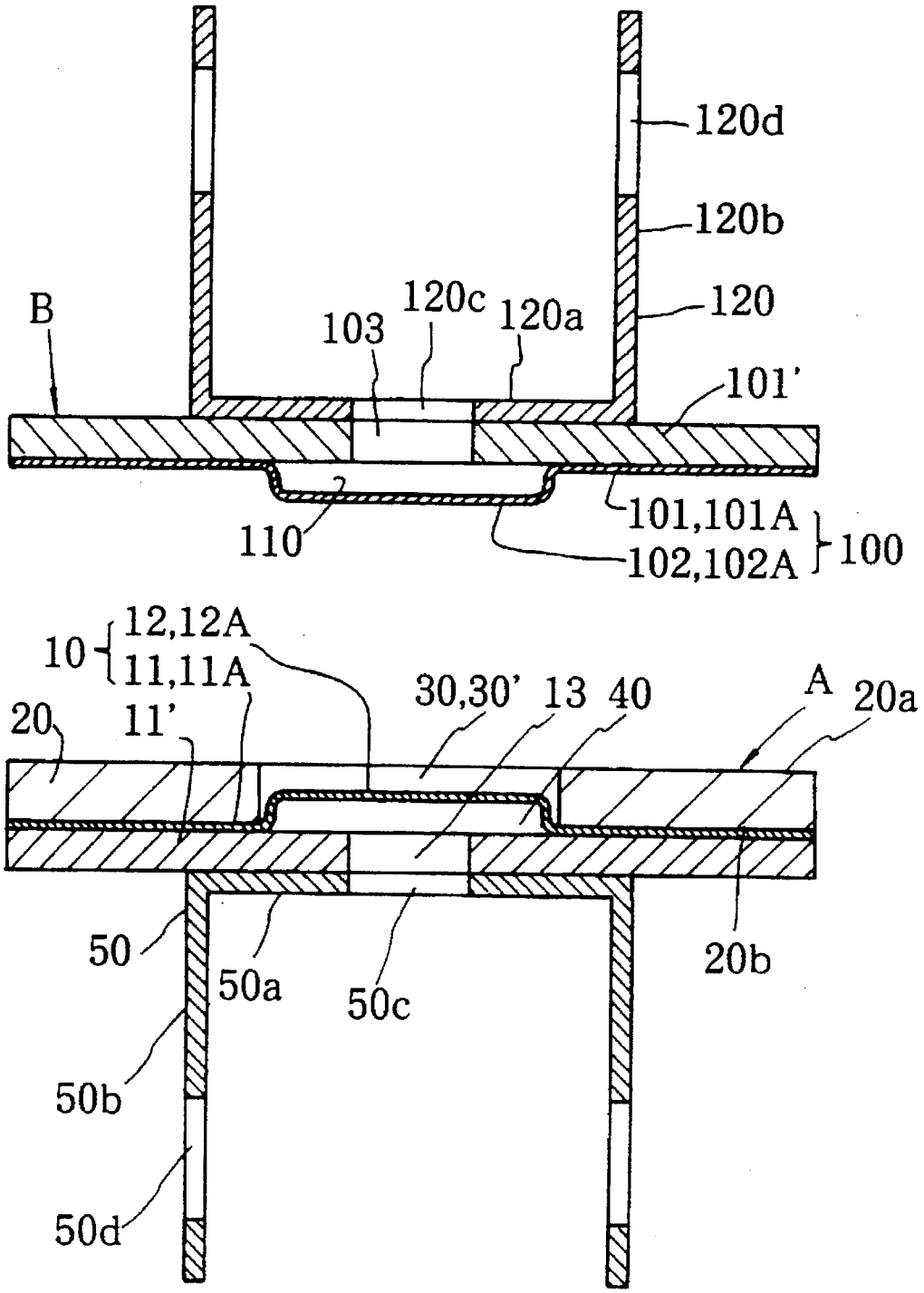
FIG. 22 is a side cross-sectional view of the fastener of FIG. 19 before engagement.
Figure 23:
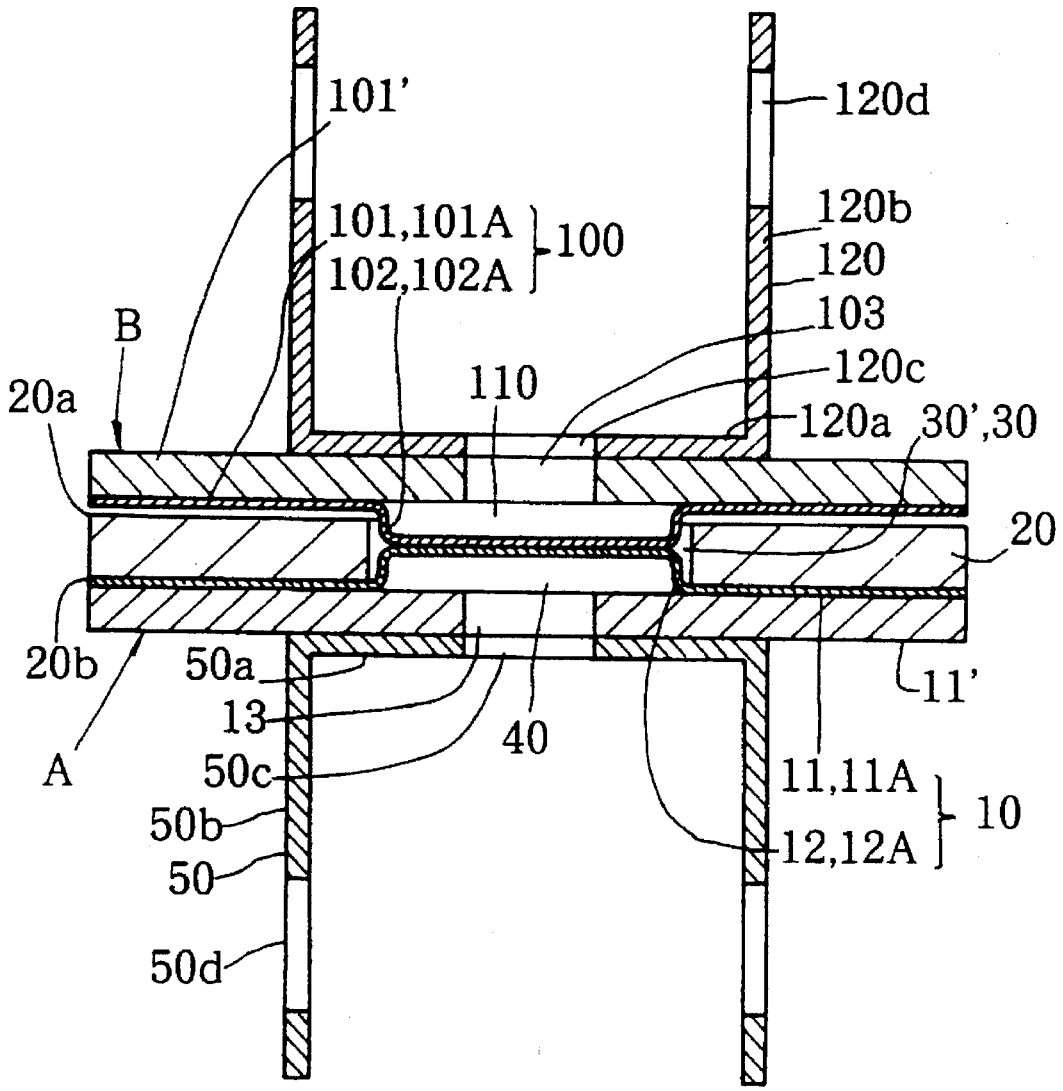
FIG. 23 is a side cross-sectional view of the fastener of FIG. 19 fully engaged.
Figure 24:
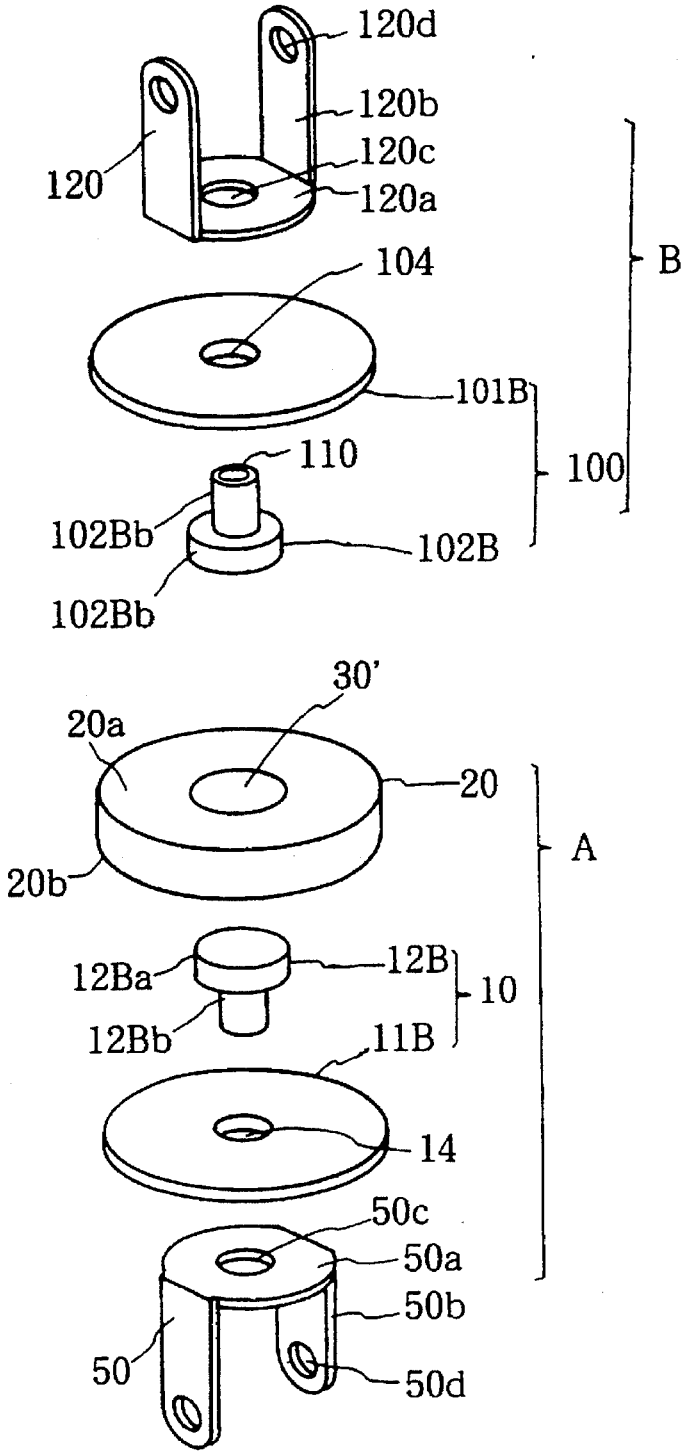
FIG. 24 is an exploded perspective view of a magnetic fastener used in a second test case according to the present invention.
Figure 27:
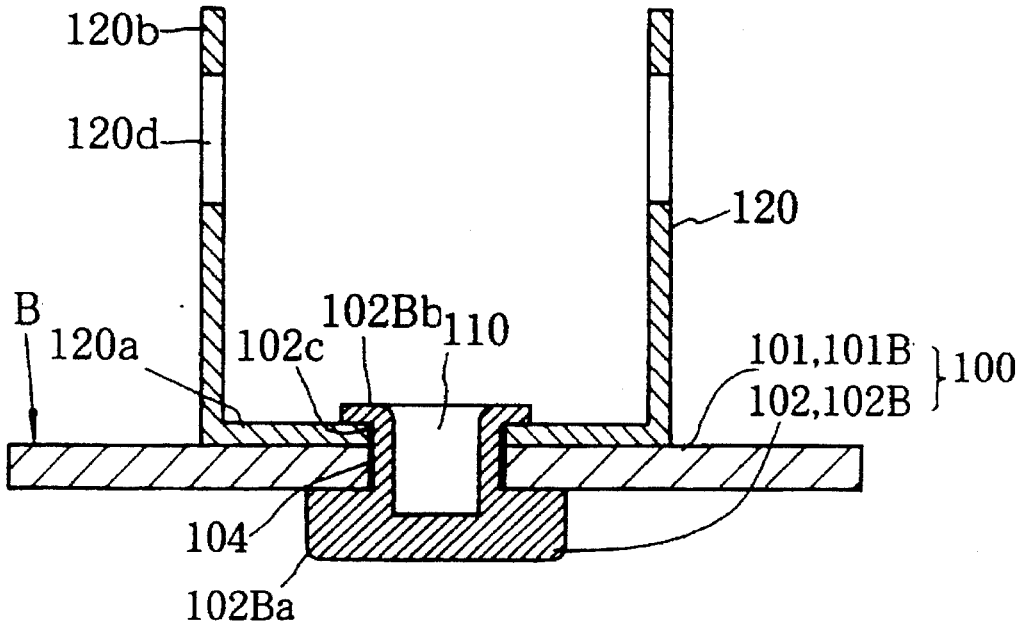
FIG. 27 is a side cross-sectional view of the fastener of FIG. 24 before engagement.
Figure 27:
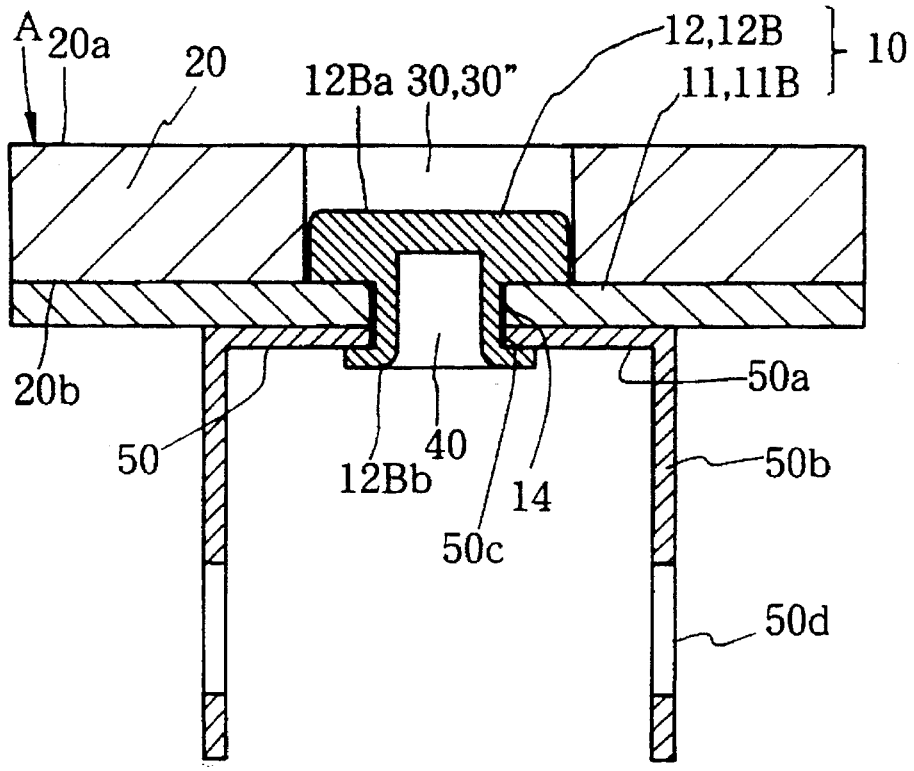
Figure 28:
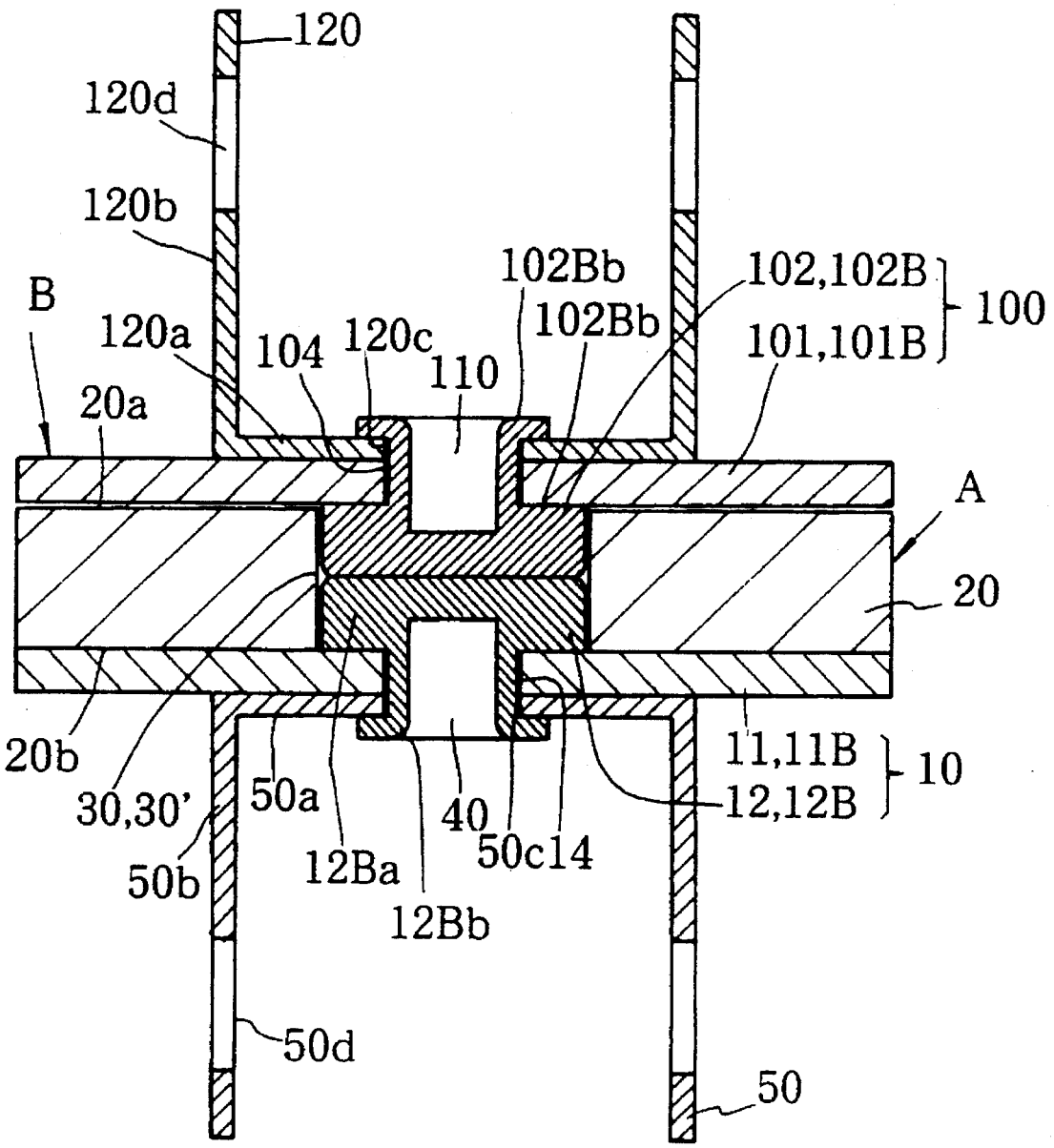
FIG. 28 is a side cross-sectional view of the fastener of FIG. 24 fully engaged.

Sixth Embodiment: FIGS. 16–18

The fastener according to the sixth embodiment does not require the case 60, as with the fifth embodiment, and the size of the larger diameter portions 12Ba and 102Ba are different. Otherwise the fastener of this embodiment is the substantially the same as the fourth embodiment. And, as with the fifth embodiment, the ferromagnetic rod 12 is press-fit or squeezed into the magnet hole 30' and retains the ferromagnetic member 10 and the attaching member 50 attached to the magnet as a unit. The ferromagnetic rod 102, however, is smaller than the magnet hole 30' to enable it to move freely in and out of the hole, as shown in FIG. 18.

And as with the fifth embodiment, the permanent magnet 20 used here is preferably a doughnut-shaped plastic or rubber magnet, with a central hole. In addition, the corner is rounded as shown in FIGS. 17 and 18. Again, the bores 40, 110 of the ferromagnetic members 10 and 100 each have a cross-sectional area of at least 2.2% but no more than 88.9% of the rod cross-sectional area, as described in the fourth embodiment.

These embodiments are explained as test cases one through nine below.

First Test Case: FIGS. 19–23

FIGS. 19–23 show the fastener of the first test case according to the present invention. This embodiment is substantially similar to the sixth embodiment, except that this embodiment includes supplemental ferromagnetic plate members 11' and 101' and uses thinner ferromagnetic members 10 and 100.

The fastening element A has a ferromagnetic member 10 placed on the magnetic pole side **20*b*, with the ferromagnetic rod 12 protruding into the hole 30', and includes a supplemental ferromagnetic plate 11' attached to the non-contact side of the ferromagnetic member 10 using an adhesive or solder. The attaching element 50 is affixed to the supplemental plate 11'** using an adhesive or solder.

The attracted element B has a ferromagnetic member 100 adapted for connecting to the opposite pole side **20*a*. Similar to the ferromagnetic member 10, it too has a ferromagnetic rod protruding from the ferromagnetic plate 101, which rod is to be inserted into the magnet hole 11'. Similarly, the supplemental ferromagnetic plate 101', to which the attachment device 102 is affixed to the non-contact side of the ferromagnetic plate 101 again using an adhesive or solder. And again, the attaching element 120 is affixed to the supplemental plate 101** using an adhesive or solder.

Referring to FIGS. 21A and 21B, the donut shaped permanent magnet 20 has the following dimensions and property:

Diameter Da: 18.0 mm

Hole Diameter Db: 7.5 mm

Thickness Dc: 1.4 mm

Magnetic Strength: 329 Gauss.

The ferromagnetic member 10, 100 is formed by compressing a ferromagnetic plate 11, 101 to provide a central ferromagnetic rod 12, 102, as described with the fourth embodiment. Referring to FIGS. 20E–20G and 21C–21E, these members have the following dimensions:

Diameter Ea, Ha: 18.0 mm

Outer Diameter Eb, Hb: 7.0 mm

Thickness Ec, Hc: 0.2 mm

Rod Length Ed, Hd: 0.8 mm

Inner Diameter Ee, He: 6.6 mm

The supplementary ferromagnetic plate 11', 101', which forms the magnet path along with the ferromagnetic member 10, 100, is made of a round iron plate with a round central hole 12. Referring to FIGS. 20C, 20D, 21F, and 21G, the ferromagnetic plates 11' and 101' have the following dimensions:

Diameter Fa, Ia: 18.0 mm

Hole Diameter Fb, Ib: 3.0 mm

Thickness Fc,Ic: 1.0 mm.

Referring to FIGS. 20A, 20B, 21H, and 21I, the attaching element 50 and 120 have the following dimensions:

Diameter Ga, Ja: 12.0 mm

Hole Diameter Gb, Jb: 3.0 mm

Leg Spread Gc, Jc: 11.0 mm

Leg Width Gd, Jd: 6.0 mm

Leg Length Ge, Je: 10.0 mm

Leg Hole Dia. Gf, Jf: 3.0 mm

Thickness Gg, Jg: 0.5 mm

Based on these dimensions, each of the cross-sectional area (taken along line x—x and x'—x' of FIGS. 21D, 20F and shown in FIGS. 21E, 20G) of the rods 12 and 102 is approximately 38.4846 $mm^2$ and that of the blind hole 40 is approximately 34.2120 $mm^2$, which is approximately 88.9% of the rod cross-sectional area.

At the point of full engagement, an experiment was conducted to measure the amount of tensile force it would take to disconnect the attracted element B from the fastening element A. The fastening element was held stationary while the attaching element 120 of the attracted element B, which was connected to a measurement equipment, was pulled away with gradually increasing force from the fastening element A, during which the force was measured. The following results have been obtained:

First tensile test: 0.30 kg

Second tensile test: 0.30 kg

Third tensile test: 0.31 kg.

The fastener in this test case shows that it is capable of withstanding a tensile force of about **303*g* between the fastening element A and the attracted element B, even though the blind hole cross-sectional area in the ferromagnetic rods 12 and 102** is at 88.9%.

Second Test Case: FIGS. 24–28

FIGS. 24–28 show the fastener of the first test case according to the present invention. This embodiment is substantially similar to the fifth embodiment (FIGS. 13–15), except that this test embodiment includes holes in the attaching elements 50 and 120 and the corner of the magnet is not rounded as in the fifth embodiment.

Referring to FIGS. 26A and 26B, the round permanent magnet 20 has the following dimensions and property:

Diameter Ka: 18.0 mm

Hole Diameter Kb: 6.2 mm

Thickness Kc: 3.2 mm

Magnetic Strength: approximately 4.4 Gauss.

Referring to FIGS. 26C, 26D, 25C, and 25D the ferromagnetic plates 11 and 101 have the following dimensions:

Diameter La, Pa: 18.0 mm

Hole Diameter Lb, Pb: 3.0 mm

Thickness Lc, Pc: 1.0 mm.

Referring to FIGS. 26E–26G, 25E–25G, the ferromagnetic rods 12 and 102 have the following dimensions:

Diameter Ma, Qa: 6.0 mm

Thickness Mb, Qb: 1.65 mm

Hole Diameter Mc, Qc: 2.9 mm

Thickness Md, Qd: 2.5 mm

Diameter Me, Qe: 2.0 mm

Thickness Mf, Qf: 1.0 mm.

Referring to FIGS. 26H, 26I, 25A, and 25B, the attaching elements 50 and 120 has the following dimensions:

Diameter Na, Oa: 12.0 mm

Hole Diameter Nb, Ob: 3.0 mm

Leg Spread Nc, Oc: 11.0 mm

Leg Width Nd, Od: 6.0 mm

Leg Length Ne, Oe: 10.0 mm

Leg Hole Dia. Nf, Of: 3.0 mm

Thickness Ng, Og: 0.5 mm

Based on these dimensions, the cross-sectional areas (taken along lines y—y and y'—y' of FIGS. 25F, 26F and shown in FIGS. 25G, 26G) of the larger diameter rod portions 12Ba, 102Ba is approximately 28.2744 $mm^2$ and that of the blind hole 40 is approximately 3.1416 $mm^2$, which is approximately 11.1% of the larger diameter rod cross-sectional area.

At the point of full engagement, an experiment was conducted to measure the amount of tensile force it would take to disconnect the attracted element B from the fastening element A. The fastening element was held stationary while the attaching element 120 of the attracted element B, which was connected to a measurement equipment, was pulled away with gradually increasing force from the fastening element A, during which the force was measured. The following results have been obtained:

First tensile test: 1.48 kg

Second tensile test: 1.40 kg

Third tensile test: 1.40 kg.

Figure 29:
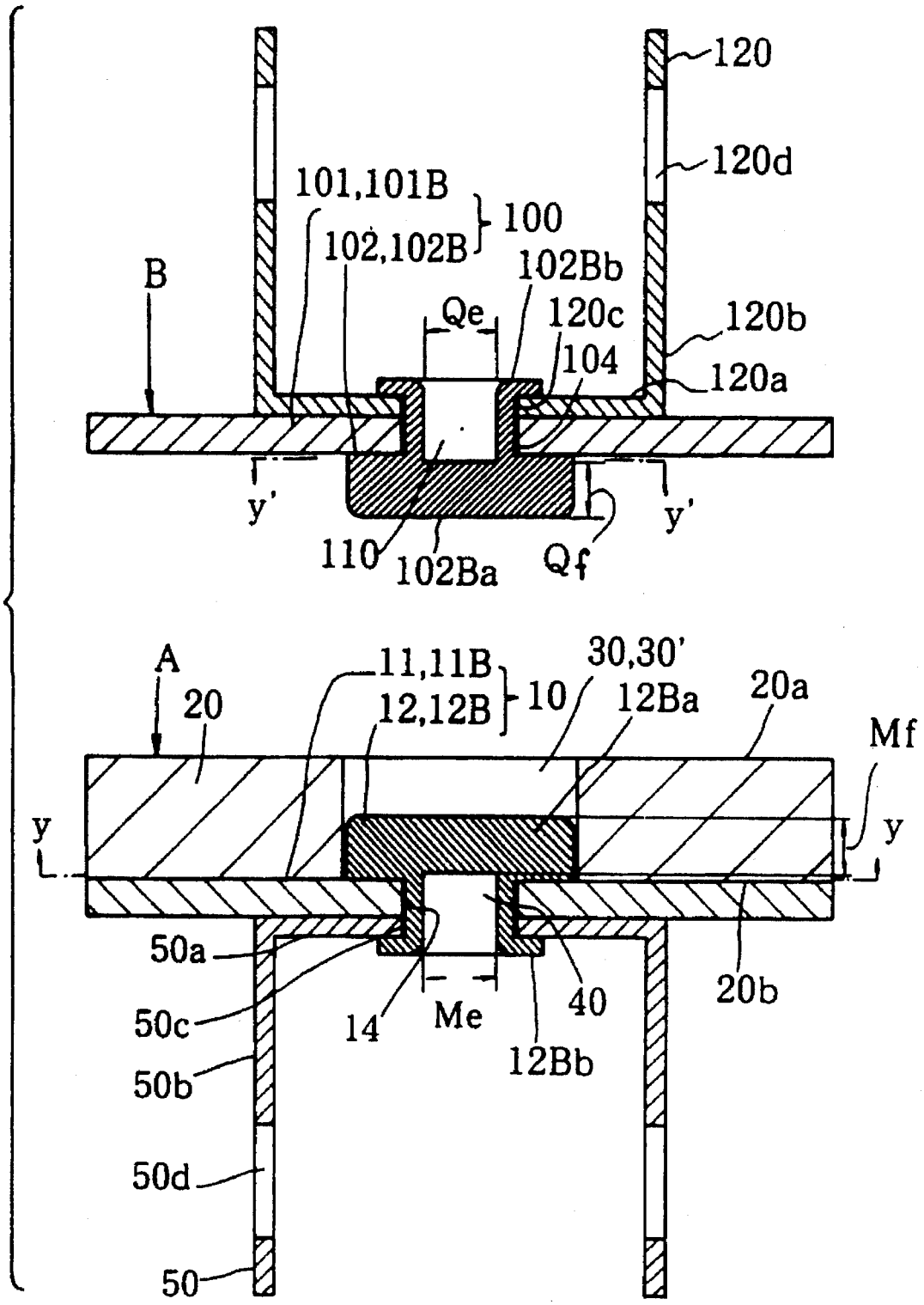
FIG. 29 is a side cross-sectional view of a fastener of a third test case according to the present invention before engagement.
Figure 30:
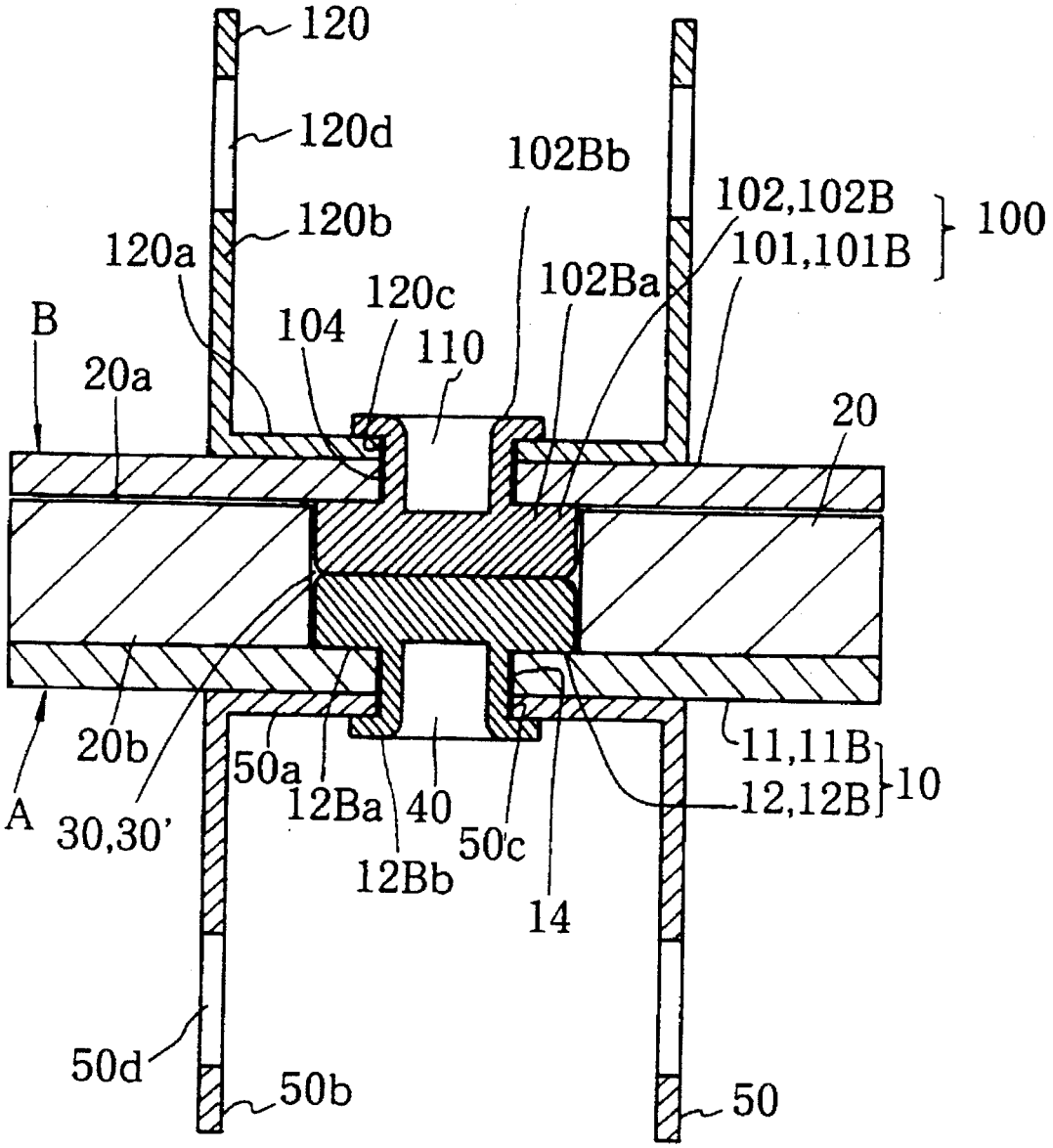
FIG. 30 is a side cross-sectional view of the fastener of the third test case fully engaged.

Test Case 3: FIGS. 29 and 30

The fastener shown in FIGS. 29 and 30 is essentially same as the fastener shown in the second test case (FIGS. 24–28) except that the ferromagnetic rod blind hole depth of the fastening element A and the attracted element B in this case is 0.5 mm shallower than that of the second test case, and the thickness Mf and Qf (between the bottom of the blind hole 40, 110 and the distal end of the larger rod portion 12Ba and 102Ba) is 1.5 mm. The cross-sectional area of the blind holes 40 and 110 thus has not changed and remains at 11.1% of the ferromagnetic rod area.

At the point of full engagement, an experiment was conducted to measure the amount of tensile force it would take to disconnect the attracted element B from the fastening element A. The fastening element was held stationary while the attaching element 120 of the attracted element B, which was connected to a measurement equipment, was pulled away with gradually increasing force from the fastening element A, during which the force was measured. The following results have been obtained:

First tensile test: 1.45 kg

Second tensile test: 1.52 kg

Third tensile test: 1.51 kg.

Figure 31:
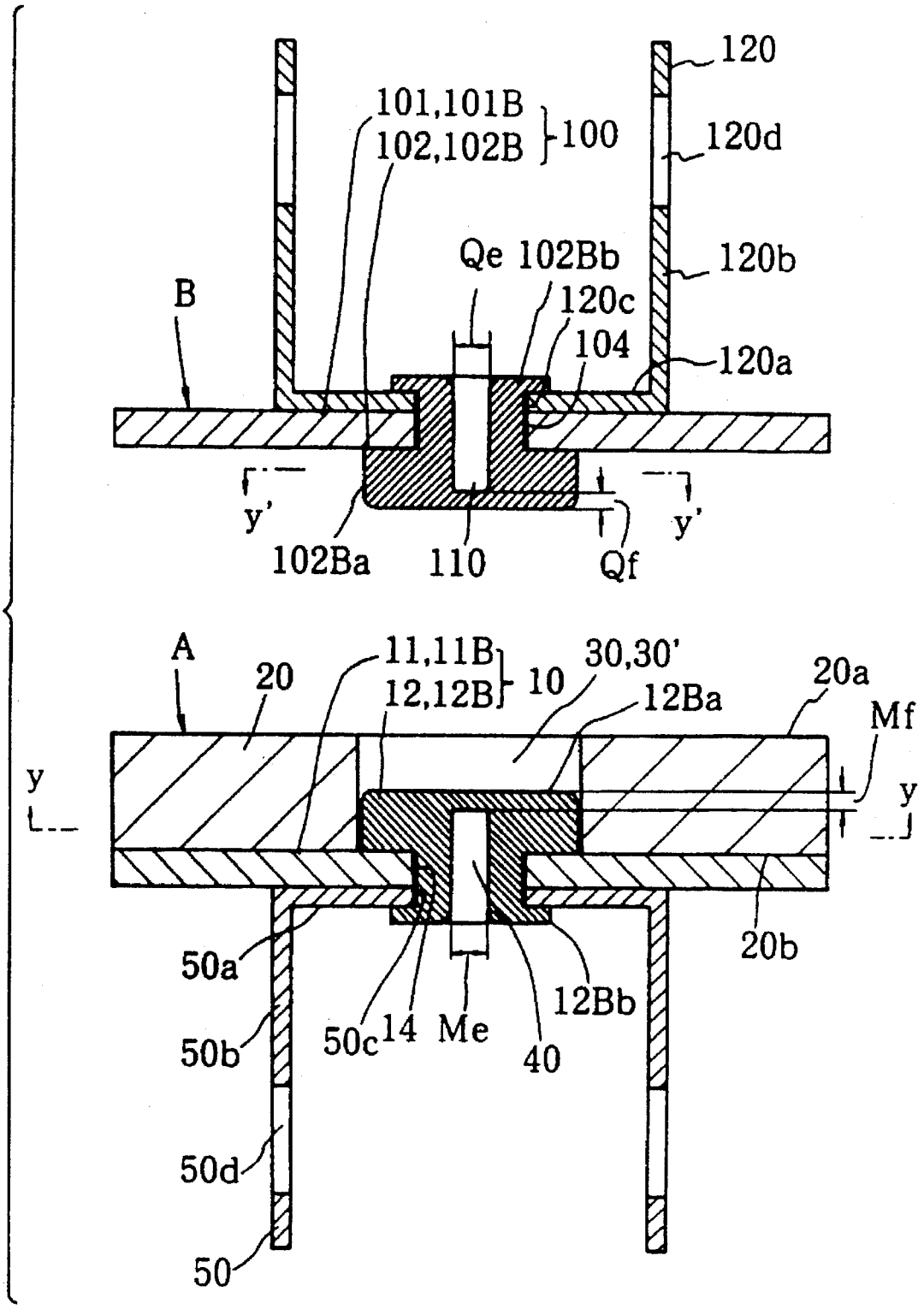
FIG. 31 is a side cross-sectional view of a fastener of a fourth test case according to the present invention before engagement.
Figure 32:
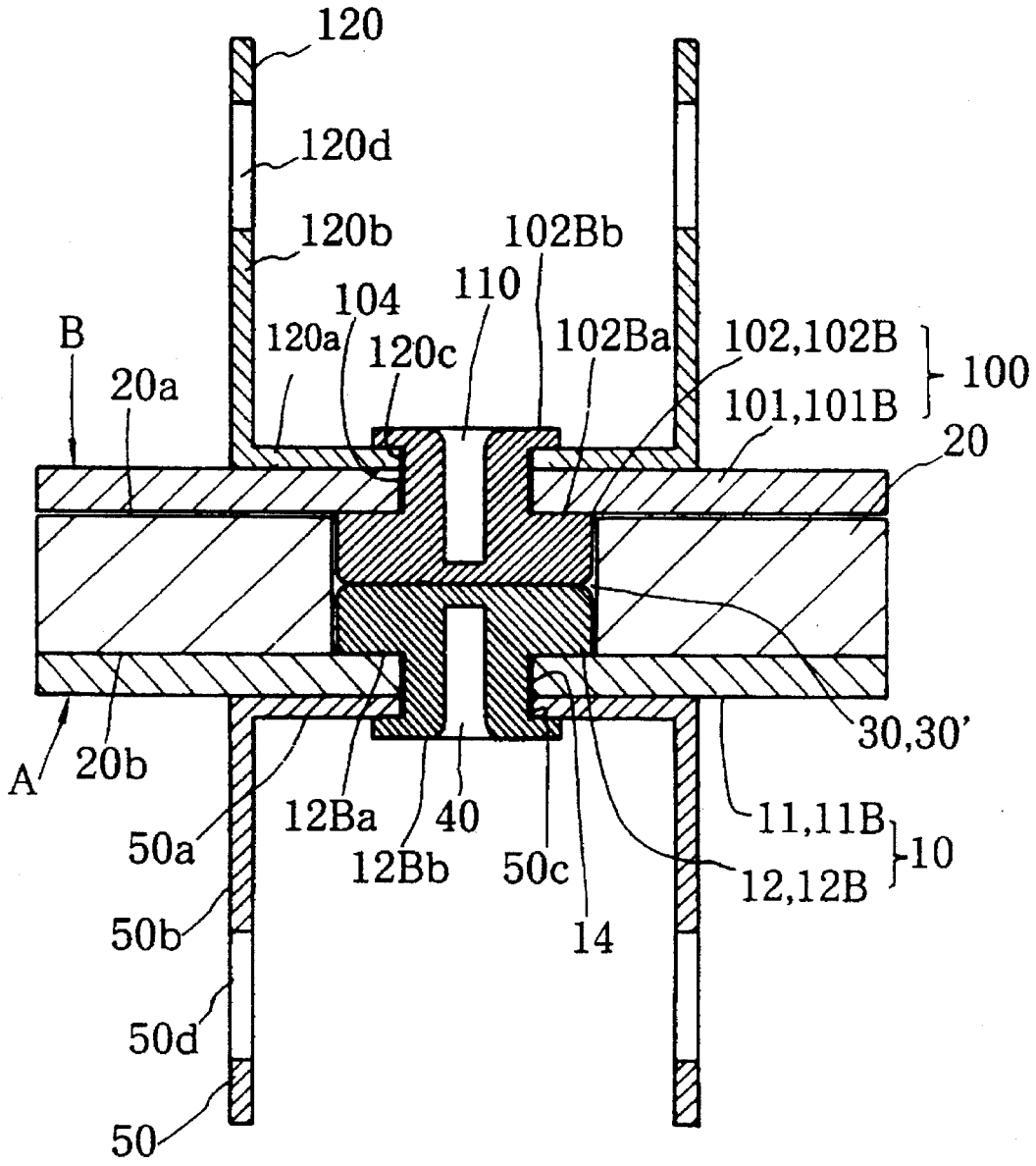
FIG. 32 is a side cross-sectional view of the fastener of the fourth test case fully engaged.

Test Case 4: FIGS. 31 and 32

The fastener shown in FIGS. 31 and 32 is essentially same as the fastener shown in the second test case (FIGS. 24–28) except that the ferromagnetic rod blind hole of the fastening element A and the attracted element B in this case is 0.5 mm deeper and 1.1 mm narrower than that of the second test case. Thus, the thickness Mf and Qf (between the bottom of the blind hole 40, 110 and the distal end of the larger rod portion 12Ba and 102Ba) is 0.5 mm, and the hole diameter Me and Qe is 0.9 mm. Based on these changes, while the cross-sectional areas (taken along lines y—y and y'—y' of FIG. 31) of the larger diameter rod portions 12Ba, 102Ba remains approximately 28.2744 $mm^2$, that of the blind hole 40 is approximately 0.6361 $mm^2$, which is approximately 2.2% of the larger diameter rod cross-sectional area.

At the point of full engagement, an experiment was conducted to measure the amount of tensile force it would take to disconnect the attracted element B from the fastening element A. The fastening element was held stationary while the attaching element 120 of the attracted element B, which was connected to a measurement equipment, was pulled away with gradually increasing force from the fastening element A, during which the force was measured. The following results have been obtained:

The first tensile test: 2.10 kg

The second tensile test: 2.18 kg

The third tensile test: 2.19 kg.

Figure 33:
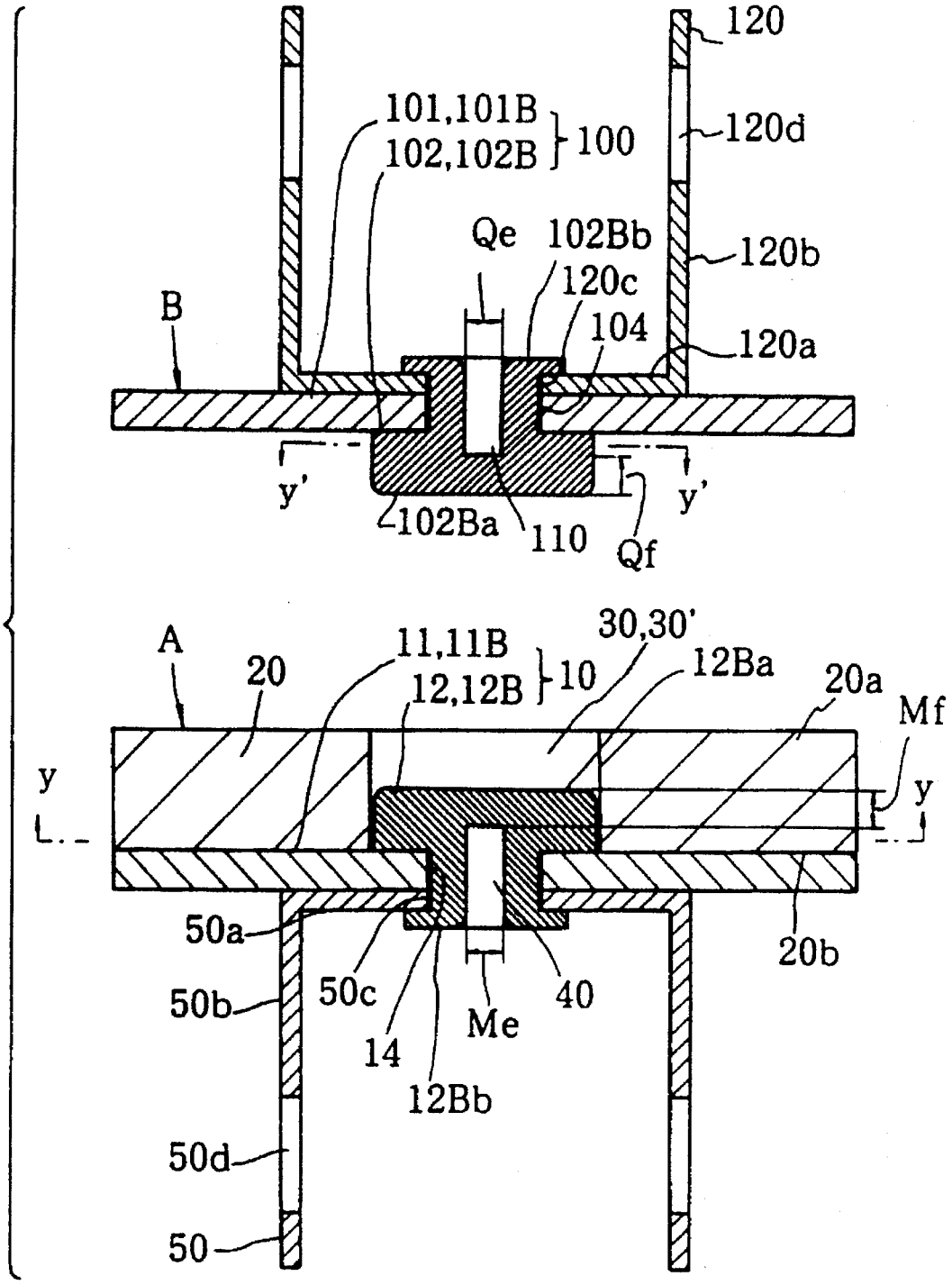
FIG. 33 is a side cross-sectional view of a fastener of a fifth test case according to the present invention before engagement.
Figure 34:
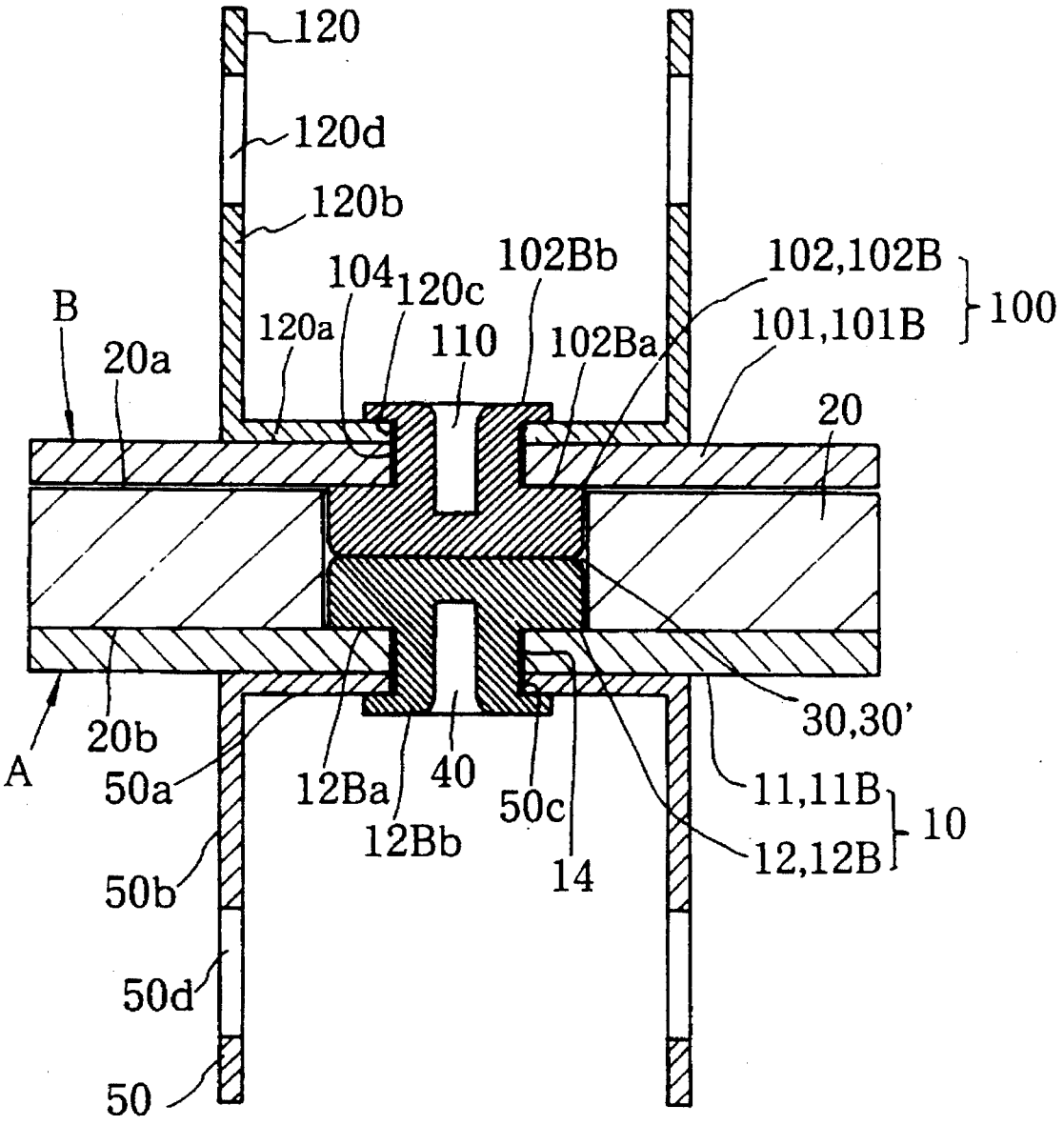
FIG. 34 is a side cross-sectional view of the fastener of the fifth test case fully engaged.
Figure 35:
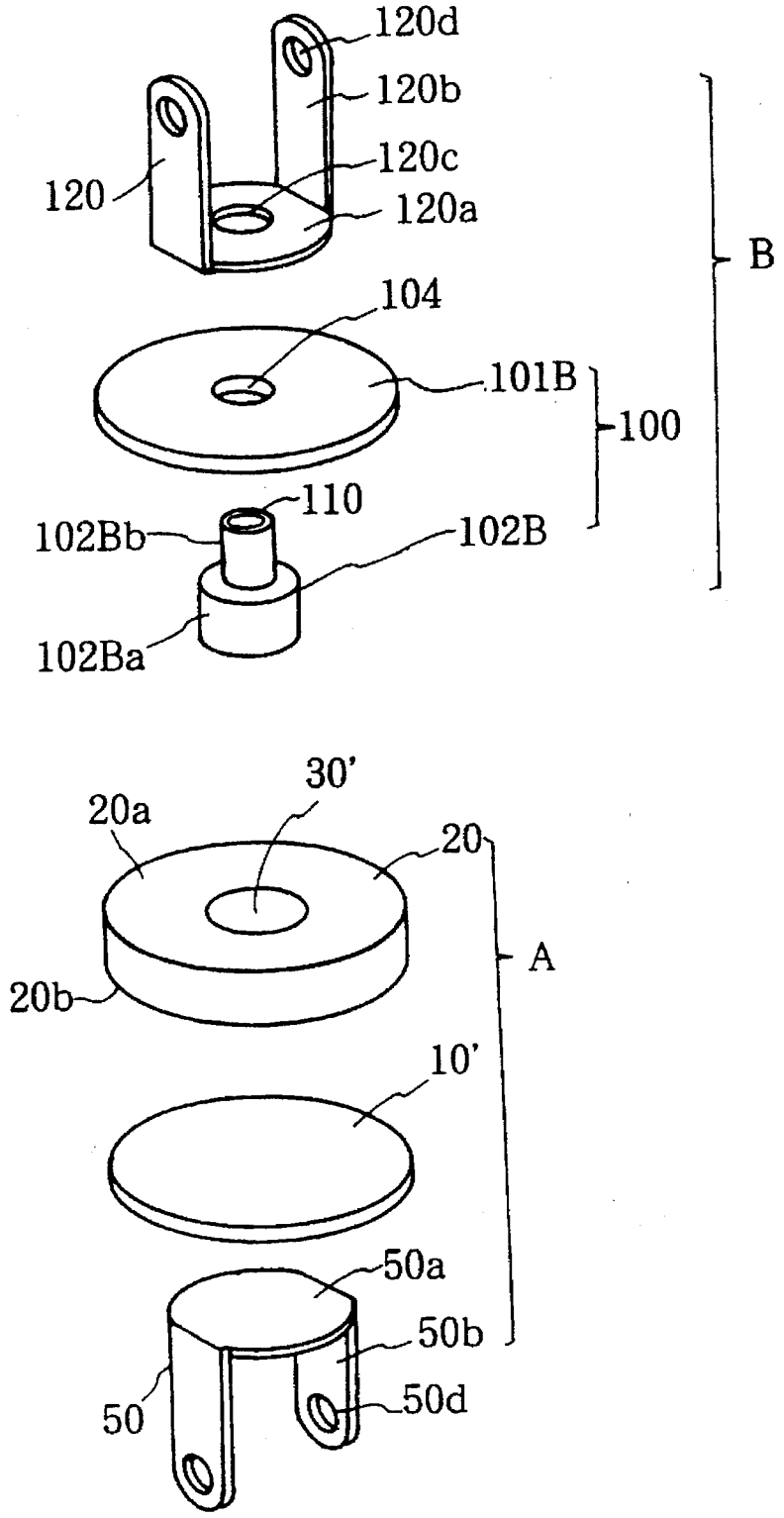
FIG. 35 is an exploded perspective view of a magnetic fastener used in a sixth test case according to the present invention.

Test Case 5: FIGS. 33 and 34

The fastener shown in FIGS. 33 and 34 is essentially same as the fastener shown in the second test case (FIGS. 24–28) except that the ferromagnetic rod blind hole of the fastening element A and the attracted element B in this case is 1.1 mm narrower than that of the second test case. Thus, the hole diameter Me and Qe is 0.9 mm.

Based on this changes, while the cross-sectional areas (taken along lines y—y and y'—y' of FIG. 33) of the larger diameter rod portions 12Ba, 102Ba remains approximately 28.2744 $mm^2$, that of the blind hole 40 is approximately 0.6361 $mm^2$, which is approximately 2.2% of the larger diameter rod cross-sectional area, as in the fourth test case.

At the point of full engagement, an experiment was conducted to measure the amount of tensile force it would take to disconnect the attracted element B from the fastening element A. The fastening element was held stationary while the attaching element 120 of the attracted element B, which was connected to a measurement equipment, was pulled away with gradually increasing force from the fastening element A, during which the force was measured. The following results have been obtained:

The first tensile test: 2.15 kg

The second tensile test: 2.20 kg

The third tensile test: 2.21 kg

Test Case 6: FIGS. 35–39

This fastener is substantially similar to the second embodiment without the cover 60 and are constructed similar to the fastener of the second test case except that the fastening element A does not include a ferromagnetic rod.

Figure 37A:
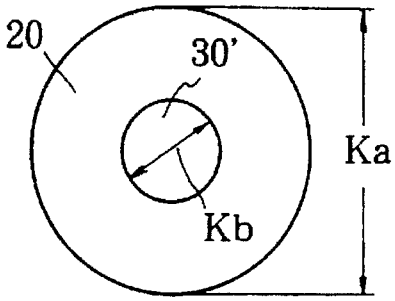
FIGS. 37A–37F show the components of the fastening element of FIG. 35, where.
Figure 37B:
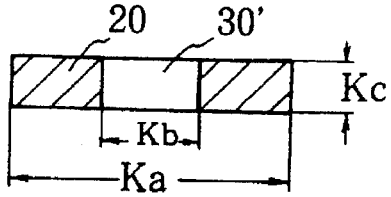

Referring to FIGS. 37A and 37B, the round permanent magnet 20 has the following dimensions and property:

Diameter Ka: 18.0 mm

Hole Diameter Kb: 6.2 mm

Thickness Kc: 3.2 mm

Magnetic Strength: approximately 4.4 Gauss.

Figure 37C:
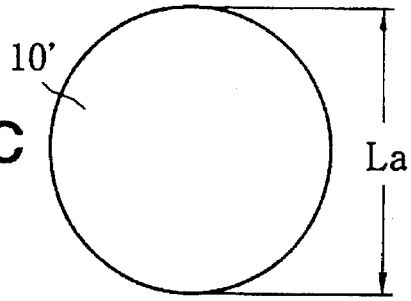
Figure 37D:
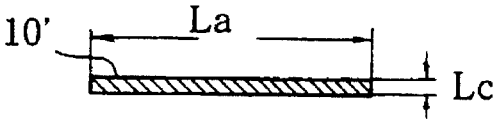

Referring to FIGS. 37C and 37D, the ferromagnetic plate 10' has the following dimensions:

Diameter La: 18.0 mm

Thickness Lc: 1.0 mm.

Referring to FIGS. 36C and 36D, the ferromagnetic plate 101B has the following dimensions:

Diameter La: 18.0 mm

Hole Diameter Pb: 3.0 mm

Thickness Lc: 1.0 mm.

Referring to FIGS. 36E–36G, the ferromagnetic rod 102B has the following dimensions:

Diameter Qa: 6.0 mm

Thickness Qb: 3.3 mm

Hole Diameter Qc: 2.9 mm

Thickness Qd: 2.5 mm

Diameter Qe: 2.0 mm

Thickness Qf: 1.0 mm.

Figure 37E:
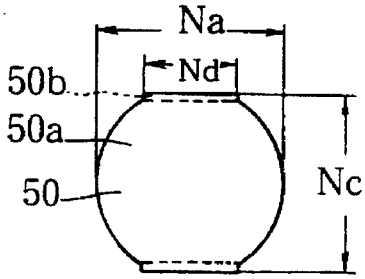
Figure 37F:
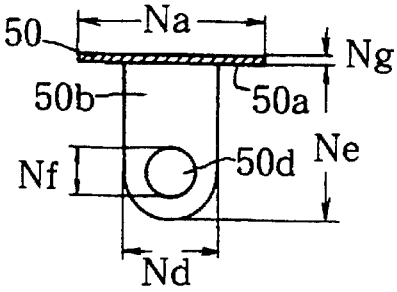
Figure 38:
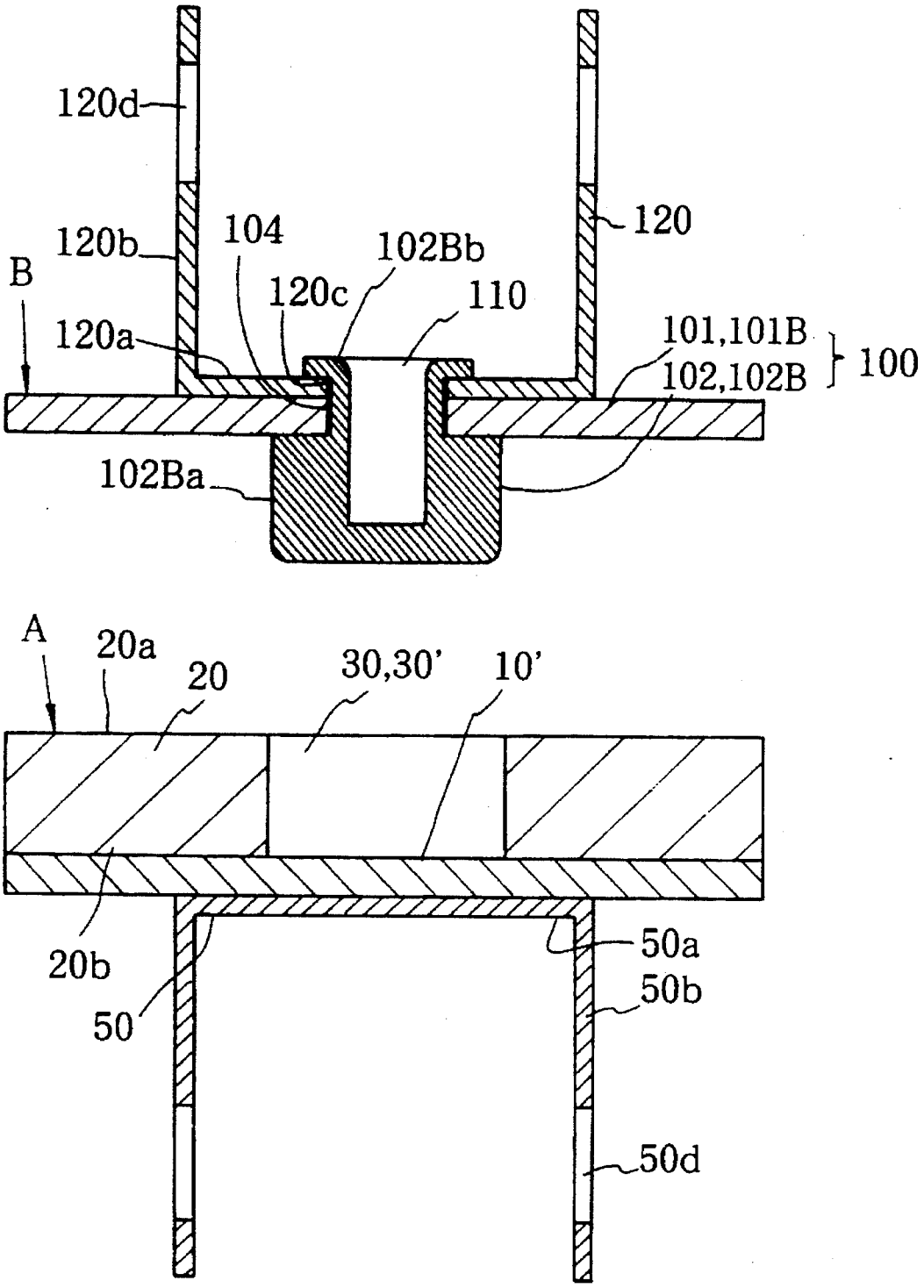
FIG. 38 is a side cross-sectional view of the fastener of FIG. 35 before engagement.
Figure 39:
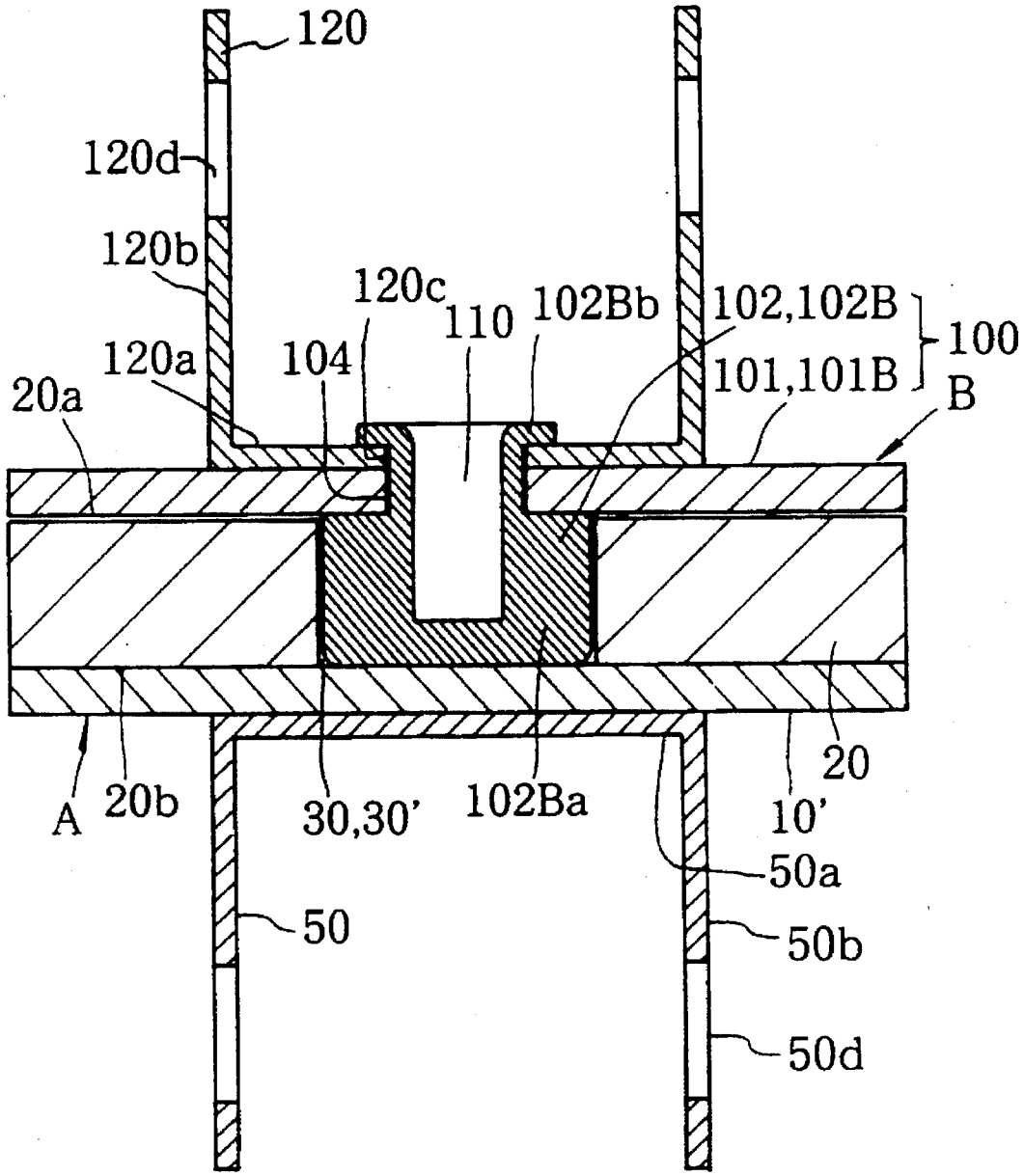
FIG. 39 is a side cross-sectional view of the fastener of FIG. 35 fully engaged.

Referring to FIGS. 37E and 37F, the attaching element 50 has the following dimensions:

Diameter Na: 12.0 mm

Leg Spread Nc: 11.0 mm

Leg Width Nd: 6.0 mm

Leg Length Ne: 10.0 mm

Leg Hole Dia. Nf: 3.0 mm

Thickness Ng: 0.5 mm.

Referring to FIGS. 36A and 36B, the attaching element 120 has the following dimensions:

Diameter Oa: 12.0 mm

Hole Diameter Ob: 3.0 mm

Leg Spread Oc: 11.0 mm

Leg Width Od: 6.0 mm

Leg Length Oe: 10.0 mm

Leg Hole Dia. Of: 3.0 mm

Thickness Og: 0.5 mm.

Based on these dimensions, the cross-sectional areas (taken along line y'—y' of FIG. 36F and shown in FIG. 36G) of the larger diameter rod portion 102Ba is approximately 28.2744 $mm^2$ and that of the blind hole 110 is approximately 3.1416 $mm^2$, which is approximately 11.1% of the larger diameter rod cross-sectional area.

At the point of full engagement, an experiment was conducted to measure the amount of tensile force it would take to disconnect the attracted element B from the fastening element A. The fastening element was held stationary while the attaching element 120 of the attracted element B, which was connected to a measurement equipment, was pulled away with gradually increasing force from the fastening element A, during which the force was measured. The following results have been obtained:

First tensile test: 1.32 kg

Second tensile test: 1.30 kg

Third tensile test: 1.30 kg.

Figure 40:
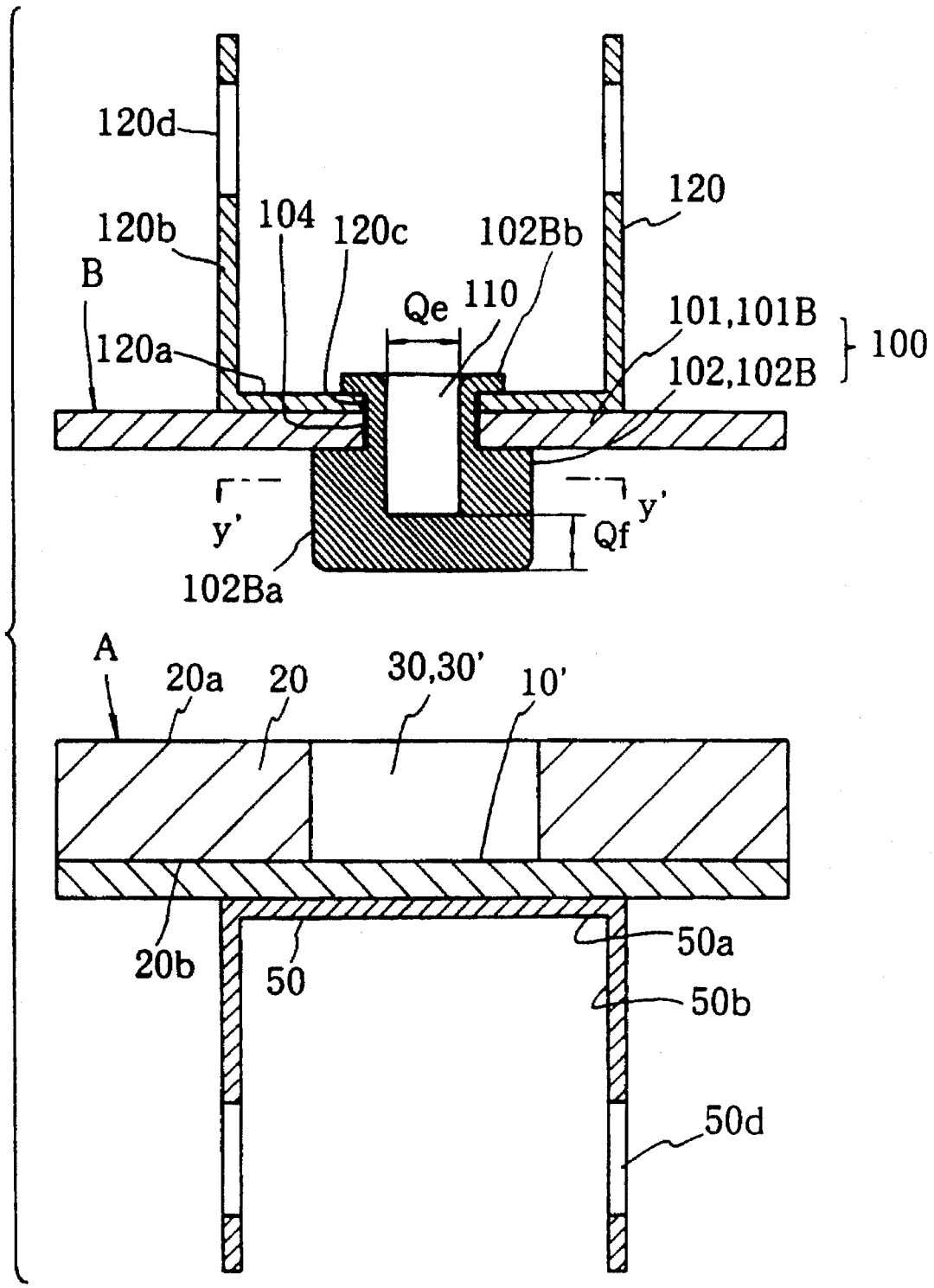
FIG. 40 is a side cross-sectional view of a fastener of a seventh test case according to the present invention before engagement.
Figure 41:
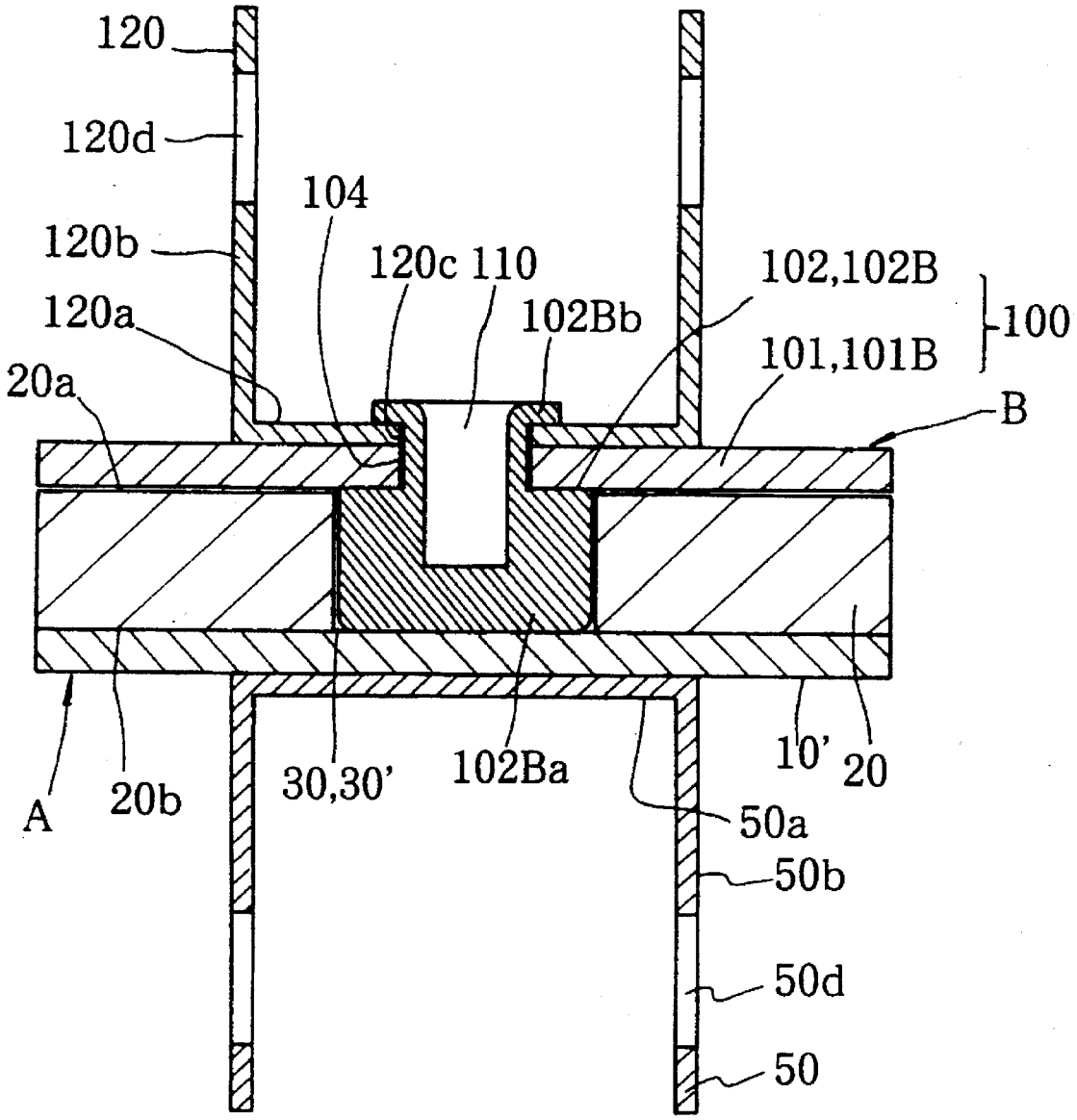
FIG. 41 is a side cross-sectional view of the fastener of the seventh test case fully engaged.
Figure 42:
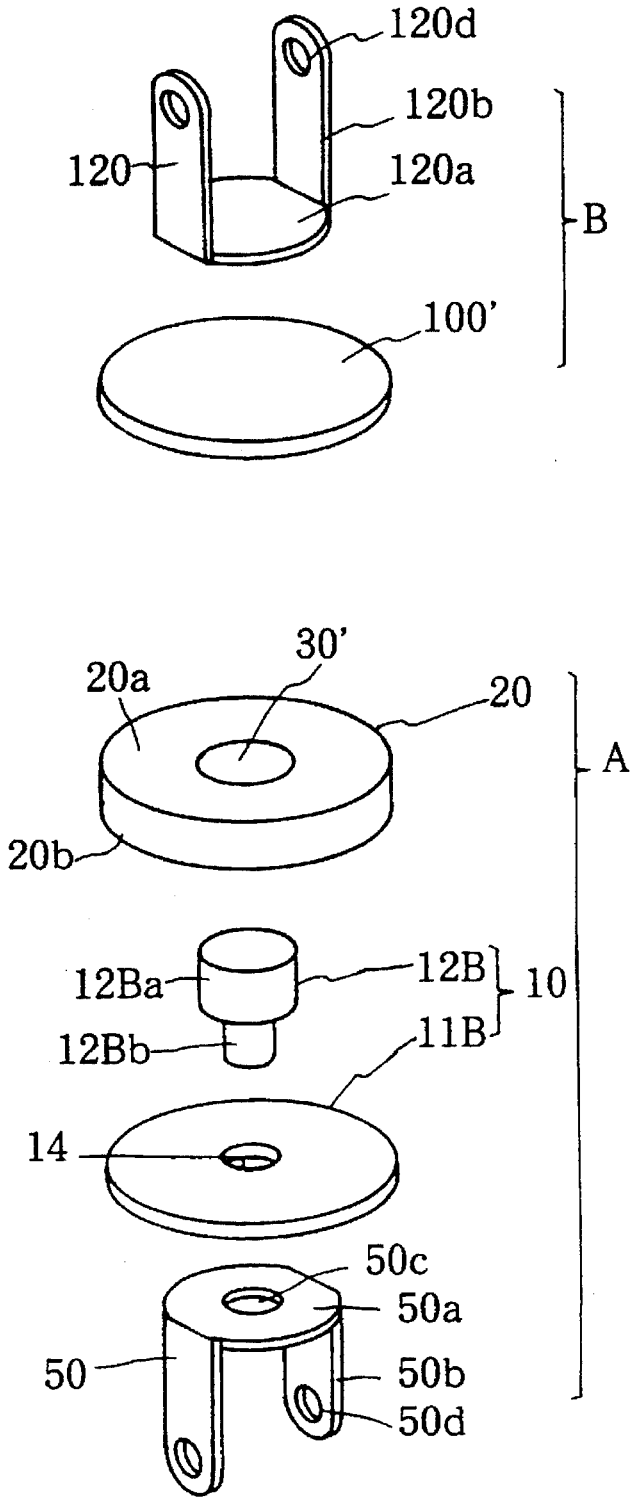
FIG. 42 is an exploded perspective view of a magnetic fastener used in a eighth test case according to the present invention.

Test Case 7: FIGS. 40 and 41

The fastener shown in FIGS. 40 and 41 is essentially same as the fastener shown in the sixth test case (FIGS. 35–39) except that the ferromagnetic rod blind hole depth of the attracted element B in this case is 0.5 mm shallower than that of the sixth test case, where the thicknesses Qf (between the bottom of the blind hole 110 and the distal end of the larger rod portion 102B) is 1.5 mm. The cross-sectional area taken along line y'—y' in FIG. 40 of the larger diameter rod portion 102Ba is approximately 28.2744 $mm^2$ and that of the blind hole 110 is approximately 3.1416 $mm^2$, the blind hole area being unchanged at 11.1% of the ferromagnetic rod area.

At the point of full engagement, an experiment was conducted to measure the amount of tensile force it would take to disconnect the attracted element B from the fastening element A. The fastening element A was held stationary while the attaching element 120 of the attracted element B, which was connected to a measurement equipment, was pulled away with gradually increasing force from the fastening element A, during which the force was measured. The following results have been obtained:

First tensile test: 1.34 kg

Second tensile test: 1.35 kg

Third tensile test: 1.35 kg.

Test Case 8: FIGS. 42–46

The fastener shown in FIGS. 42–46 is similar to the ones shown in FIGS. 35–41 (sixth and seventh test cases) except that the ferromagnetic rod 12B is formed on the fastening element A instead of the attracted element B.

Referring to FIGS. 44A and 44B, the round permanent magnet 20 has the following dimensions and property:

Diameter Ka: 18.0 mm

Hole Diameter Kb: 6.2 mm

Thickness Kc: 3.2 mm

Magnetic Strength: approximately 4.4 Gauss.

Referring to FIGS. 44C and 44D, this ferromagnetic plate has the following dimensions:

Diameter La: 18.0 mm

Hole Diameter Lb: 3.0 mm

Thickness Lc: 1.0 mm.

Referring to FIGS. 44E–44G, the ferromagnetic rod has the following dimensions:

Diameter Ma: 6.0 mm

Thickness Mb: 3.3 mm

Hole Diameter Mc: 2.9 mm

Thickness Md: 2.5 mm

Diameter Me: 2.0 mm

Thickness Mf: 1.0 mm.

Referring to FIGS. 44H and 44I, the attaching element 50 has the following dimensions:

Diameter Na: 12.0 mm

Hole Diameter Nb: 3.0 mm

Leg Spread Nc: 11.0 mm

Leg Width Nd: 6.0 mm

Leg Length Ne: 10.0 mm

Leg Hole Dia. Nf: 3.0 mm

Thickness Ng: 0.5 mm.

Figure 43A:
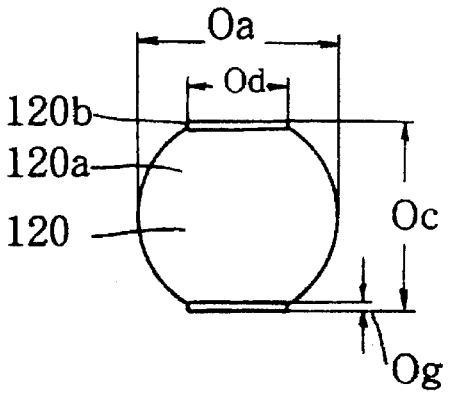
FIGS. 43A–43D show the components of the attracted element of FIG. 42, where.
Figure 43B:
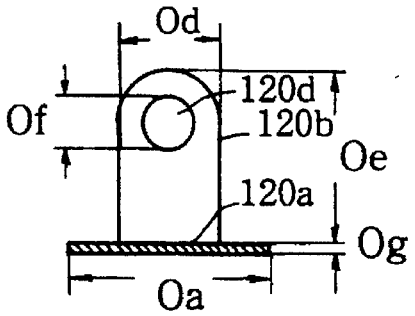
Figure 43C:
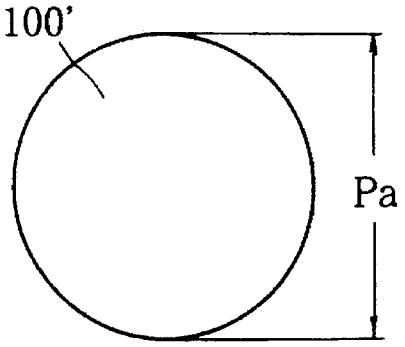
Figure 43D:
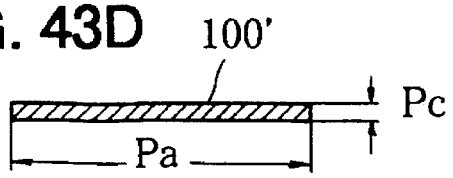
Figure 45:
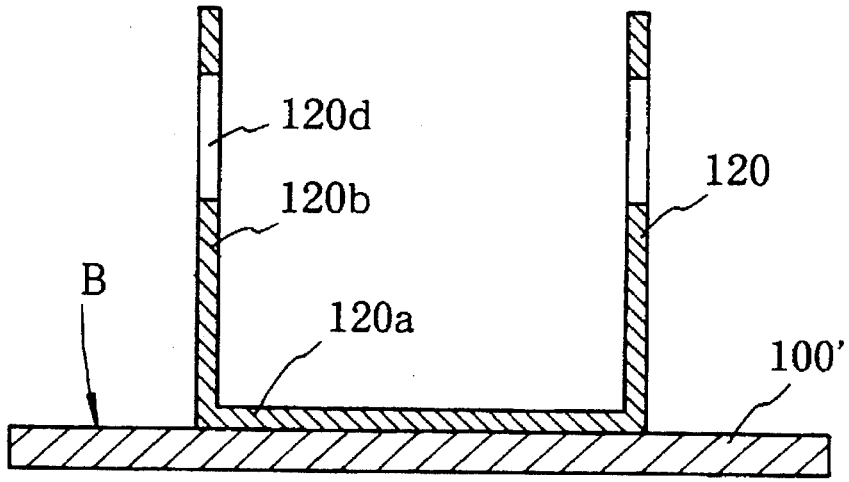
FIG. 45 is a side cross-sectional view of the fastener of FIG. 42 before engagement.
Figure 45:
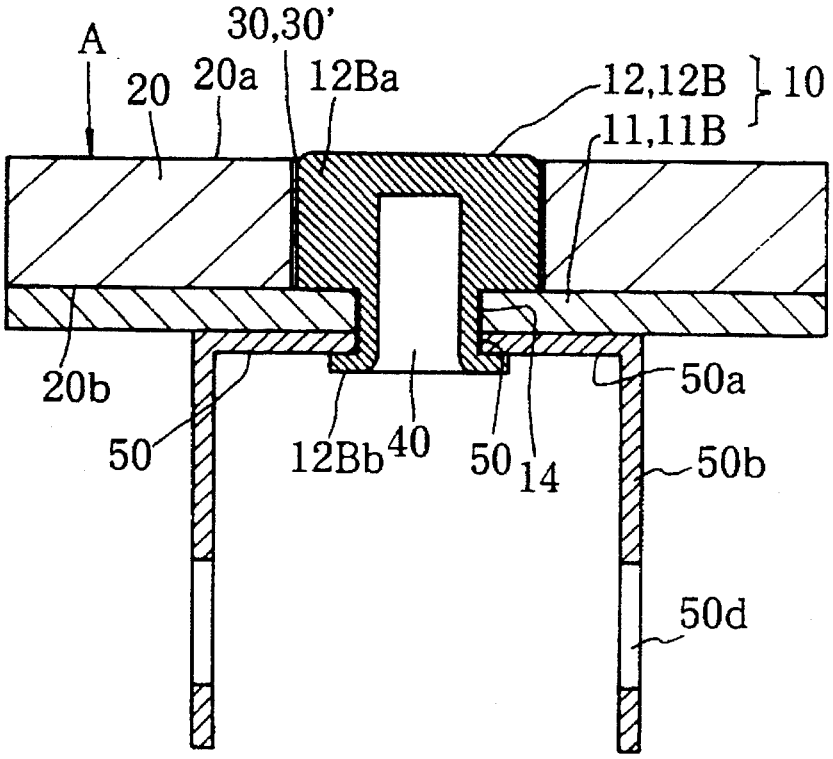
Figure 46:
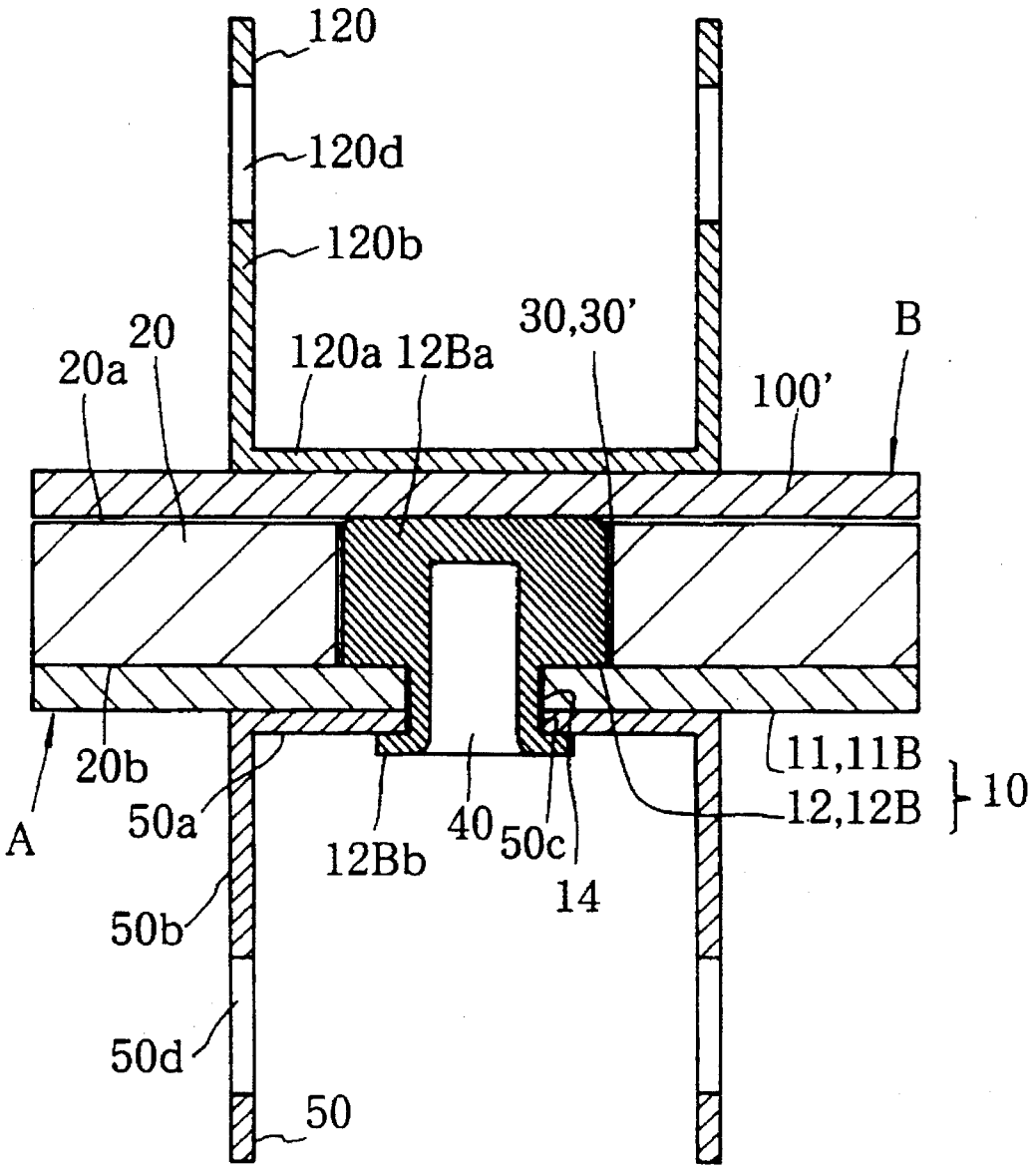
FIG. 46 is a side cross-sectional view of the fastener of FIG. 42 fully engaged.

Referring to FIGS. 43C and 43D, the round ferromagnetic plate 100' has the following dimensions:

Diameter Pa: 18.0 mm

Thickness Pc: 1.0 mm.

Referring to FIGS. 43A and 43B, the attaching element 120, the seat 120*a* of which is soldered to the ferromagnetic plate 100', is made of iron, whose dimensions are as follows:

Diameter Oa: 12.0 mm

Leg Spread Oc: 11.0 mm

Leg Width Od: 6.0 mm

Leg Length Oe: 10.0 mm

Leg Hole Dia. Of: 3.0 mm

Thickness Og: 0.5 mm.

Based on these dimensions, the cross-sectional area (taken along line y—y of FIG. 44F and shown in FIG. 44G)

of the larger diameter rod 12Ba is approximately 28.2744 $mm^2$ and that of the blind hole 40 is approximately 3.1416 $mm^2$, which is approximately 11.1% of the larger diameter rod cross-sectional area.

At the point of full engagement, an experiment was conducted to measure the amount of tensile force it would take to disconnect the attracted element B from the fastening element A. The fastening element A was held stationary while the attaching element 120 of the attracted element B, which was connected to a measurement equipment, was pulled away with gradually increasing force from the fastening element A, during which the force was measured. The following results have been obtained:

First tensile test 1.37 kg

Second tensile test 1.35 kg

Third tensile test 1.33 kg.

Figure 47:
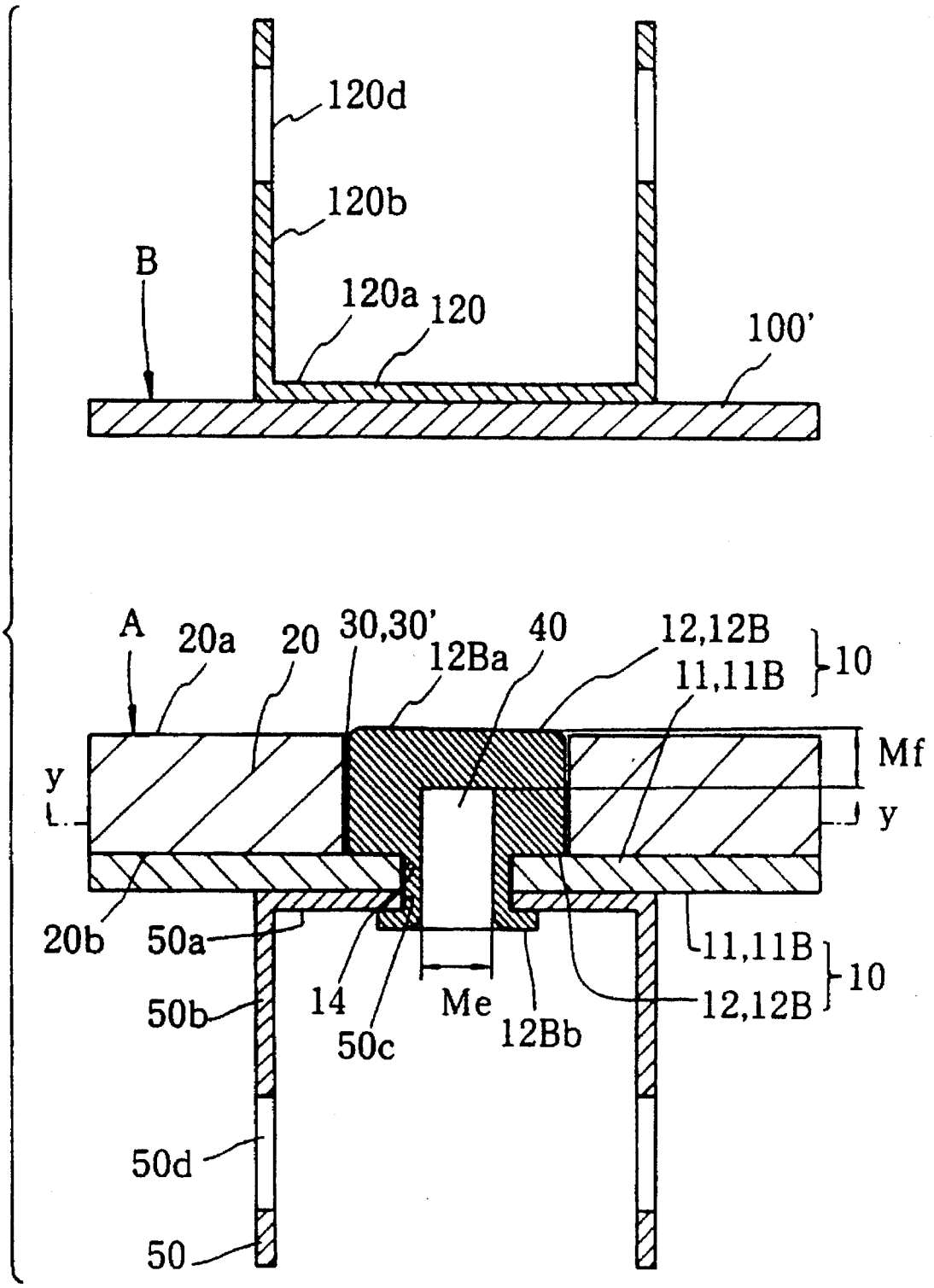
FIG. 47 is a side cross-sectional view of a fastener of a ninth test case according to the present invention before engagement.
Figure 48:
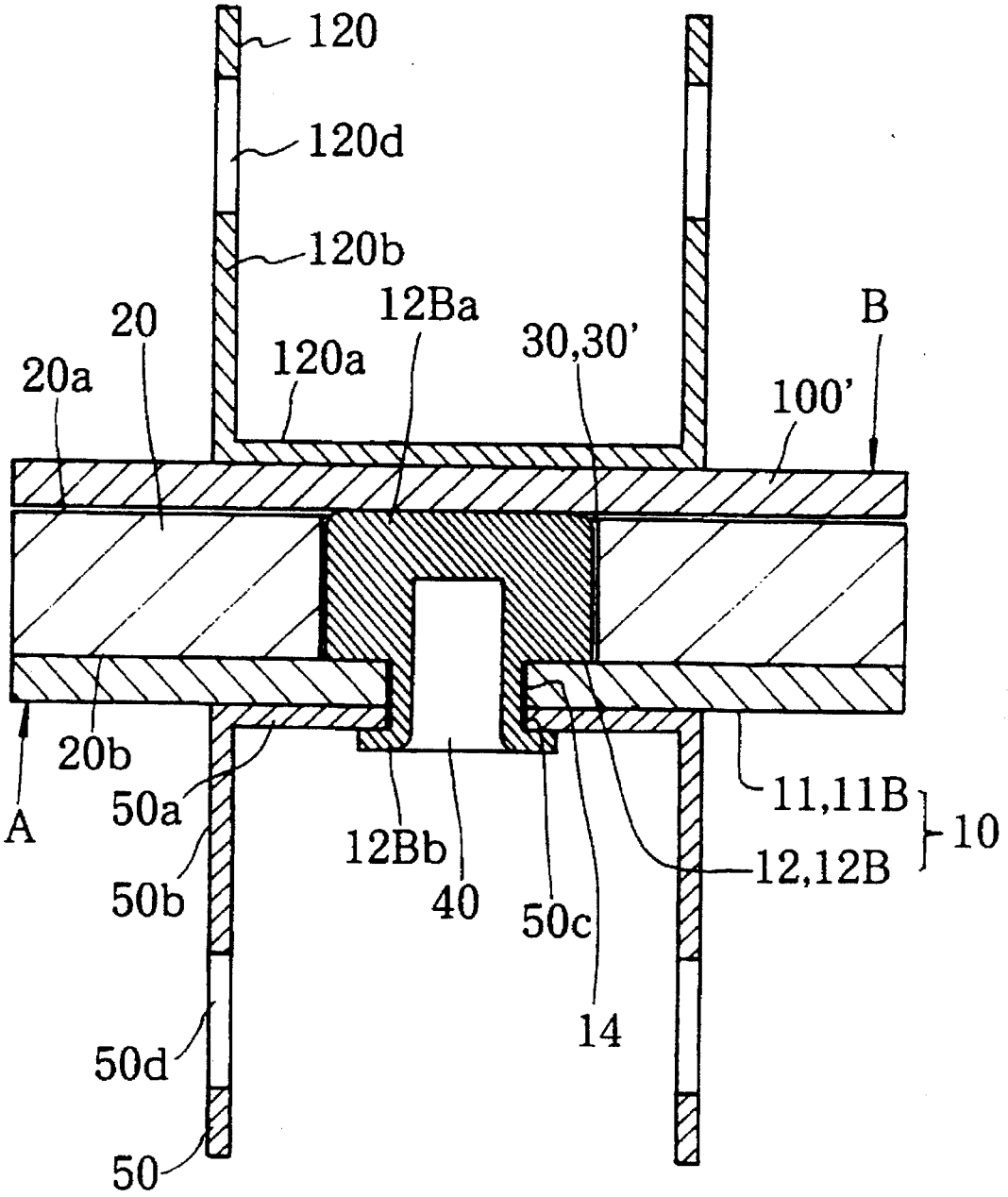
FIG. 48 is a side cross-sectional view of the fastener of the ninth test case fully engaged.

Test Case 9: FIGS. 47 and 48

The fastener shown in FIGS. 47 and 48 is essentially the same as that shown in FIGS. 42–46 (eighth test case) except that the ferromagnetic rod blind hole depth of the attracted element B in this case is 0.5 mm shallower than that of the eighth test case so that the thicknesses Mf (between the bottom of the blind hole 110 and the distal end or apex of the larger rod portion 102B) is 1.5 mm.

At the point of full engagement, an experiment was conducted to measure the amount of tensile force it would take to disconnect the attracted element B from the fastening element A. The fastening element A was held stationary while the attaching element 120 of the attracted element B, which was connected to a measurement equipment, was pulled away with gradually increasing force from the fastening element A, during which the force was measured. The following results have been obtained:

First pull test: 1.37 kg

Second pull test: 1.34 kg

Third pull test: 1.40 kg.

Figure 49:
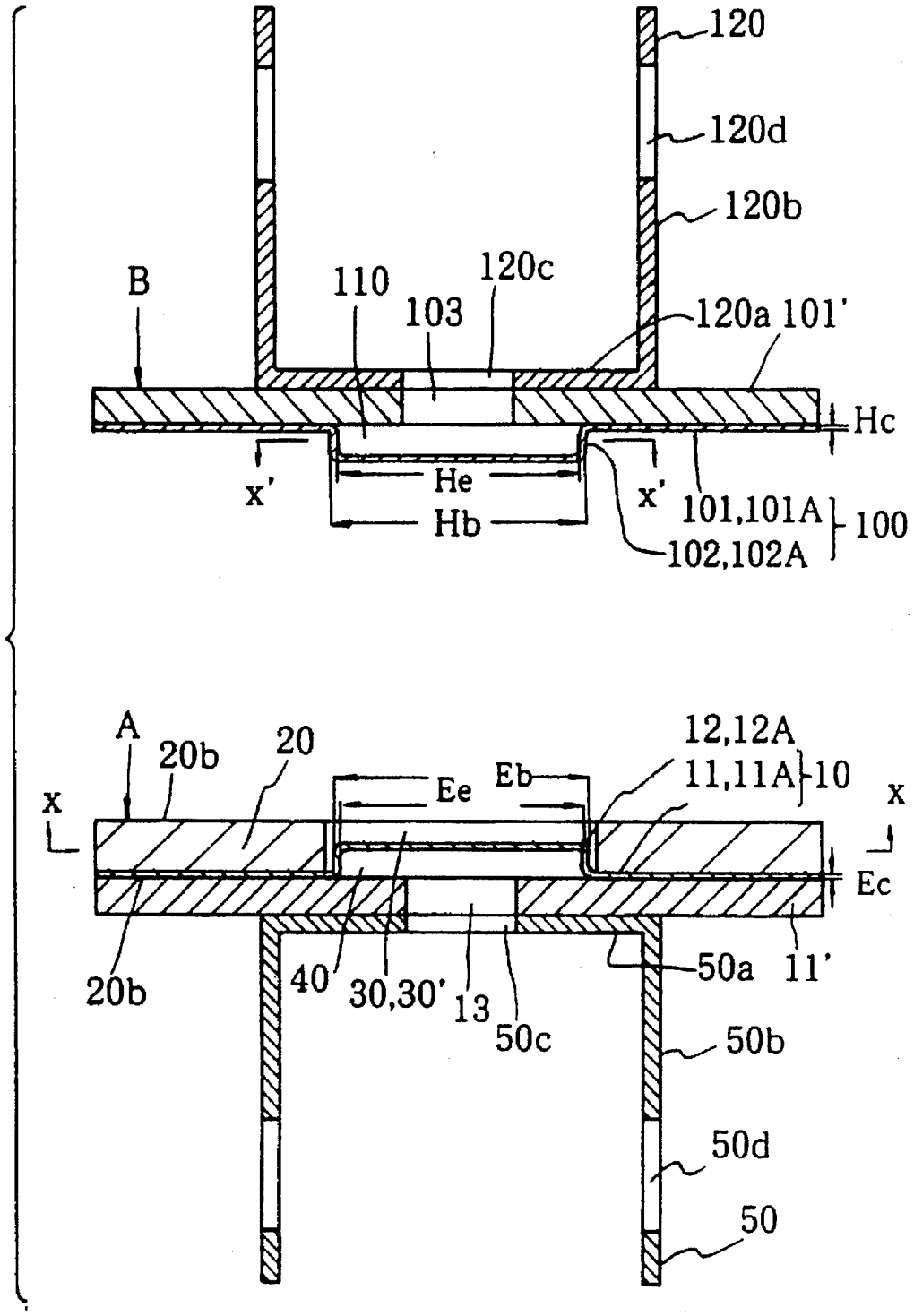
FIG. 49 is a side cross-sectional view of a fastener of a first comparison example according to the present invention before engagement.
Figure 50:
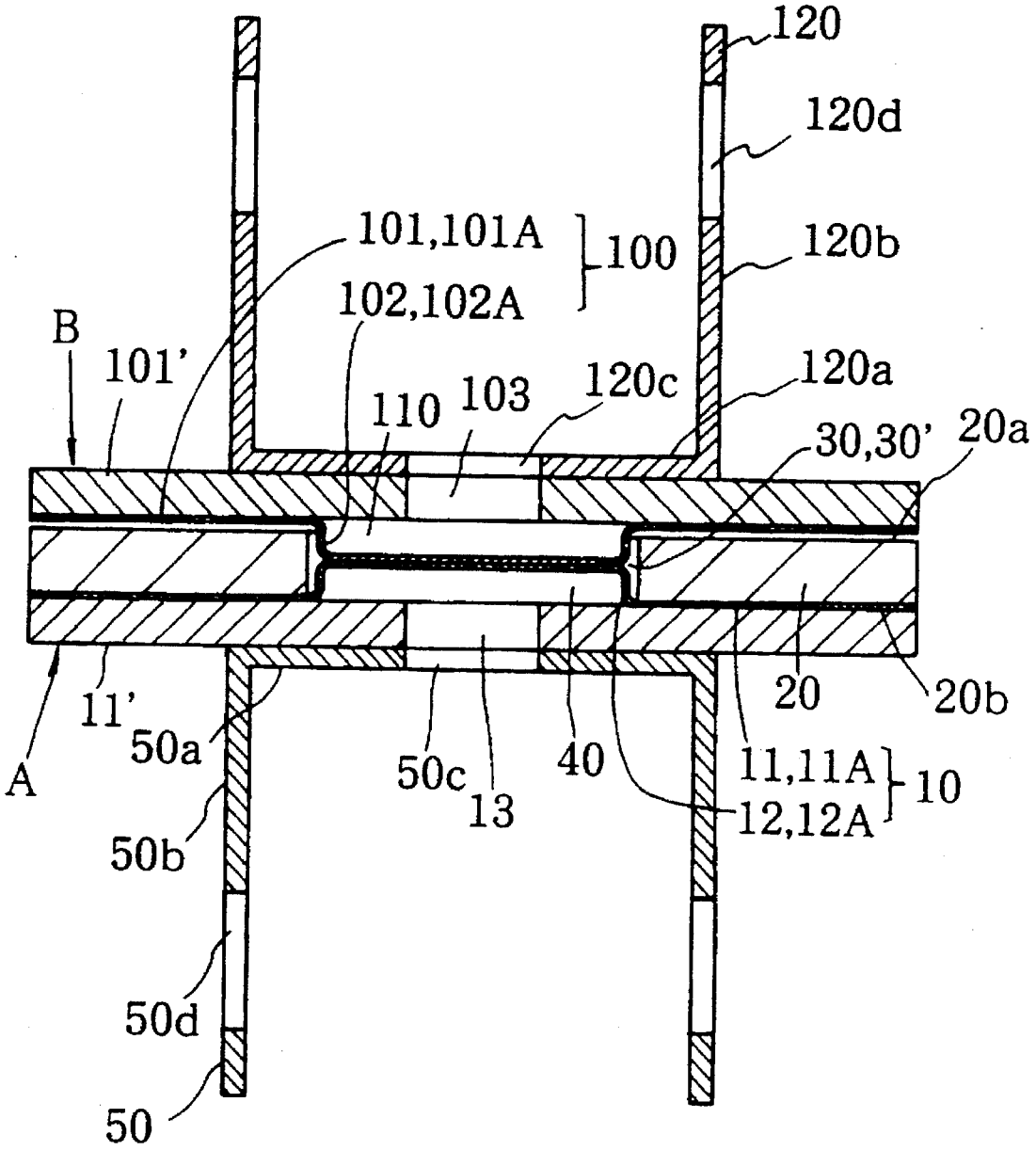
FIG. 50 is a side cross-sectional view of the fastener of the first comparison example fully engaged.

Comparative Example 1: FIGS. 49 and 50

The fastener shown in FIGS. 49 and 50 represents the first comparative example. The fastener according to this embodiment is substantially similar to the embodiment shown in FIGS. 19–23 (first test case), except that the thickness Ec and Hc of the comparative example's ferromagnetic members 10 and 100 is 0.1 mm, forming the following dimensions:

Ferromagnetic Rods 12 and 102

Outer Diameter Eb and Hb: 7.0 mm

Inner Diameter Ee and He: 6.8 mm.

Based on these dimensional changes, the ferromagnetic rod's cross-sectional area taken at line x—x and x'—x' in FIG. 49 is about 38.484 $mm^2$ while that of the hole 40 and 110 is about 36.3168 $mm^2$, which is about 94.4% of the ferromagnetic rod's cross-sectional area.

At the point of full engagement, an experiment was conducted to measure the amount of tensile force it would take to disconnect the attracted element B from the fastening element A. The fastening element was held stationary while the attaching element 120 of the attracted element B, which was connected to a measurement equipment, was pulled away with gradually increasing force from the fastening element A, during which the force was measured. The following results have been obtained:

First tensile test: 0.18 kg

Second tensile test: 0.18 kg

Third tensile test: 0.18 kg.

Figure 51:
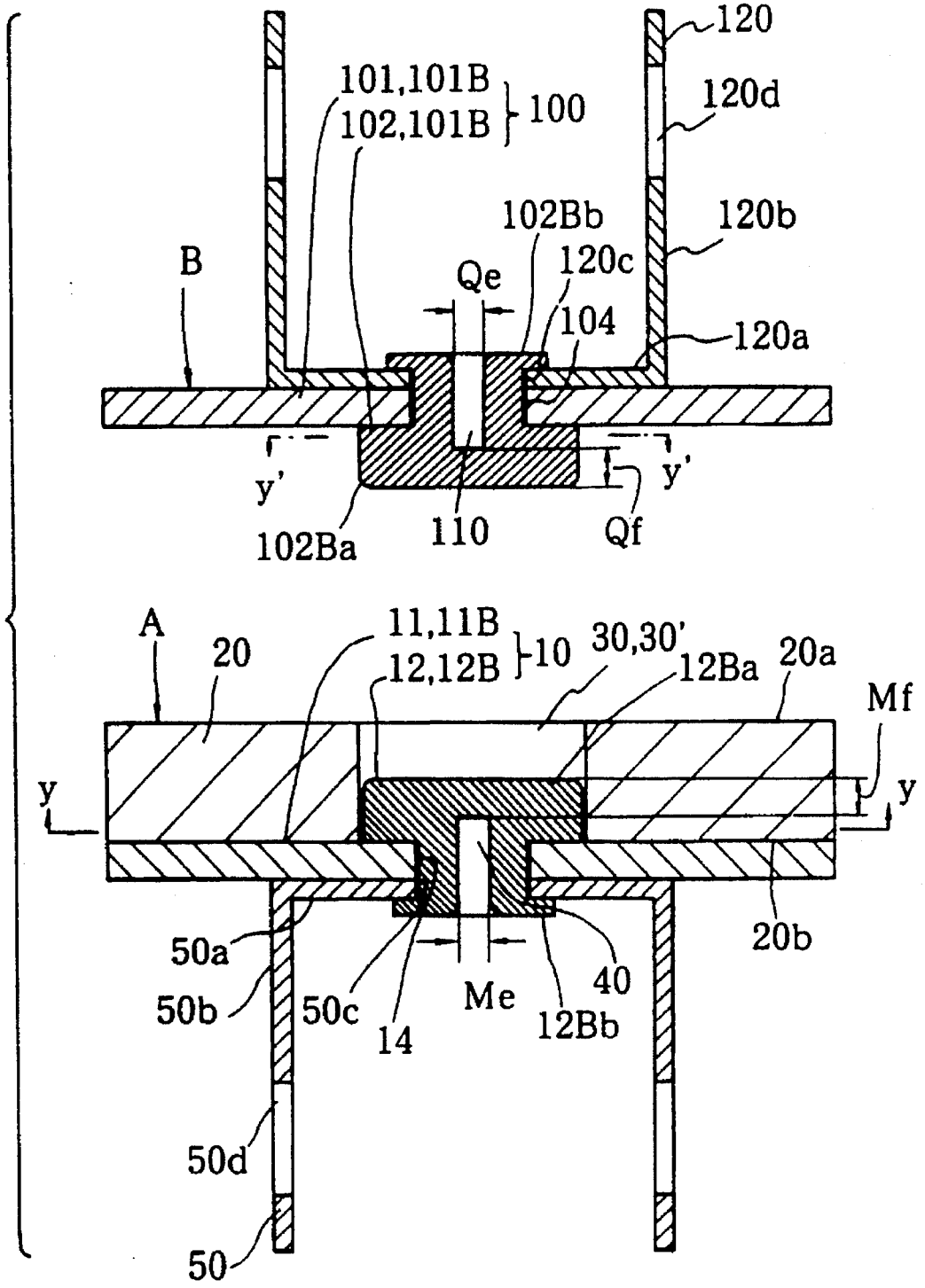
FIG. 51 is a side cross-sectional view of a fastener of a second comparison example according to the present invention before engagement.
Figure 52:
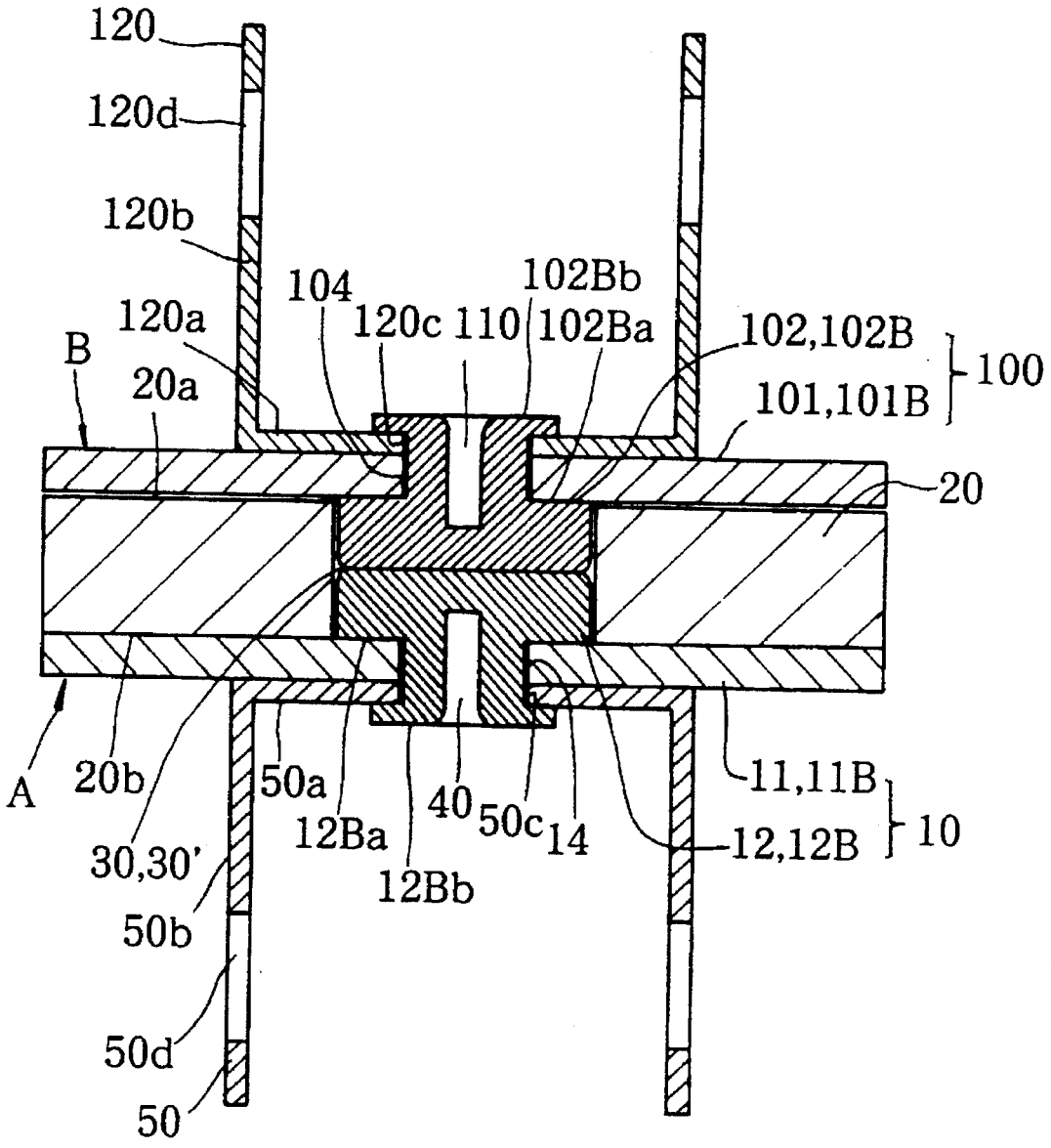
FIG. 52 is a side cross-sectional view of the fastener of the first comparison example fully engaged.

Comparative Example 2: FIGS. 51 and 52

The fastener according to this embodiment is substantially similar to the embodiment of the second test case (FIGS. 24–28), except for the blind hole size. Specifically, the diameter Me and Qe of the second comparative example is 0.8 mm. Based on this dimension, the cross-sectional area of each blind hole 40, 110 taken along respective line y—y, y'—y' is approximately 0.5026 $mm^2$, while that of each ferromagnetic rod 12, 102 is approximately 28.2744 $mm^2$. Thus, the hole's cross-sectional area is about 1.8% that of the rod 12, 102.

At the point of full engagement, an experiment was conducted to measure the amount of tensile force it would take to disconnect the attracted element B from the fastening element A. The fastening element was held stationary while the attaching element 120 of the attracted element B, which was connected to a measurement equipment, was pulled away with gradually increasing force from the fastening element A, during which the force was measured. The following results have been obtained:

First tensile test: 2.17 kg

Second tensile test: 2.16 kg

Third tensile test: 2.16 kg.

Figure 53:
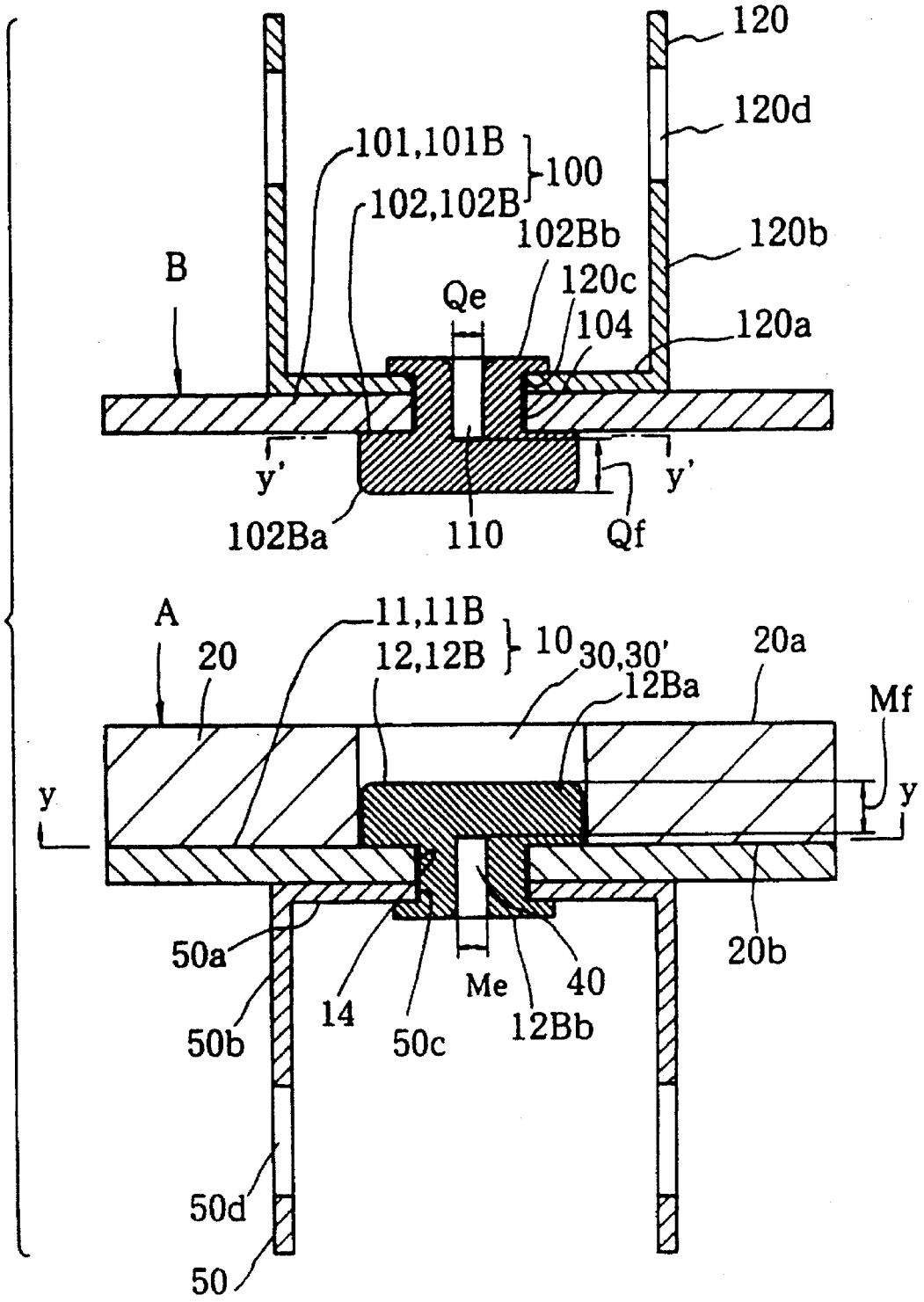
FIG. 53 is a side cross-sectional view of a fastener of a first comparison example according to the present invention before engagement.
Figure 54:
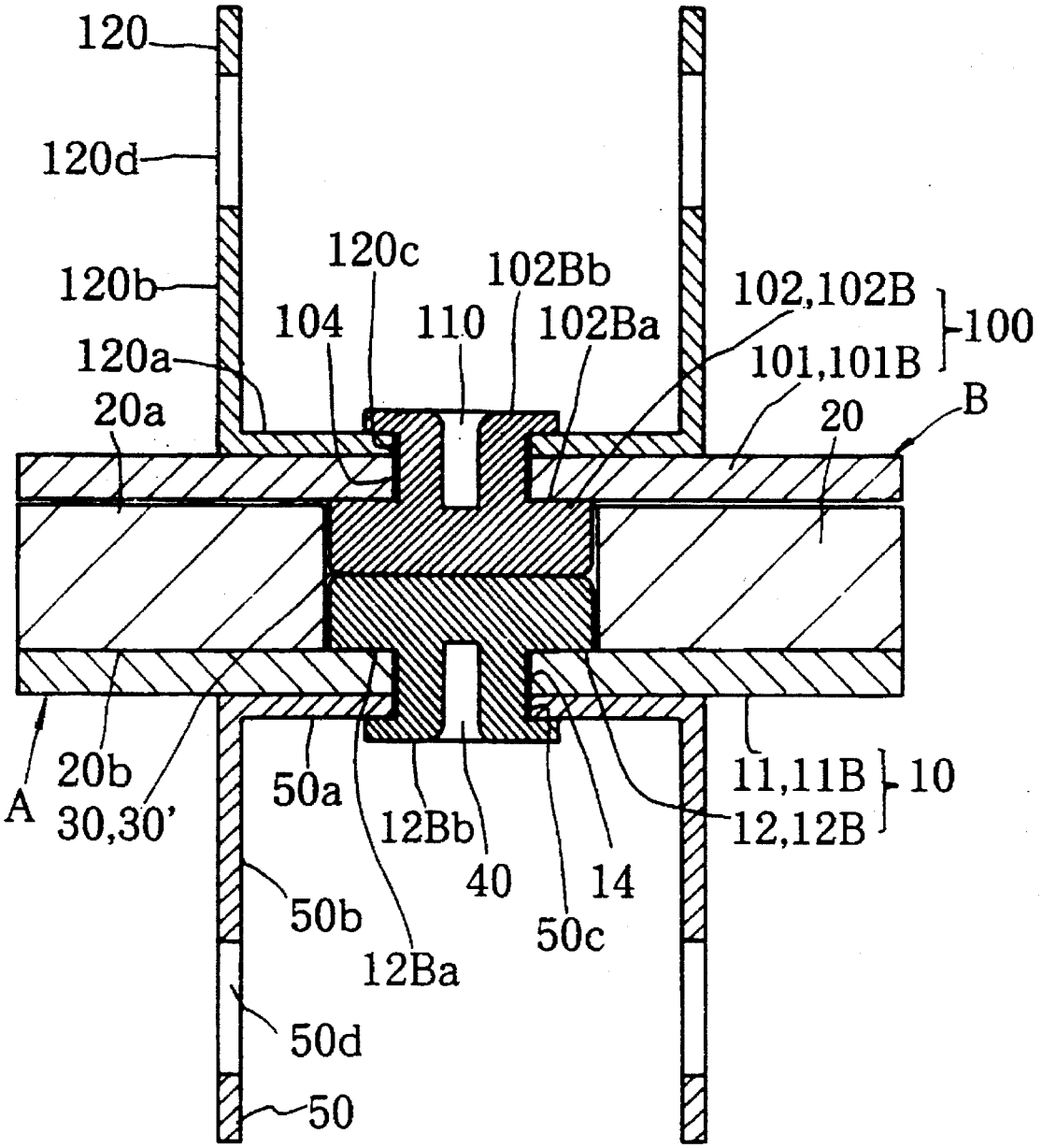
FIG. 54 is a side cross-sectional view of the fastener of the first comparison example fully engaged.

Comparative Example 3: FIGS. 53–54

The fastener according to this embodiment is substantially similar to the second comparative example, except that the blind hole depth is shallower by 0.5 mm (the thickness Mf, Qf being 1.5 mm) in both fastening and attracted elements. The cross-sectional area of the hole 40, 110 remains approximately 1.8% that of the rod 12, 102 as in the second comparative example.

At the point of full engagement, an experiment was conducted to measure the amount of tensile force it would take to disconnect the attracted element B from the fastening element A. The fastening element was held stationary while the attaching element 120 of the attracted element B, which was connected to a measurement equipment, was pulled away with gradually increasing force from the fastening element A, during which the force was measured. The following results have been obtained:

First tensile test: 2.21 kg

Second tensile test: 2.18 kg

Third tensile test: 2.18 kg.

Evaluation

The test cases and comparative examples reveal that smaller the blind hole 40, 110 relative to the rod 12, 102, stronger the holding strength, and vice-versa. In addition, no significant change in the holding strength was found with differing blind hole depths or the thicknesses Mf, Qf of the ferromagnetic rod 12, 102.

Based on these results, no significant increase in pulling force will be created on the fastening element A even if the cross-sectional area of the blind hole 40 or 110 of the fastening element's ferromagnetic rod 12 or 102 is set as low as 1.8% that of the ferromagnetic rod 12 or 102.

In the first test case, both holes 40 and 110 in their respective ferromagnetic rod 12A and 102A cover approximately 88.9% of the total cross-sectional area taken along the line y—y, y'—y' of their respective ferromagnetic rods 12 and 102. In the first comparison example, both holes 40 and 110 in their respective ferromagnetic rod 12 and 102 cover approximately 94.4% of the total cross-sectional area taken along the line y—y, y'—y' of their respective ferromagnetic rods 12A and 102A. In comparing these two examples, the fastener in the first test case has shown a dramatic increase in the pulling force over the fastener in the first comparison test, even though the ratio of the sizes between the holes 40 and 110, and the rod 12 A and 102A is only slightly different.

From above observations of these test case and comparison examples, it is optimal to set the cross-sectional area of the blind hole 40 or 110 to at least 2.2% but not more than 88.9% of the ferromagnetic rod 12 or 102.

The ferromagnetic rod 12 of the fastening element A and the ferromagnetic rod 102 of the attracted element B are designed to concentrate and create a magnetic flux within the magnet hole 30'. As a result of this concentration, a strong magnetic field is created within the hole in the axial direction, concentrating the magnetic attraction to the end or apex of the ferromagnetic rod 12, 102. The blind hole in the ferromagnetic rod 12, 102 therefore do not tend to significantly affect the magnetic strength, within the parameters set above. But it does, however, lighten the fastener.

I claim:

1. A magnetic fastener comprising:

a fastening element having a permanent magnet with a hole substantially parallel to a direction of the magnetic poles, said fastening element having a first ferromagnetic plate having a first thickness and being disposed on a first side of said magnet facing said hole;

an attracted element having a second ferromagnetic plate, said second plate having a second thickness and being adapted for connecting to a second side of said magnet opposite said first side of said magnet facing said hole; and a ferromagnetic rod having a distal end that extends from one side of at least one of said first and second ferromagnetic plates and is insertable into said magnet hole, said ferromagnetic rod defining a blind hole extending from said at least one of said plates into said distal end, wherein a cross-sectional area of said blind hole is at least 2.2% but no more than 88.9% of a cross-sectional area of said distal end, and wherein a cross-sectional wall thickness of said distal end is greater than the thickness of said at least one of said plates.

2. The magnetic fastener of claim 1, wherein said ferromagnetic rod is a rivet.

3. The magnetic fastener of claim 2, wherein said at least one of said plates defines a ferromagnetic plate hole aligned with said rivet and being smaller than said distal end, a proximal end of said rivet being secured to said at least one of said plates through said ferromagnetic plate hole.

4. A magnetic fastener comprising:

a fastening element having a permanent magnet with a hole substantially parallel to a direction of the magnetic poles, said fastening element having a first ferromagnetic plate having a first thickness and being disposed on a first side of said magnet facing said hole, said first ferromagnetic plate having a first ferromagnetic rod with a distal end that extends from a first side of said first plate into said magnet hole; and an attracted element having a second ferromagnetic plate having a second thickness and being adapted for connecting to a second side of said magnet opposite said first side of said magnet facing said hole, said second plate having a second ferromagnetic rod having a distal end that extends from a first side of said second plate and is adapted to be inserted into said magnet hole so that said distal end of said second rod is near said distal end of said first rod when said attracted element is fully engaged with said fastening element, wherein at least one of said first and second ferromagnetic rods defines a blind hole extending from said plate from which said at least one of said rods extends into said distal end of said at least one of said rods, wherein a cross-sectional area of said blind hole is at least 2.2% but no more than 88.9% of a cross-sectional area of said distal end of said at least one of said rods, and wherein a cross-sectional wall thickness of said distal end of said at least one of said rods is greater than the thickness of said plate from which said at least one of said rods extends.

5. The magnetic fastener of claim 4, wherein said distal end of said second rod contacts said distal end of said first rod when said attracted element is fully engaged with said fastening element.

6. The magnetic fastener of claim 4, wherein said at least one of said ferromagnetic rods is a rivet.

7. The magnetic fastener of claim 6, wherein said rivet has a proximal end secured through a ferromagnetic plate hole defined in the plate from which said at least one of said rods extends, said ferromagnetic plate hole being smaller than said distal end.

8. A magnetic fastener comprising:

a fastening element having a permanent magnet with a hole substantially parallel to a direction of the magnetic poles, said fastening element having a first ferromagnetic plate having a first thickness and being disposed on a first side of said magnet facing said hole, said first ferromagnetic plate having a first ferromagnetic rod with a distal end that extends from a first side of said first plate into said magnet hole; and an attracted element having a second ferromagnetic plate adapted for connecting to a second side of said magnet opposite said first side of said magnet facing said hole, wherein said distal end of said rod extends to said second plate when said attracted element is fully engaged with said fastening element, and wherein said rod defines a blind hole extending from said first plate into said distal end of said rod, wherein a cross-sectional area of said blind hole is at least 2.2% but no more than 88.9% of a cross-sectional area of said distal end, and wherein a cross-sectional wall thickness of said rod is greater than the thickness of said first plate.

9. The magnetic fastener of claim 8, wherein said ferromagnetic rod is a rivet.

10. The magnetic fastener of claim 9, wherein said first plate defines a ferromagnetic plate hole aligned with said rivet and being smaller than said distal end, a proximal end of said rivet being secured to said first plate through said ferromagnetic plate hole.

* * * * *